US010741957B2

(12) United States Patent
Hara et al.

(10) Patent No.: US 10,741,957 B2
(45) Date of Patent: Aug. 11, 2020

(54) TERMINAL MODULE AND CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Teruo Hara, Mie (JP); Hiroyoshi Maesoba, Mie (JP); Toshifumi Ichio, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/313,705

(22) PCT Filed: Jun. 12, 2017

(86) PCT No.: PCT/JP2017/021579
§ 371 (c)(1),
(2) Date: Dec. 27, 2018

(87) PCT Pub. No.: WO2018/003466
PCT Pub. Date: Jan. 4, 2018

(65) Prior Publication Data

US 2019/0319389 A1 Oct. 17, 2019

(30) Foreign Application Priority Data

Jun. 29, 2016 (JP) ..... 2016-128583

(51) Int. Cl.
*H01R 13/426* (2006.01)
*H01R 13/6581* (2011.01)

(52) U.S. Cl.
CPC ..... *H01R 13/426* (2013.01); *H01R 13/6581* (2013.01)

(58) Field of Classification Search
CPC ... H01R 13/6581; H01R 13/426; H01R 9/038
See application file for complete search history.

(56) References Cited

U.S. PATENT DOCUMENTS 4,915,641 A * 4/1990 Miskin ..... H01R 13/631 439/247
5,236,375 A * 8/1993 Kachlic ..... H01R 13/6275 439/607.13

(Continued)

FOREIGN PATENT DOCUMENTS

JP 61-024983 2/1986
JP 6-054242 7/1994

(Continued)

OTHER PUBLICATIONS

International Search Report dated Aug. 29, 2017.

*Primary Examiner* — Briggitte R. Hammond
(74) *Attorney, Agent, or Firm* — Gerald E. Hespos; Michael J. Porco; Matthew T. Hespos

(57) ABSTRACT

A terminal module M1 is to be accommodated into an outer housing 30, and includes male terminals 20 to be connected to ends of signal wires 11, a first terminal holding member 61 including accommodation recesses 78 for accommodating the terminals 20 inserted in a direction intersecting an extending direction of the terminals 20 with tip parts 21 of the terminals 20 projecting, and a second terminal holding member 65 to be assembled with the first terminal holding member 61. The second terminal holding member 65 is relatively movable toward ends of the signal wires 11 from a terminal tip protection position where the second terminal (Continued)

holding member 65 covers tip parts 21 of the terminals 20 projecting from the first terminal holding member 61.

12 Claims, 95 Drawing Sheets

(56) References Cited

U.S. PATENT DOCUMENTS

| | | | | |
|---|---|---|---|---|
| 7,578,697 | B2 * | 8/2009 | Wang | H01R 13/506 439/497 |
| 8,764,486 | B2 * | 7/2014 | Ii | H01R 9/038 439/607.46 |
| 8,840,435 | B2 * | 9/2014 | Plazio | H01R 13/506 439/607.41 |
| 8,894,448 | B2 * | 11/2014 | Affeltranger | H01R 4/2433 439/701 |
| 2007/0270036 | A1 * | 11/2007 | Belopolsky | H01R 9/032 439/607.41 |
| 2013/0023155 | A1 | 1/2013 | Ii | |
| 2013/0052866 | A1 * | 2/2013 | Ii | H01R 13/6581 439/607.41 |
| 2013/0288522 | A1 | 10/2013 | Ii | |

FOREIGN PATENT DOCUMENTS

| | | |
|---|---|---|
| JP | 2001-015225 | 1/2001 |
| JP | 2013-25967 | 2/2013 |
| JP | 2013-229254 | 11/2013 |
| JP | 2013-229255 | 11/2013 |

* cited by examiner

TERMINAL MODULE AND CONNECTOR

BACKGROUND

Field of the Invention

The invention relates to a terminal module and a connector for accommodating the terminal module.

Related Art

A shielded cable for high frequency has signal wires, a shield layer surrounding the signal wires and an insulation coating around the shield layer so that electromagnetic noise hardly radiates to outside and so that the shielded cable is hardly affected by electromagnetic noise from outside. Japanese Unexamined Patent Publication No. 2013-229255 discloses a connector that can be used with such a shielded cable.

This shield connector by connecting inner conductor terminals (male terminals) to conductor parts of signal wires with an insulation coating on an end of a shielded cable stripped to expose a shield layer. The shield connector is accommodated into an inner housing made of synthetic resin in a state where the tips of the inner conductor terminals are projecting. Thereafter, the inner housing is inserted into a box-shaped outer conductor shell (referred to as a shield shell in Japanese Unexamined Patent Publication No. 2013-229255) and is accommodated at a predetermined position in the outer conductor shell. Finally, a barrel of the outer conductor shell is caulked to the exposed shield layer, thereby connecting the shield layer to the outer conductor shell.

However, tip parts of the inner conductor terminals are exposed in the shield connector described in Japanese Unexamined Patent Publication No. 2013-229255. Thus, the tip parts may be deformed by contacting outside when accommodating the inner conductor terminals into the outer conductor shell. Further, the tip parts of the inner conductor terminals may be deformed by contacting an outer housing or the like when accommodating the inner housing into the outer housing.

SUMMARY

A terminal module disclosed in this specification is to be accommodated into an outer housing and includes a male terminal to be connected to an end of a signal wire, a first terminal holding member including an accommodation recess for accommodating the terminal inserted in a direction intersecting an extending direction of the terminal with a tip part of the terminal projecting, and a second terminal holding member to be assembled with the first terminal holding member. The second terminal holding member is relatively movable toward an end of the signal wire from a terminal tip protection position where the second terminal holding member covers the tip part of the terminal projecting from the first terminal holding member.

According to this configuration, the terminal holding member capable of accommodating the terminal is divided into the first and second terminal holding members. The tip part of the terminal projecting from the first terminal holding member is covered by the second terminal holding member, and the second terminal holding member relatively moves toward the end of the signal wire. Thus, the tip part of the terminal projects forward of the second terminal holding member to be exposed. That is, since the terminal can be accommodated in the outer housing with the tip thereof covered and protected by the second terminal holding member, the deformation of the terminal such as when the terminal is accommodated into the outer housing can be suppressed.

Plural terminals may be provided and may be accommodated respectively into plural accommodation recesses.

Generally, plural signal wires are covered collectively with a shield layer or two signal wires are twisted to be less affected by noise. However, it is necessary to strip the shield layer or to untwist the signal wires in connected parts of the signal wires and the terminals. Terminals are accommodated sequentially into a terminal holding member. As one terminal is being accommodated, the remaining terminal(s) is/are retracted in an extending direction of the terminals. Thus, the shield layer needs to be stripped or the signal wires needs to be untwisted by as much as the length of the terminals or longer. However, the above-described configuration accommodates the terminal into the terminal holding member through an opening provided in the direction intersecting the extending direction. Thus, the other terminal(s) must only be retracted outward of accommodation recesses when accommodating one terminal into the corresponding accommodation recess. Thus, a stripping dimension of the shield layer or an untwisting dimension can be shorter as compared to the case where the terminals are accommodated in the extending direction of the terminals, and there is less influence of noise.

The first and second terminal holding members may include partial locking portions for locking the first and second terminal holding members to each other at the terminal tip protection position and full locking portions for locking the first and second terminal holding members to each other at a position shifted toward the end of the signal wire. According to this configuration, the partial locking portions lock the first and second terminal holding members with the tip part of the terminal covered by the second terminal holding member (at the terminal tip protection position). Thus, there is no possibility that the first and second terminal holding members inadvertently move to expose the tip part of the terminal, such as while the terminal is being accommodated into the outer housing. Further, the first and second terminal holding members are locked by the full locking portions with the tip part of the terminal exposed (position shifted toward the end of the signal wire). Thus, there is no possibility that the first and second terminal holding members inadvertently relatively move to return to the state where the tip part of the terminal is covered.

In a connector including the terminal module and the outer housing for accommodating the terminal module, the outer housing may be an outer conductor shell made of metal. If the tip part of the terminal is exposed, the tip part may contact the outer conductor shell. However, the second terminal holding member covers the tip part of the terminal. Thus, there is no possibility that the tip part of the terminal contacts the outer conductor shell to be deformed.

The outer conductor shell may be divided into two. One outer conductor shell may include an opening larger than the first and second terminal holding members with the tip part of the terminal covered by the second terminal holding member, and the other outer conductor shell may cover the opening. In this configuration, the one outer conductor shell includes the opening larger than the first and second terminal holding members with the tip part of the terminal covered by the second terminal holding member. Thus, the first and second terminal holding members are more easily insertable through the opening. Further, since the opening is covered by the other outer conductor shell, frequency characteristic deterioration caused by providing the opening can be suppressed.

The outer housing may be a connector housing made of synthetic resin and may include an insertion opening through which the terminal module is inserted in the extending direction of the terminal with the tip part of the terminal in the lead. According to this configuration, the tip part of the terminal in an exposed state easily contacts a wall surface of the connector housing. Thus, it is preferable to use the terminal module in which the tip part of the terminal is protected, until the terminal is accommodated to a predetermined position.

The second terminal holding member may include a second engaging portion engageable with the outer housing. In this configuration, the second terminal holding member can be fixed to the outer housing when relatively moving the second and first terminal holding members, and the first terminal holding member is moved easily with respect to the second terminal holding member.

The first terminal holding member may include a first locking portion lockable to the outer housing at a position shifted toward the end of the signal wire. In this configuration, the first terminal holding member is locked to the outer housing in a state where the first terminal holding member is moved toward the end of the signal wire and the tip part of the terminal protrudes from the second terminal holding member in the outer housing. Thus, there is no unintended movement of the first terminal holding member after reaching a state connectable to the mating connector.

The first terminal holding member may include a terminal locking portion for locking the terminal and a first engaging portion engageable with the outer housing. In this configuration, the first terminal holding member can be fixed to the outer housing when moving the first terminal holding member with respect to the second terminal holding member, and the second terminal holding member easily is moved with respect to the first terminal holding member. Further, the terminal is locked to the first terminal holding member by the terminal locking portion and the first terminal holding member does not move by being fixed to the outer housing. Thus, a timing of moving the second terminal holding member can be delayed.

According to the terminal module and the connector disclosed in this specification, the tip part of the male terminal can be protected.

BRIEF DESCRIPTION OF DRAWINGS

FIG. 28 is a section in the state before the lower terminal holding member is moved forward.

DETAILED DESCRIPTION

First Embodiment

A first embodiment is described with reference to FIGS. 1 to 31.

Figure 3:
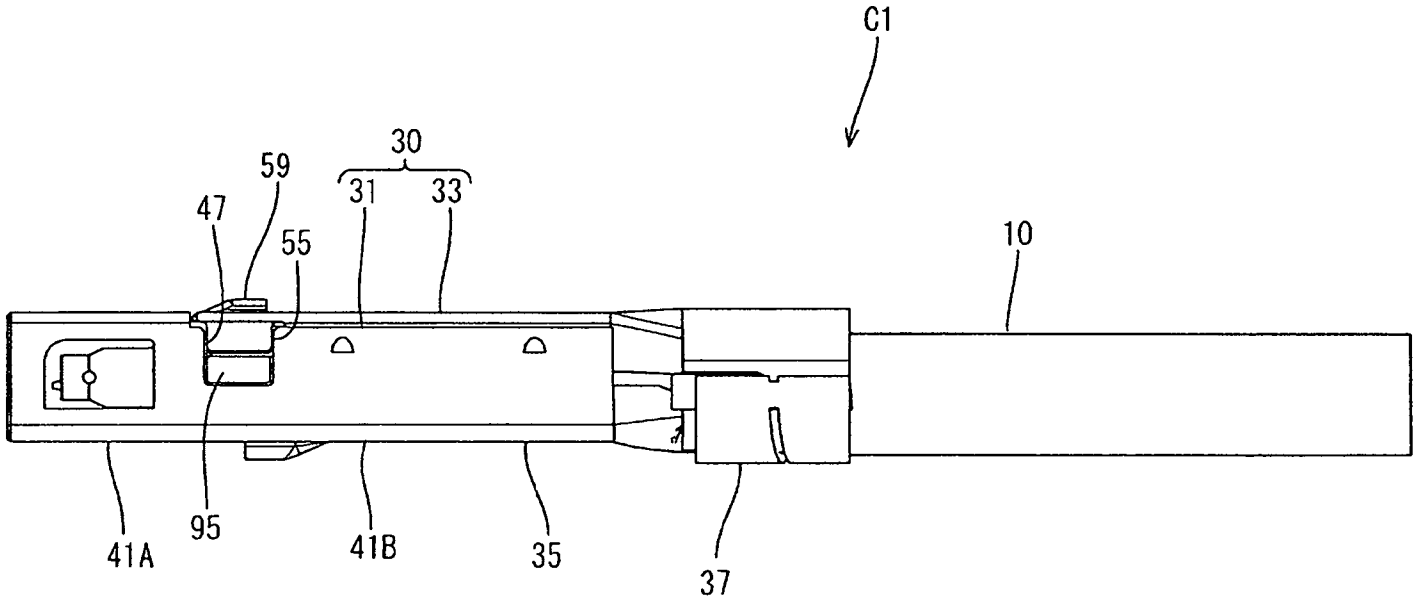
FIG. 3 is a side view of the shield connector.
Figure 23:
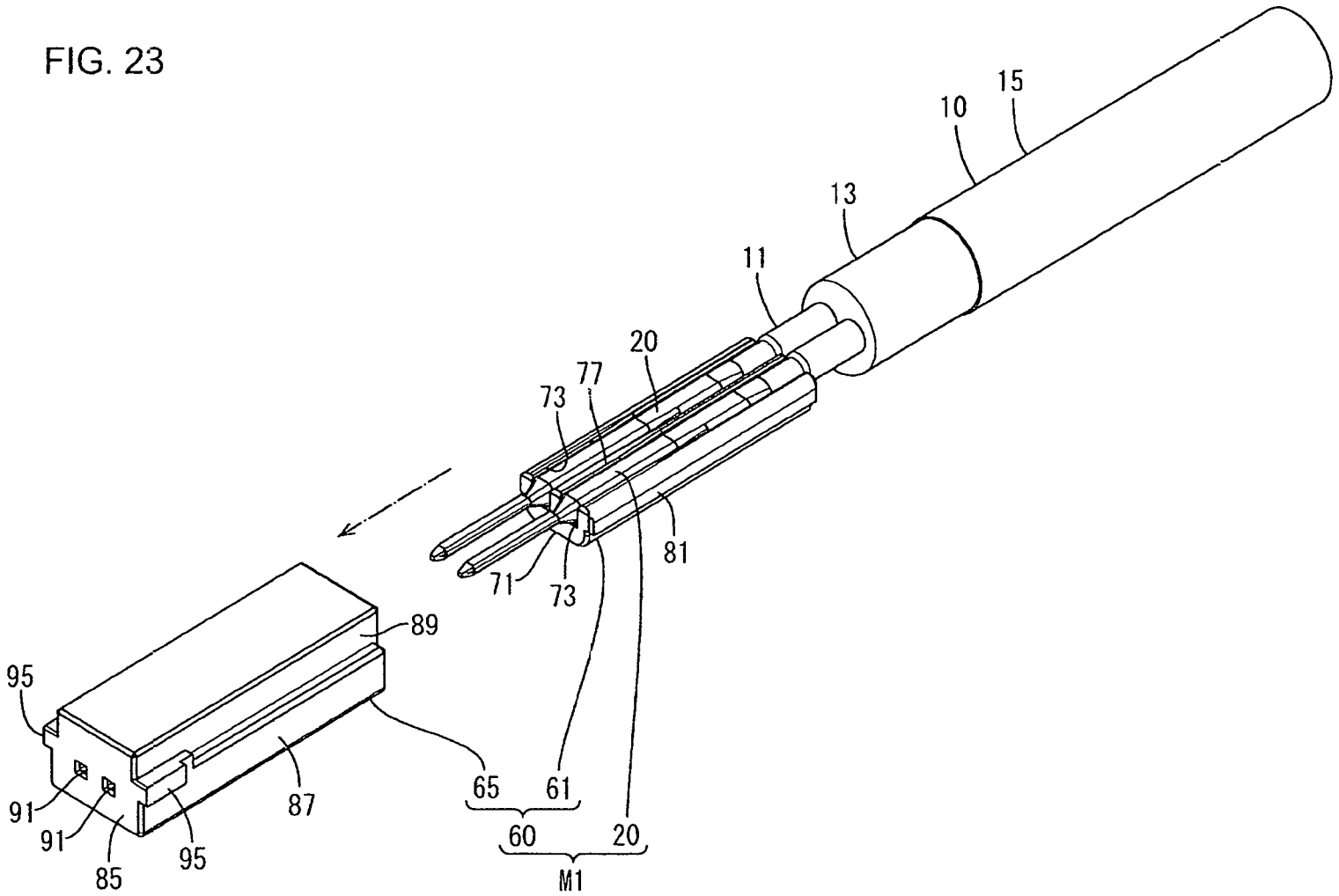
FIG. 23 is a perspective view in a state before the lower terminal holding member is assembled with the upper terminal holding member.
Figure 30:
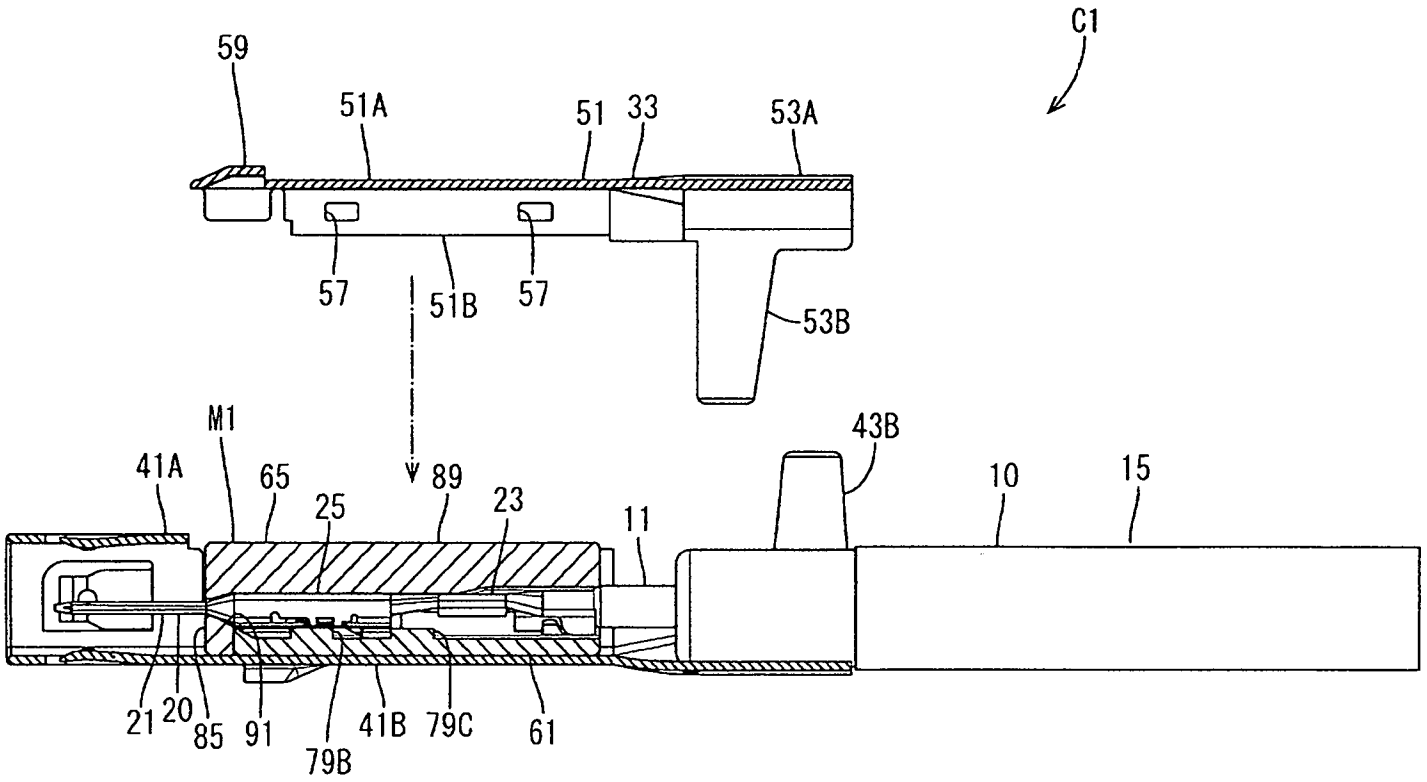
FIG. 30 is a section in the state before the upper outer conductor shell is assembled with the lower outer conductor shell.
Figure 31:
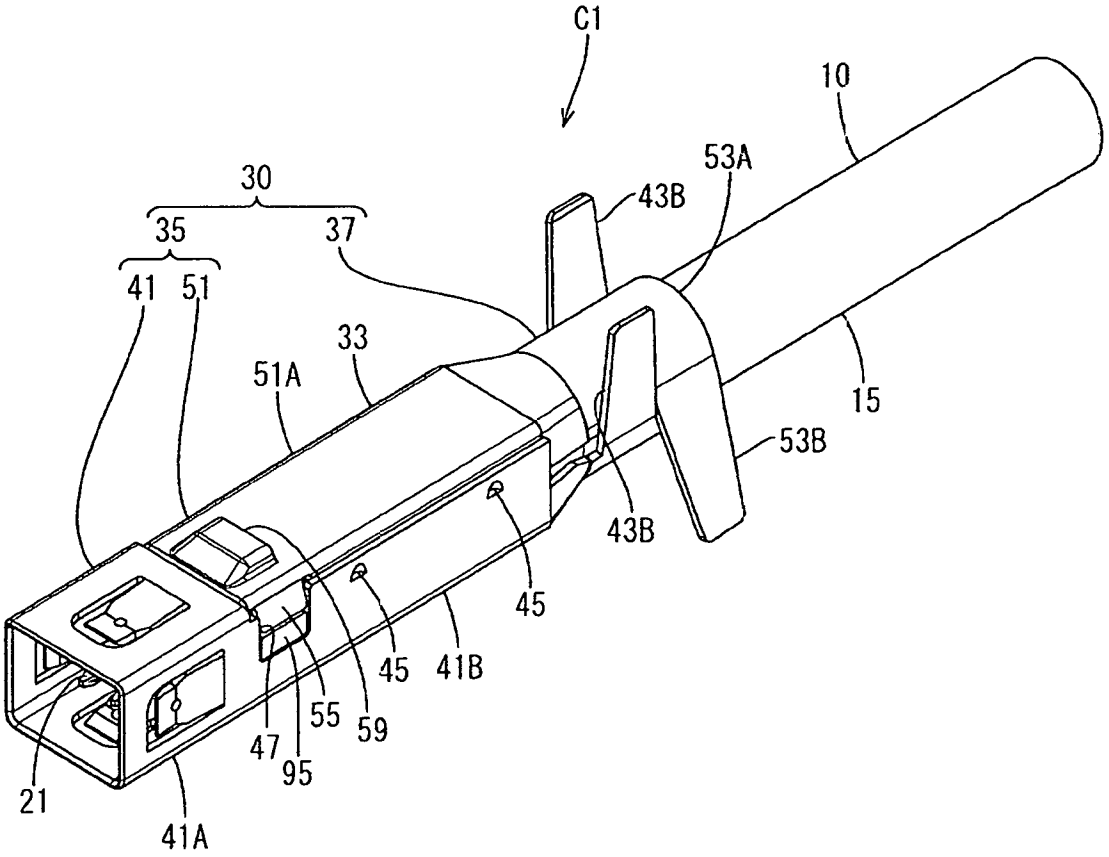
FIG. 31 is a perspective view in the state before the upper outer conductor shell is assembled with the lower outer conductor shell.

A terminal module M1 and a connector C1 of this embodiment are used for a multipolar shielded cable including a plurality of signal wires. The terminal module M1 of this embodiment includes terminals 20 connected to signal wires 11 of a shielded cable 10 and a terminal holding member 60 for holding the terminals 20 as shown in FIG. 23. The connector C1 of this embodiment includes the terminal module M1 and an outer conductor shell 30 as shown in FIGS. 30 and 31. Note that, in the following description, a left side of FIG. 2 (connecting direction of the connector C1) is referred to as a front side and a right side of FIG. 2 (side of the shielded cable 10) is referred to as a rear side concerning a front-rear direction. Further, a vertical direction is based on FIG. 3 and upper and lower sides of FIG. 3 are referred to as upper and lower sides.

Figure 5:
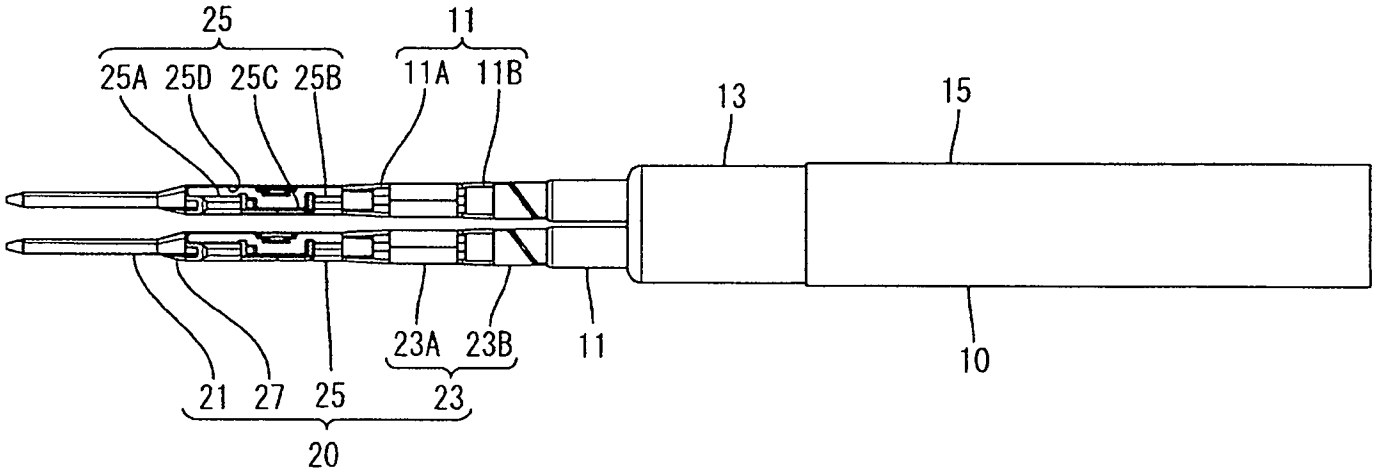
FIG. 5 is a bottom view of terminals connected to a shielded cable.

As shown in FIG. 5, the shielded cable 10 is configured by bundling signal wires 11 (two in this embodiment), covering around the signal wires 11 by a shield layer 13 and covering around the shield layer 13 by an insulation coating 15. The signal wire 11 is formed by covering an inner conductor 11A by an inner insulation coating 11B. Further, the signal wire 11 is for transmitting a signal and the inner conductor 11A has a small diameter. At an end of the shielded cable 10, the insulation coating 15 and the shield layer 13 are stripped to expose the signal wires 11 for connection to the terminals 20. Further, the insulation coating 15 is stripped a longer distance than the shield layer 13 and the shield layer 13 also is exposed.

Figure 22:
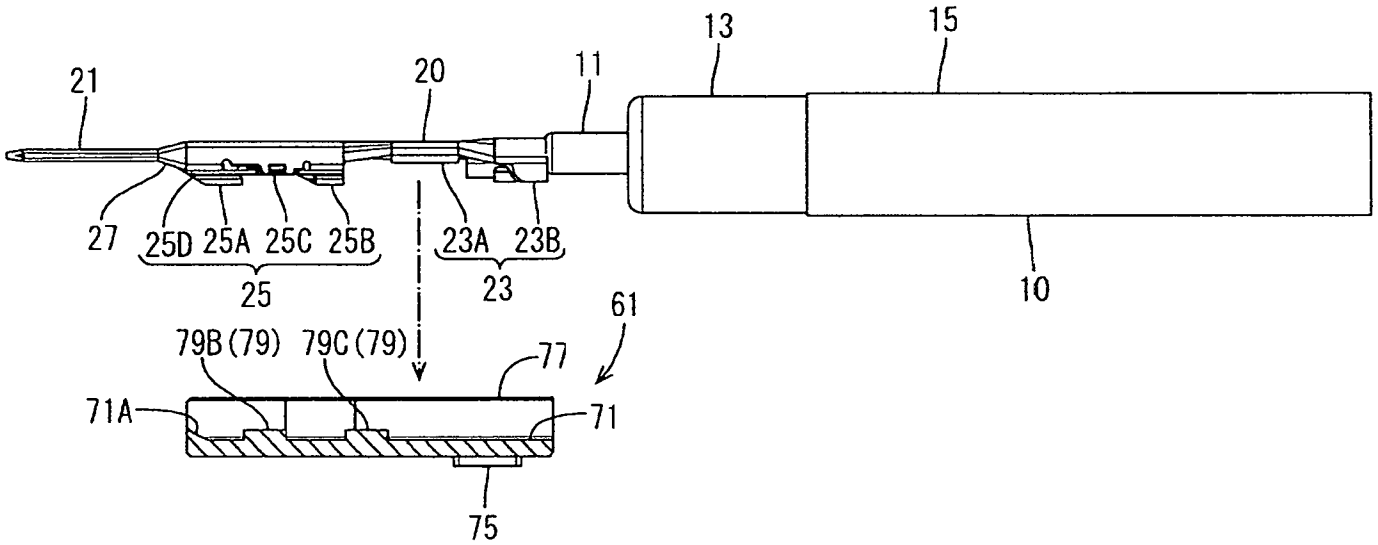
FIG. 22 is a section in the state before the terminals are mounted into the lower terminal holding member.

The terminal 20 is a male terminal fitting and is formed by press-working a conductive metal plate as shown in FIGS. 5 and 22. The terminal 20 includes a tab-like electrically connecting portion 21 (an example of a "tip part"), a crimping portion 23 (an example of a "connecting part") to be crimped to the signal wire 11 and a terminal locked portion 25 provided between the electrically connecting portion 21 and the crimping portion 23. Further, a part between the terminal locked portion 25 and the electrically connecting portion 21 is a tapered portion 27 becoming narrower toward a tip. The crimping portion 23 is composed of crimping pieces in the form of open barrels and includes a wire barrel 23A to be caulked to the inner conductor 11A and an insulation barrel 23B to be caulked to the inner insulation coating 11B.

As shown in FIG. 22, the terminal locked portion 25 is box-shaped and occupies about ⅓ of the terminal 20 in the front-rear direction. The terminal locked portion 25 is provided with front and rear projections 25A, 25B projecting down and a recess 25C in the form of an opening is between the two projections 25A and 25B. The front projection 25A has a front end part with an inclined surface connected to the tapered portion 27. Further, as shown in FIG. 5, the projections 25A, 25B of the terminal locked portion 25 are displaced toward one side and a side of the terminal locked portion 25 opposite to the projections 25A, 25B serves as a locking portion opening 25D communicating with the recess 25C.

Figure 4:
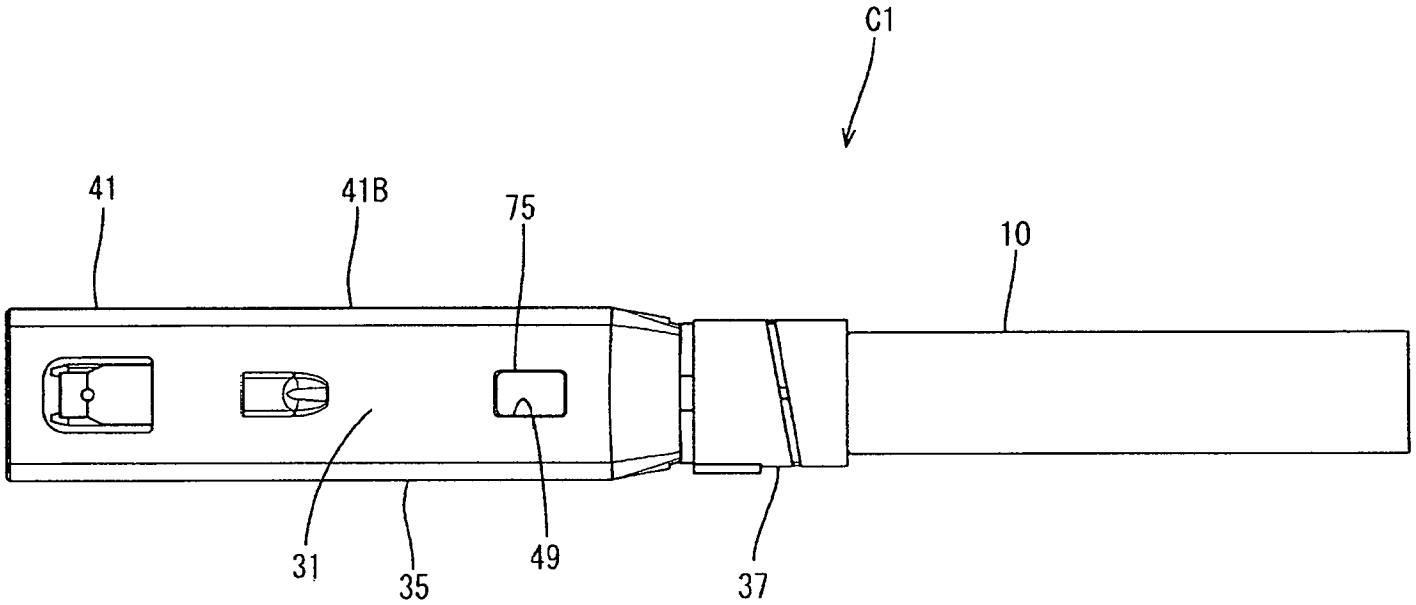
FIG. 4 is a bottom view of the shield connector.
Figure 29:
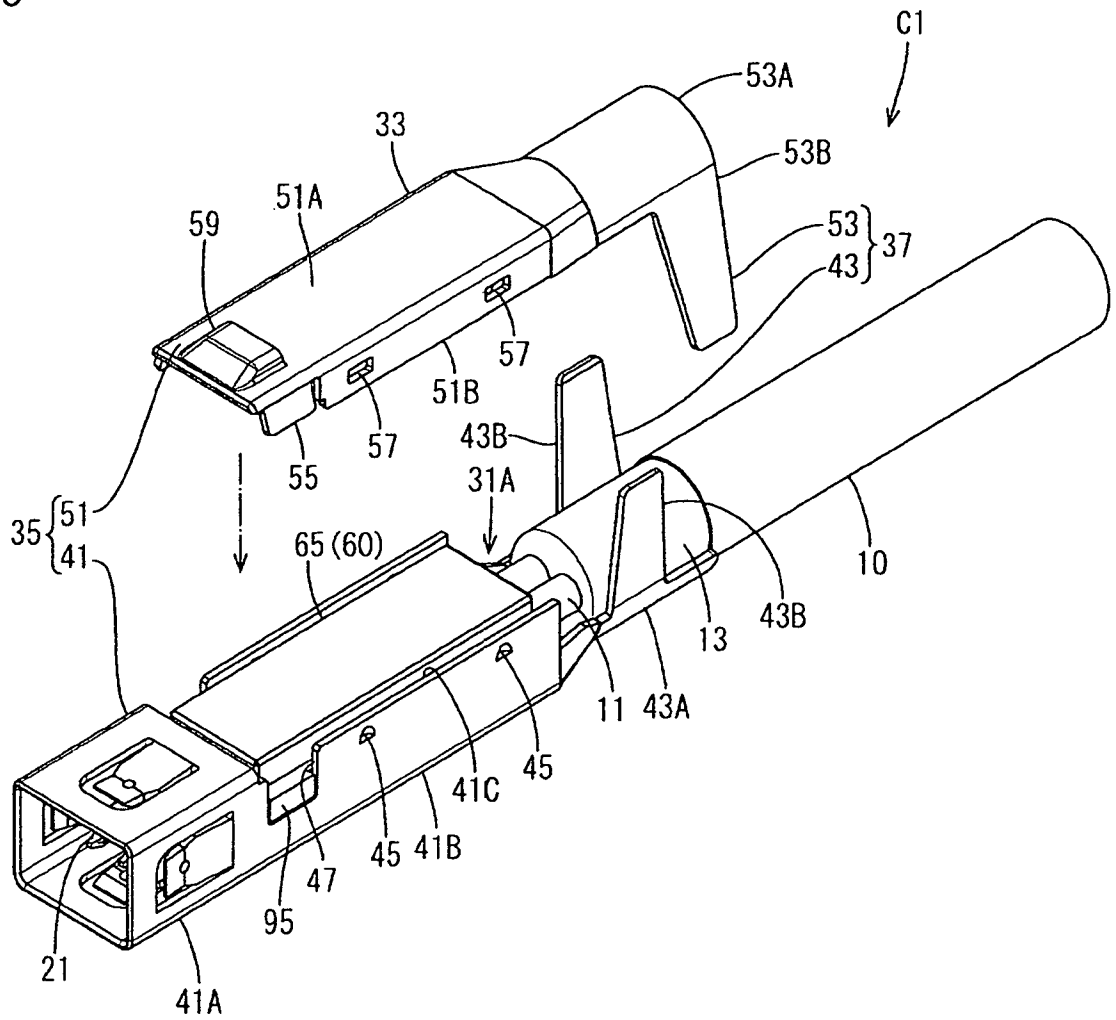
FIG. 29 is a perspective view in a state before the upper outer conductor shell is assembled with the lower outer conductor shell.

As shown in FIGS. 3, 4 and 29, the outer conductor shell 30 is vertically (direction perpendicular to an extending direction of the terminals 20) divided into two, and configured by assembling a lower outer conductor shell 31 (an example of "a first outer conductor shell") and an upper outer conductor shell 33 (an example of "a second outer conductor shell"). Further, the outer conductor shell 30 includes a body portion 35 in the form of a rectangular tube for accommodating the terminal holding member 60 and a barrel 37 to be connected to the shield layer 13 of the shielded cable 10.

Figure 7:
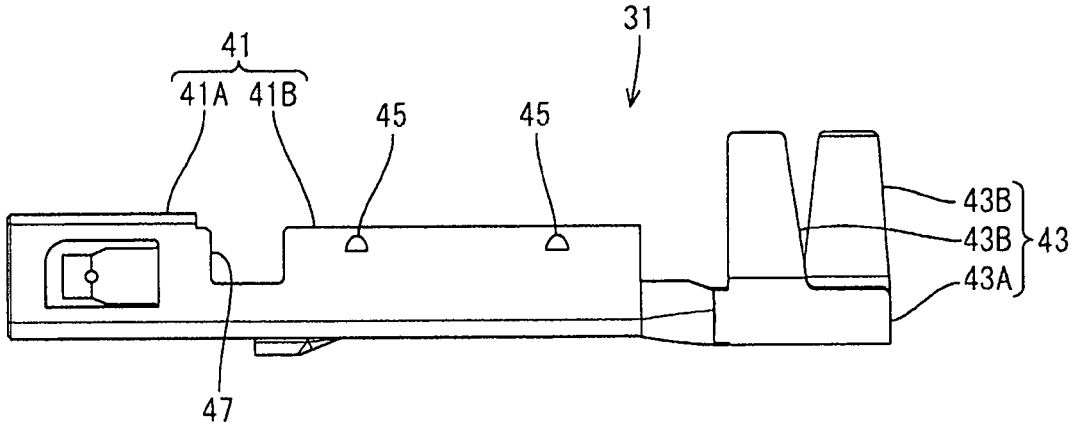
FIG. 7 is a side view of the lower outer conductor shell.
Figure 8:
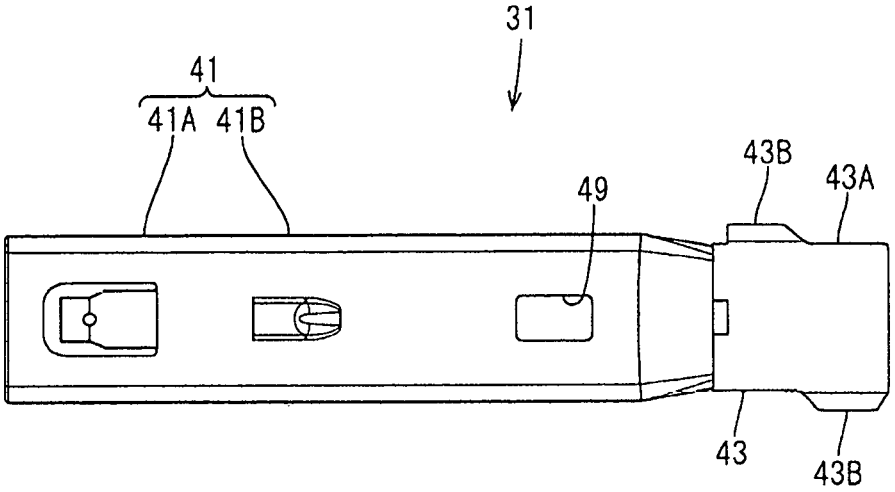
FIG. 8 is a bottom view of the lower outer conductor shell.
Figure 9:
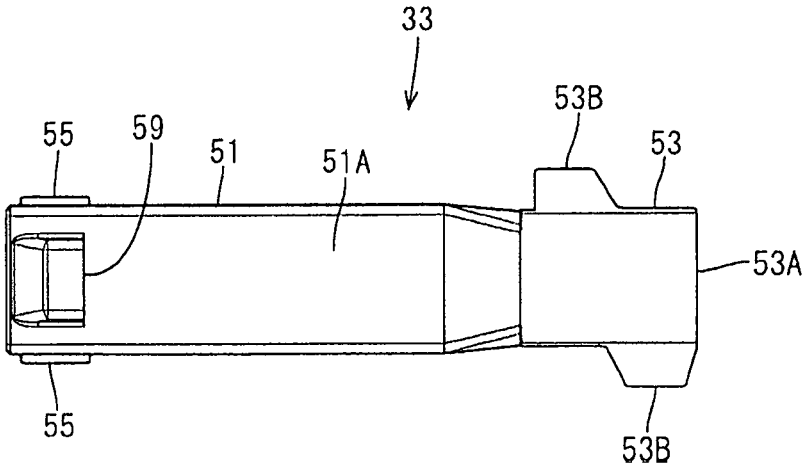
FIG. 9 is a plan view of an upper outer conductor shell.

The lower outer conductor shell 31 is formed by press-working a conductive plate material. As shown in FIGS. 7 and 29, the lower outer conductor shell 31 includes a lower body 41 in the form of a rectangular tube constituting a part of the body portion 35 and a lower barrel portion 43 constituting a part of the barrel 37.

Figure 25:
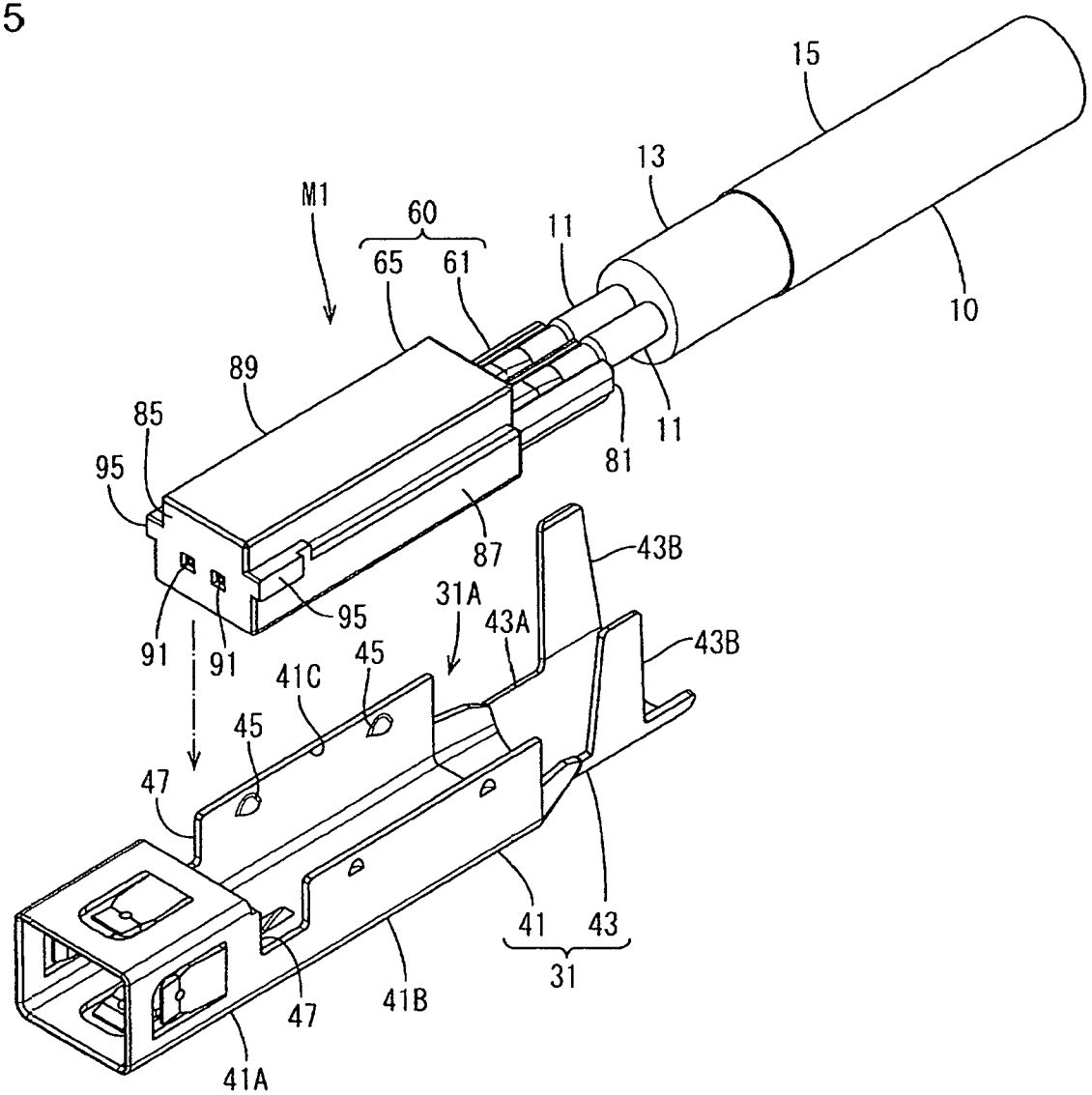
FIG. 25 is a perspective view in a state before a terminal holding member is assembled with the lower outer conductor shell.

As shown in FIGS. 25 and 30, the lower body 41 is substantially in the form of a rectangular tube open in the front-rear direction and a front part 41A of the lower body 41 has four surrounding surfaces. On the other hand, a rear end part 41B of the lower body 41 is provided with a body-side opening 41C entirely open upward, and has a U-shaped cross-section. Further, the electrically connecting portions 21 of the terminals 20 are accommodated in the front part 41A of the lower body 41, and the terminal holding member 60 is accommodated in the rear end part 41B. A dimension of the rear part 41B of the lower body 41 in the front-rear direction is substantially equal to that of the terminal holding member 60 in the front-rear direction.

Figure 6:
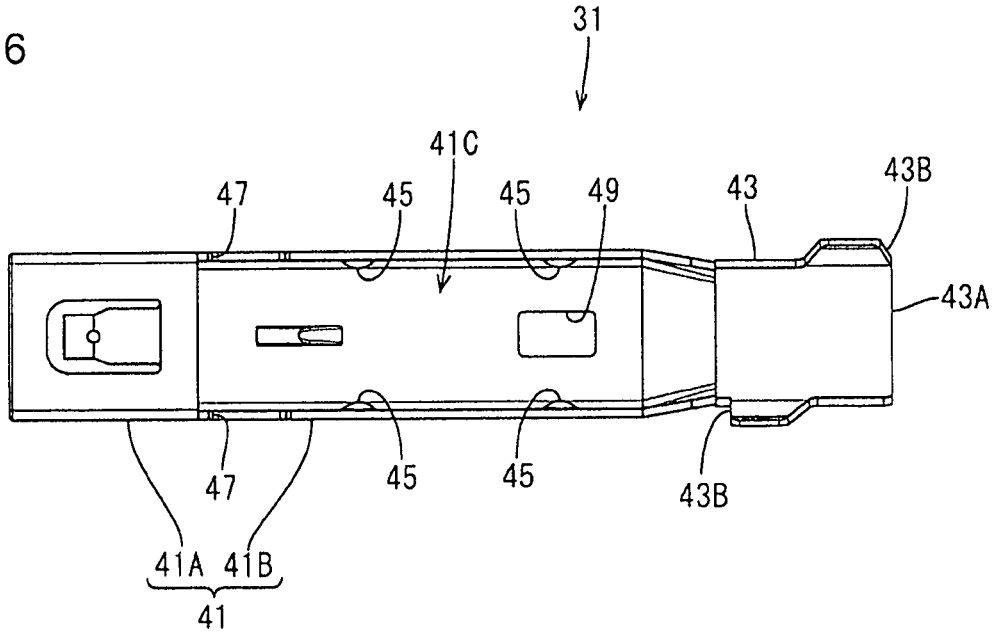
FIG. 6 is a plan view of a lower outer conductor shell.

As shown in FIGS. 6 and 7, both side surfaces of the rear end part 41B of the lower body 41 are struck inward to provide locking protrusions 45. Further, the rear end part 41B of the lower body 41 is provided with cuts 47 cut down into a rectangular shape from the upper edges of the both side surfaces thereof. The cuts 47 have a vertical dimension, that is substantially half the vertical dimension of the lower body 41, and are provided on a front part of the body-side opening 41C. A locked portion 49 lockable to a locking portion 75 of the terminal holding member 60 to be described later is provided in a bottom plate of the lower body 41. The locked portion 49 is a hole having a substantially rectangular shape and penetrating in a plate thickness direction.

As shown in FIGS. 7 and 25, the lower barrel portion 43 includes a bottom plate 43A continuous with the lower body 41 and barrel pieces 43B rising up from the bottom plate 43A. Further, the bottom plate 43A of the lower barrel portion 43 has an arcuate cross-section, and the lower end position thereof is lower than that of the lower body 41. Further, the lower barrel portion 43 is open upward, and constitutes an opening 31A of the lower outer conductor shell 31, into which the terminal holding member 60 is insertable, together with the body-side opening 41C of the lower body portion 41.

Figure 10:
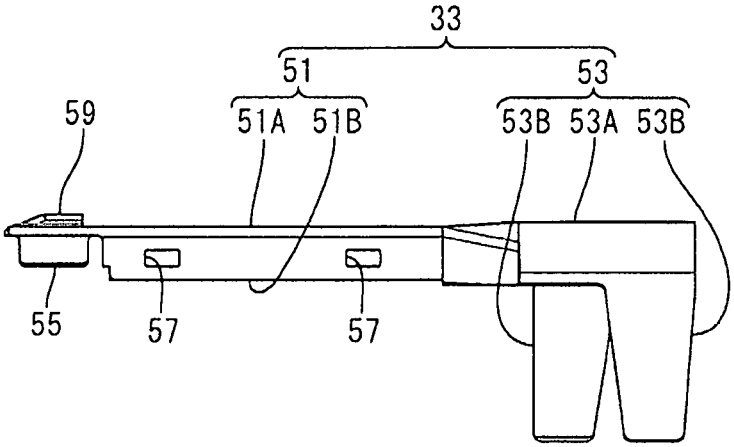
FIG. 10 is a side view of the upper outer conductor shell.
Figure 11:
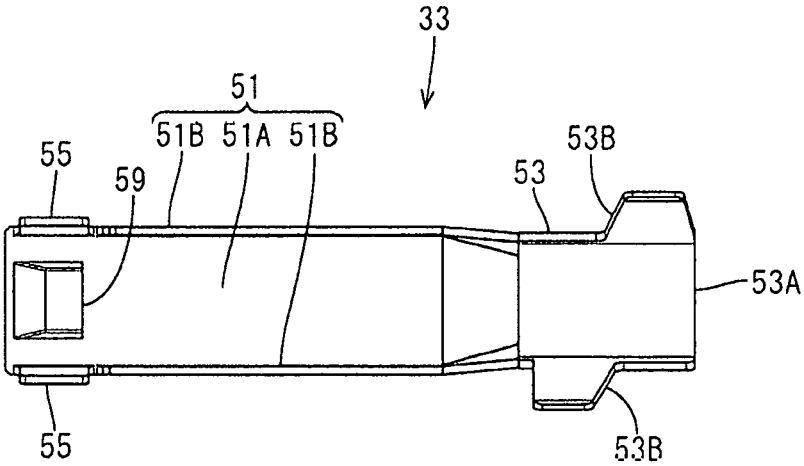
FIG. 11 is a bottom view of the upper outer conductor shell.

The upper outer conductor shell 33 is formed by press-working a conductive plate material. As shown in FIGS. 10 and 29, the upper outer conductor shell 33 includes an upper body 51 constituting a part of the body 35 and an upper barrel portion 53 constituting a part of the barrel 37. Further, the upper outer conductor shell 33 covers the opening 31A of the lower outer conductor shell 31 from above.

The upper body 51 is formed by a ceiling plate 51A substantially parallel to the bottom plate of the lower body 41 and two side plates 51B bent into a substantially L shape from side ends of the ceiling plate 51A, is open in the front-rear direction and has a U-shaped cross-section. Further, the ceiling plate 51A of the upper body 51 covers the body-side opening 41C of the lower body portion 41, and outer surfaces of the side plates 51B of the upper body 51 are in contact with inner surfaces of the side surfaces of the rear end part 41B of the lower body 41. That is, both side plates 51B of the upper body 51 overlap the rear end part 41B of the lower body 41 by entering the rear end part 41B. When the upper body 51 overlaps the lower body 41, the body 35 in the form of a rectangular tube open in the front-rear direction is formed. Further, a dimension of the upper body portion 51 in the front-rear direction is substantially equal to that of the terminal holding member 60 in the front-rear direction.

Further, front end parts of the side plates 51B of the upper body 51 are struck outwardly to become struck pieces 55 that are at positions where the cuts 47 are provided. Locking holes 57 penetrate the side plates 51B of the upper body 51 in the plate thickness direction at positions corresponding to the locking protrusions 45 of the lower body 41. Further, a lance locking portion 59 projects up at the front end of the ceiling plate 51A of the upper body 51. The lance locking portion 59 can position the outer conductor shell 30 in an unillustrated connector housing by locking a locking lance of the connector housing in this embodiment.

The upper barrel portion 53 includes an upper plate 53A continuous with the upper body 51 and barrel pieces 53B extending down from the upper plate 53A. Further, the upper plate 53A of the upper barrel portion 53 has an arcuate cross-sectional shape and the upper end position thereof is higher than that of the upper body 51. When the upper barrel portion 53 is positioned to cover the lower barrel portion 43, the upper plate 53A of the upper barrel portion 53 and the bottom plate 43A of the lower barrel portion 43 form a hollow cylindrical shape. The respective barrel pieces 43B, 53B are caulked to a hollow cylindrical part of the barrel 37 so that the barrel 37 is connected to the shield layer 13 of the shielded cable 10.

As shown in FIG. 23, the terminal holding member 60 is vertically (direction perpendicular to the extending direction of the terminals 20) divided into two, and configured by assembling a lower terminal holding member 61 (an example of a "first terminal holding member") and an upper terminal holding member 65 (an example of a "second terminal holding member"). Further, the lower terminal holding member 61 is slidable along the extending direction of the terminals 20 with respect to the upper terminal holding member 65.

Figure 12:
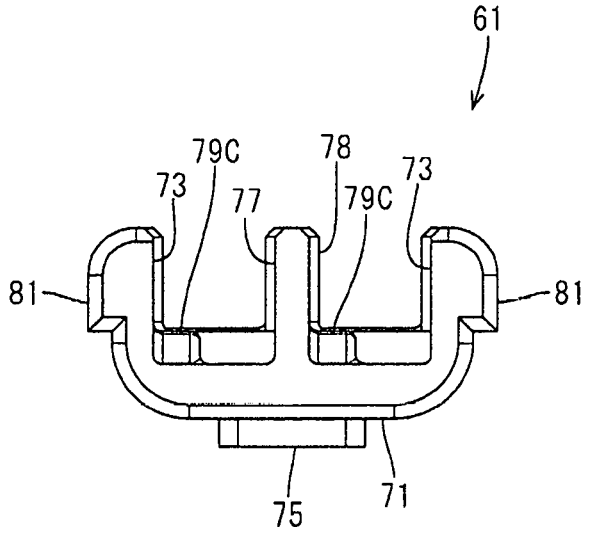
FIG. 12 is a back view of a lower terminal holding member.
Figure 21:
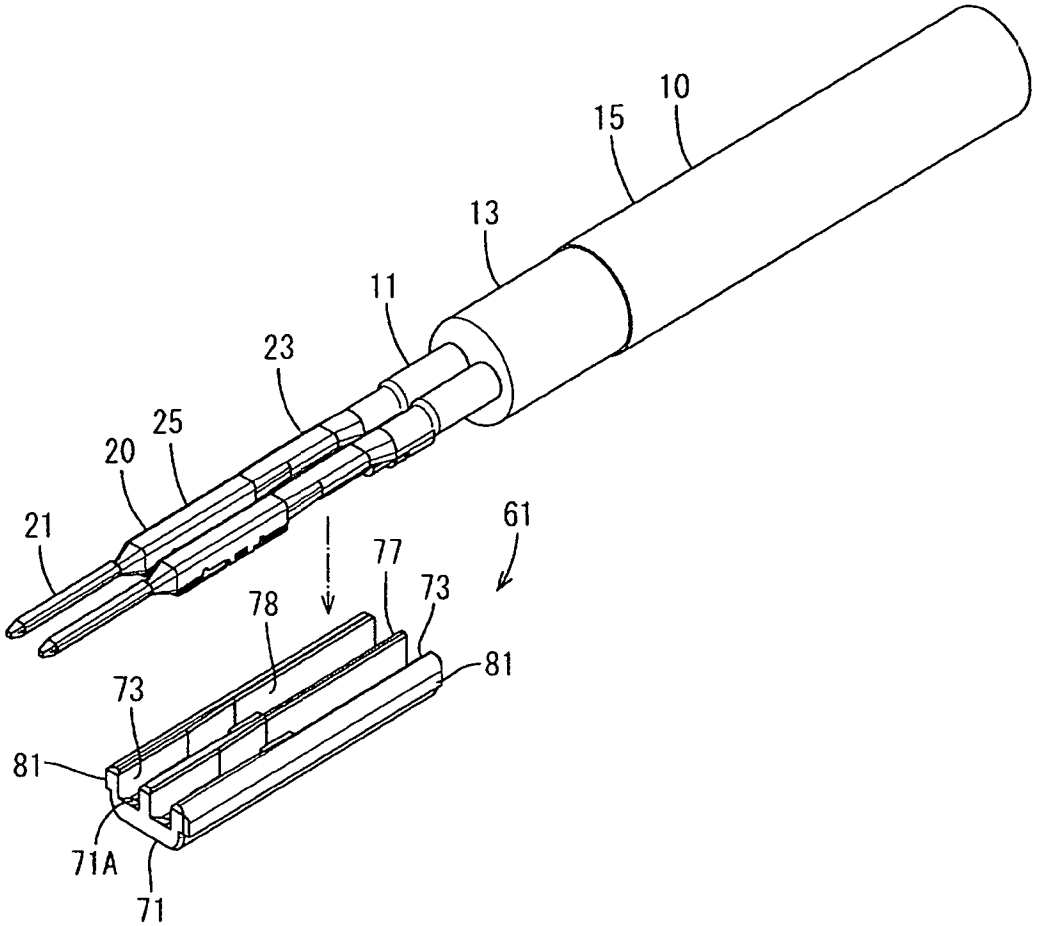
FIG. 21 is a perspective view in a state before the terminals are mounted into the lower terminal holding member.

The lower terminal holding member 61 is made of synthetic resin and, as shown in FIGS. 12 and 21, holds the crimping portions 23 and the terminal locked portions 25 of the terminals 20 of the shielded cable 10. Further, the lower terminal holding member 61 includes a bottom portion 71 and two side walls 73 rising from the bottom portion 71 while being substantially L-shaped and is open up and in the front-rear direction to define a substantially U-shape in a front view. Further, corner parts between the bottom portion 71 and both side walls 73 have a rounded outer shape. Note that a tapered surface 71A extending up toward a front end is provided on a front part of the bottom portion 71. The locking portion 75 projects down on the lower surface of a rear end part of the bottom portion 71. The locking portion 75 has a rectangular shape and locks the locked portion 49 (see FIG. 6) of the lower outer conductor shell 31.

Figure 13:
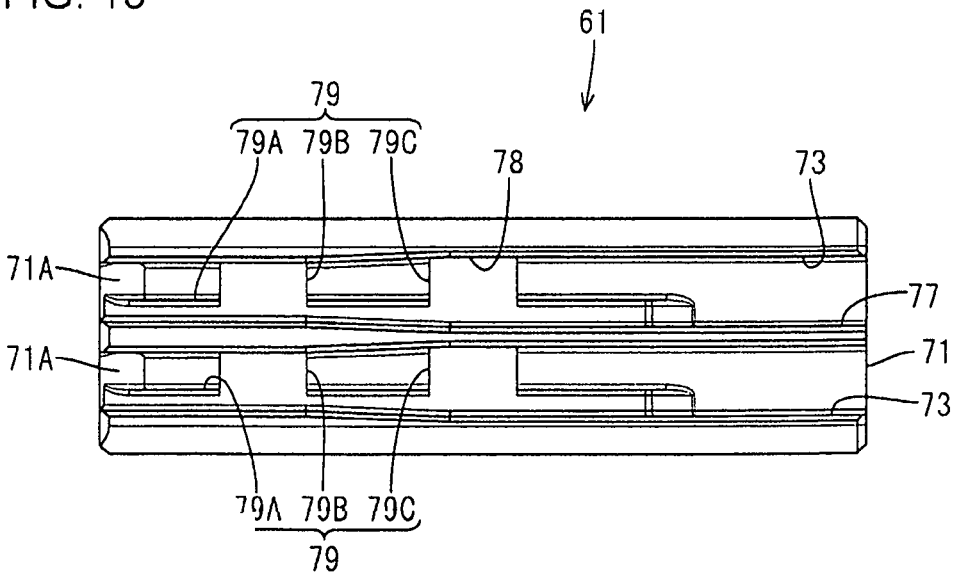
FIG. 13 is a plan view of the lower terminal holding member.
Figure 14:
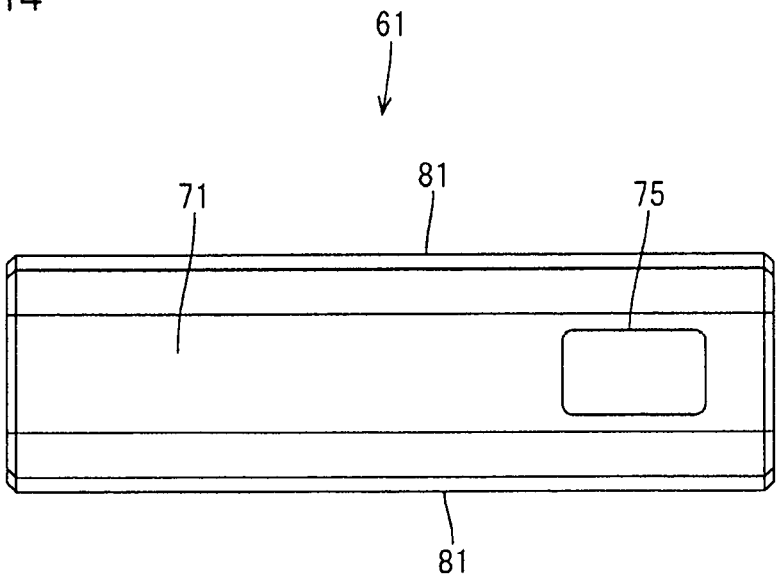
FIG. 14 is a bottom view of the lower terminal holding member.

As shown in FIGS. 13 and 22, a partition wall 77 partitioning between the terminals 20 is provided between the side walls 73 to form a partition between the terminals. The partition wall 77 projects up to the same height as the upper end positions of the side walls 73 from the bottom portion 71. An area enclosed by each side wall 73, the partition wall 77 and the bottom portion 71 serves as an accommodation recess 78 for accommodating the crimping portion 23 and the terminal locked portion 25 of the terminal 20. The accommodation recess 78 is open upward, and the terminal 20 can be accommodated thereinto from above with the electrically connecting portion 21 projecting. Further, an inner dimension between each side wall 73 and the partition wall 77 (of the accommodation recess 78) is substantially equal to an outer dimension of the terminal locked portion 25 at a front part (front ¼). The inner dimension between each side wall 73 and the partition wall 77 (of the accommodation recess 78) becomes larger toward a rear side, and is substantially equal to or slightly larger than an outer dimension of the crimping portion 23 at a rear half part (rear ½).

Further, as shown in FIGS. 13 and 22, a terminal locking portion 79 to be fit into the recess 25C of the terminal locked portion 25 and the locking portion opening 25D communicating with the recess 25C is provided on the upper surface of the bottom portion 71. The upper end position of the terminal locking portion 79 is slightly lower than that of the tapered surface 71A of the bottom portion 71. The terminal locking portion 79 includes a narrow portion 79A having a width that is about ⅓ of the inner dimension between the partition wall 77 and the side wall 73 of the lower terminal holding member 61, a first wide portion 79B having a width equal to the inner dimension between the partition wall 77 and the side wall 73 and a second wide portion 79C provided behind the first wide portion 79B and having a width equal to the inner dimension between the partition wall 77 and the side wall 73. The narrow portion 79A of the terminal locking portion 79 is provided from the front end of the lower terminal holding member 61 to a position where the wire barrel 23A of the terminal 20 is accommodated, and fit into the recess 25C and the locking portion opening 25D. The front end of the first wide portion 79B is locked to the rear end of the front projection 25A of the terminal locked portion 25, and the front end of the second wide portion 79C is locked to the rear end of the rear projection 25B of the terminal locked portion 25. Note that a front part of the front projection 25A of the terminal locked portion 25 is disposed on the tapered surface 71A.

As shown in FIGS. 12 and 21, rails 81 project out from both side walls 73 in a width direction. The rails 81 extend in the front-rear direction (extending direction of the terminals 20) from the front end to the rear end of the lower terminal holding member 61. The upper end positions of the rails 81 are at the same height as the upper end positions of the side walls 73, and rounded surfaces extend from the upper surfaces of the side walls 73 toward side surfaces of the rails 81. Further, a vertical dimension of each rail 81 is about half the vertical dimension of the lower terminal holding member 61, and a projecting dimension of each rail 81 in the width direction is equal to a width (plate thickness) of the side walls 73.

Figure 19:
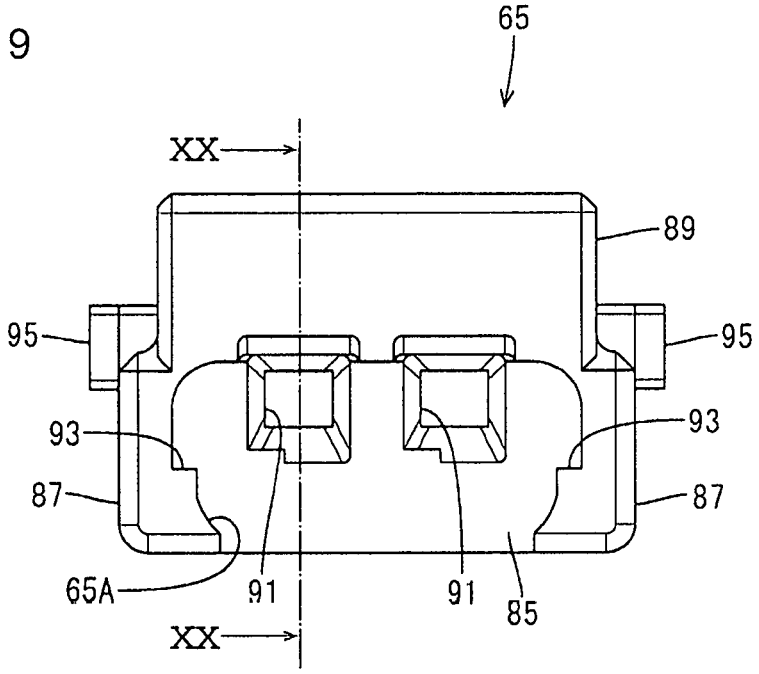
FIG. 19 is a back view of the upper terminal holding member.
Figure 20:
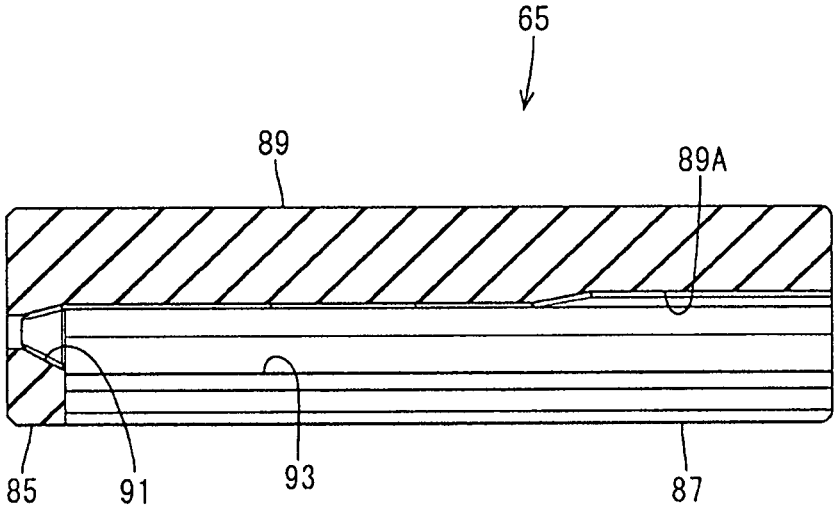
FIG. 20 is a section at position XX-XX in FIG. 19.

The upper terminal holding member 65 is made of synthetic resin and has a box shape open rearward and downward, as shown in FIGS. 19 and 23. The lower terminal holding member 61 is insertable into the upper terminal holding member 65 through a rear opening 65A. The upper terminal holding member 65 includes a front wall 85, two side walls 87 and a ceiling wall 89. The front wall 85 is substantially rectangular in a front view, and terminal insertion holes 91 are provided in a central part of the front wall 85 for allowing the insertion of the electrically connecting portions 21 of the terminals 20. Each terminal insertion hole 91 is tapered toward a tip in conformity with the shape of the tapered portion 27 of the terminal 20. With the electrically connecting portions 21 of the terminals 20 projecting from the upper terminal holding member 65, the tapered portions 27 are fit in the terminal insertion holes 91.

The side walls 87 of the upper terminal holding member 65 cover the side walls 73 of the lower terminal holding member 61. A width of each side wall 87 of the upper terminal holding member 65 is larger than that of the side wall 73 of the lower terminal holding member 61. Each side wall 87 of the upper terminal holding member 65 has an inner surface shape in conformity with the outer surface shape of the lower terminal holding member 61, and is provided with a guide groove 93 into which the rail 81 is fit to slide.

Figure 1:
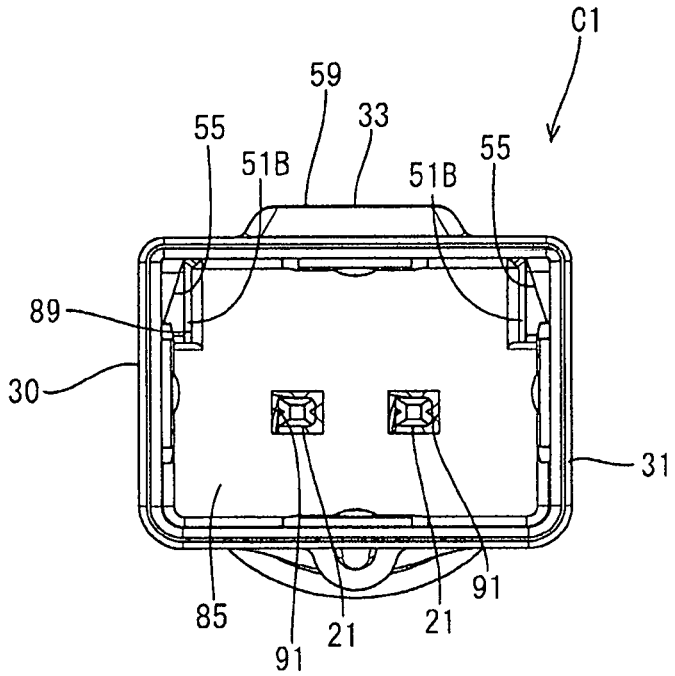
FIG. 1 is a front view of a shield connector in a first embodiment.
Figure 2:
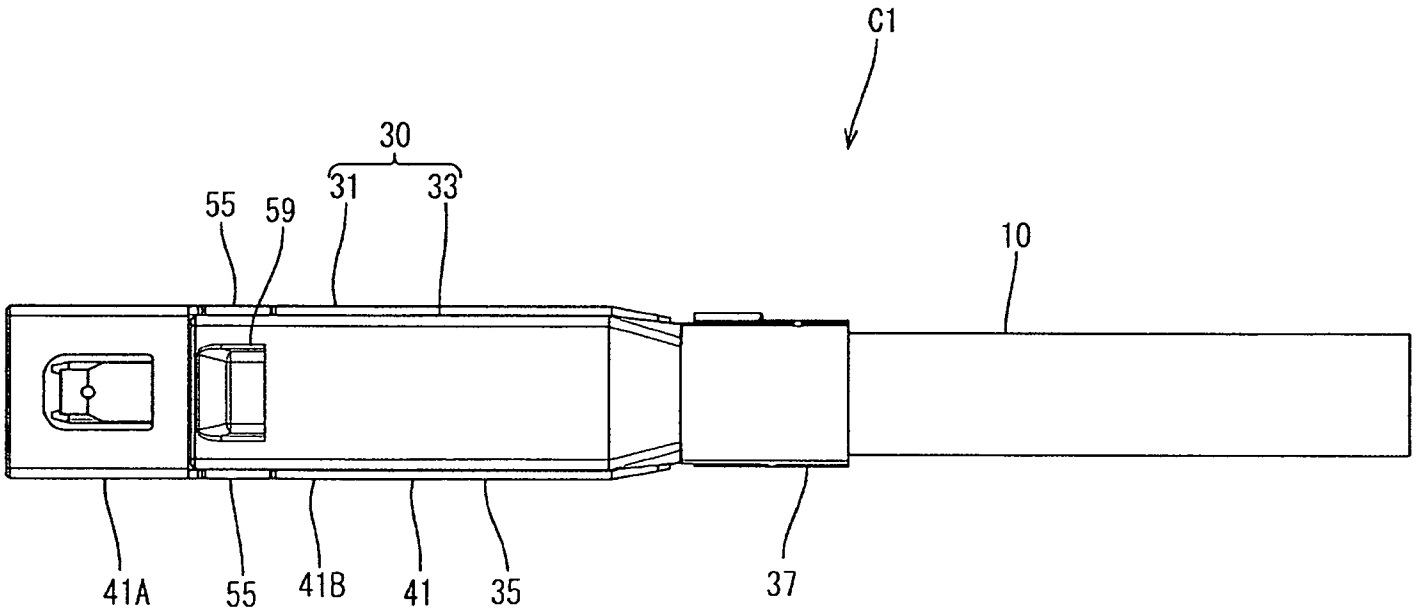
FIG. 2 is a plan view of the shield connector.
Figure 18:
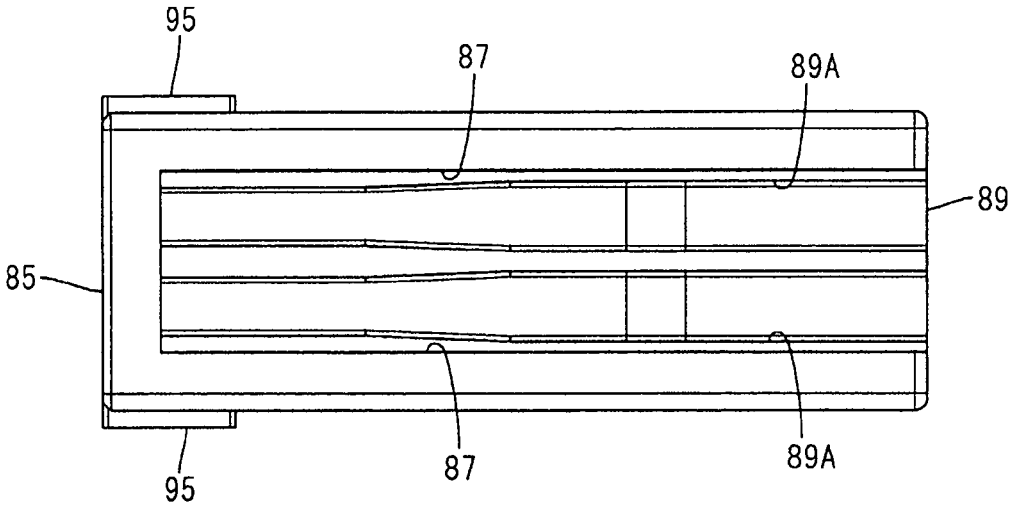
FIG. 18 is a bottom view of an upper terminal holding member.

As shown in FIGS. 1, 18 and 23, the ceiling wall 89 covers an upper part of the lower terminal holding member 61 and occupies about half the vertical dimension of the upper terminal holding member 65. An outer dimension of the ceiling wall 89 in the width direction is slightly smaller than an inner dimension between the side surface plates 51B of the upper body 51 of the upper outer conductor shell 33. Thus, steps are formed between the ceiling wall 89 and the side walls 87 spaced wider apart than the ceiling wall portion 89. Further, upper accommodation recesses 89A in conformity with the shape of the bottom surface of the terminal 20 are provided in the lower surface of the ceiling wall 89. An inner dimension of a front part of the upper accommodation recess 89A is substantially equal to the outer dimension of the terminal locked portion 25, similar to the accommodation recess 78. The inner dimension of the upper accommodation recess 89A becomes larger toward the rear, and the inner dimension at a rear half is substantially equal to or slightly larger than the outer dimension of the crimping portion 23. A rear part of the upper accommodation recess 89A is also gradually widened upward.

Figure 15:
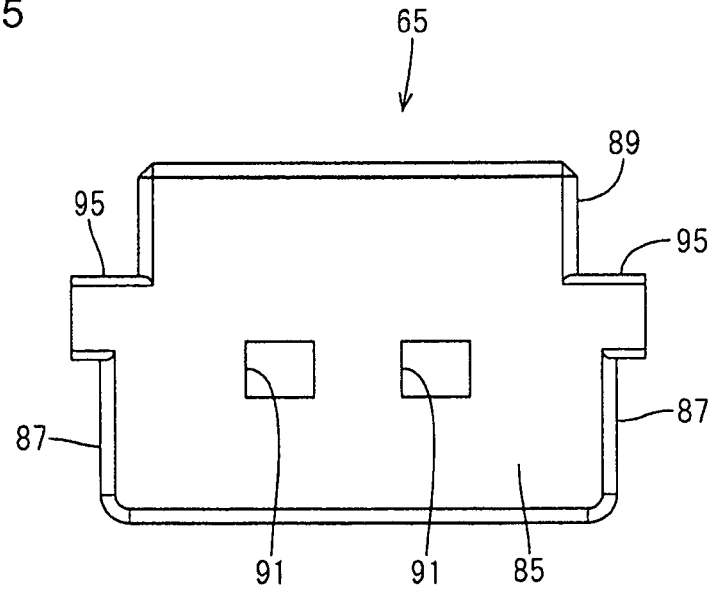
FIG. 15 is a front view of an upper terminal holding member.
Figure 16:
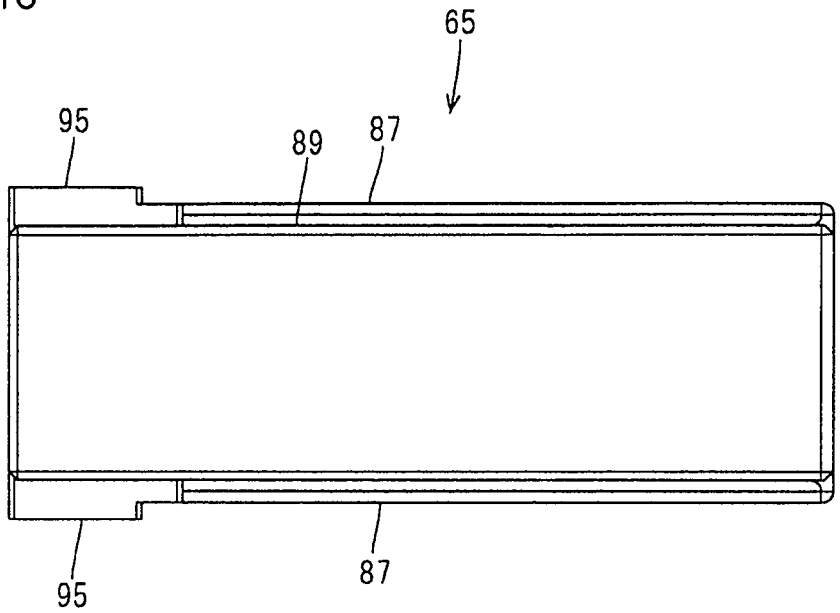
FIG. 16 is a plan view of the upper terminal holding member.
Figure 17:
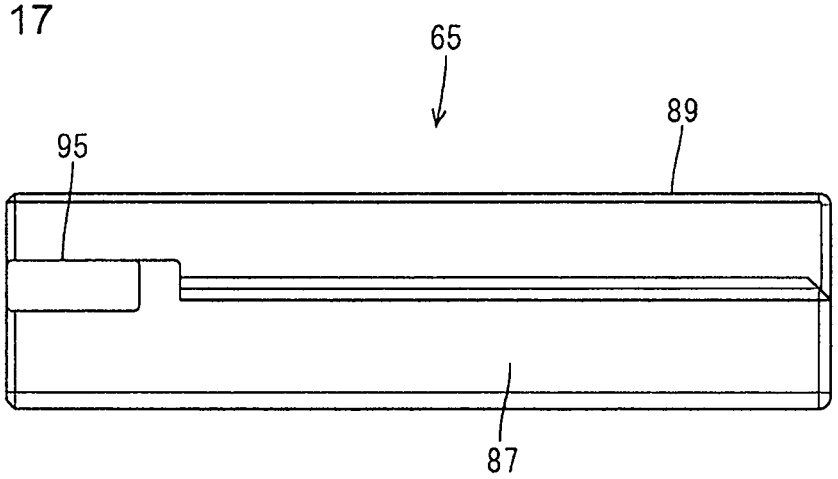
FIG. 17 is a side view of the upper terminal holding member.

As shown in FIGS. 15 and 25, engaging portions 95 (an example of a "second engaging portion") to be engaged with the cuts 47 of the lower outer conductor shell 31 are provided on side surfaces of a front part of the ceiling wall 89. The engaging portion 95 projects farther out in the width direction than the side wall 73 with the position of the step between the ceiling wall 89 and the side wall 73 as a lower end. A side surface of the engaging portion 95 is flush with that of the lower body 41 of the lower outer conductor shell 31. Further, a dimension of the engaging portion 95 in the front-rear direction is equal to that of the cut 47 in the front-rear direction, and a movement of the upper terminal holding member 65 in the front-rear direction is restricted by the contact of hole edges of the cuts 47 with the engaging portions 95.

Next, an example of an assembling procedure of the connector C1 is described.

First, as shown in FIG. 5, the insulation coating 15 of the shielded cable 10 is stripped to expose the ends of the signal wires 11 and the shield layer 13. Then, the signal wires 11 are connected to the terminals 20. Specifically, the wire barrels 23A of the crimping portions 23 are crimped to the inner conductors 11A of the signal wires 11 and the insulation barrels 23B of the crimping portions 23 are caulked to the inner insulation coatings 11B of the signal wires 11.

Subsequently, as shown in FIGS. 21 and 22, the terminals 20 connected to the signal wires 11 of the shielded cable 10 are accommodated into the lower terminal holding member 61. The terminals 20 are accommodated into the lower terminal holding member 61 from above so that each terminal 20 is accommodated into each accommodation recess 78. In the case of accommodating the terminals 20 into the upwardly open accommodation recesses 78, the second terminal 20 merely is retracted outward of first accommodation recess 78 when accommodating first terminal 20 into the corresponding first accommodation recess 78. Thus, a stripping dimension of the shield layer 13 may be short as compared to the case where the terminals 20 are accommodated in the extending direction of the terminals 20. Therefore, there is less influence of noise.

The terminals 20 are held not to move with respect to the lower terminal holding member 61 by fitting the terminal locking portions 79 into the recesses 25C and the locking portion openings 25D of the terminal locked portions 25 and accommodating the terminal locked portions 25 into the accommodation recesses 78. At this time, the electrically connecting portions 21 of the terminals 20 are held in a state projecting from the front end of the lower terminal holding member 61.

Figure 24:
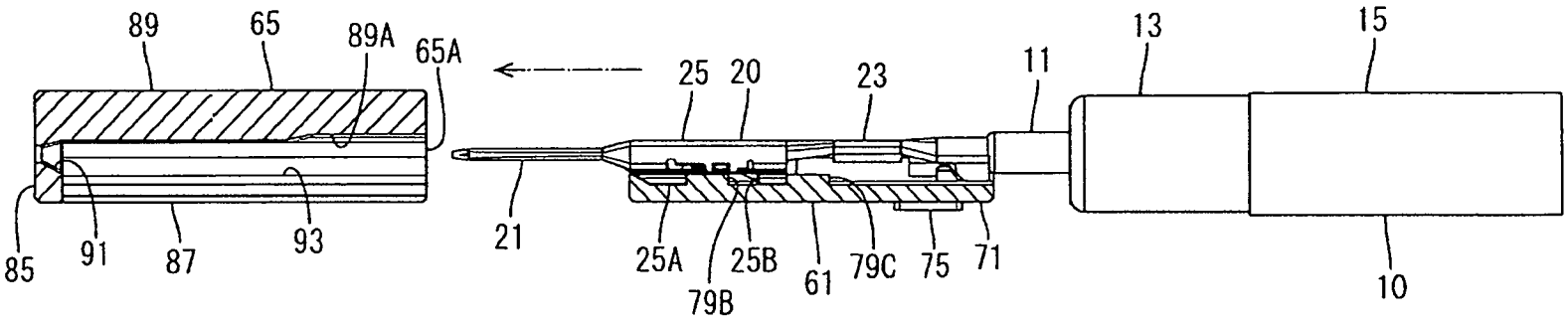
FIG. 24 is a section in the state before the lower terminal holding member is assembled with the upper terminal holding member.
Figure 26:
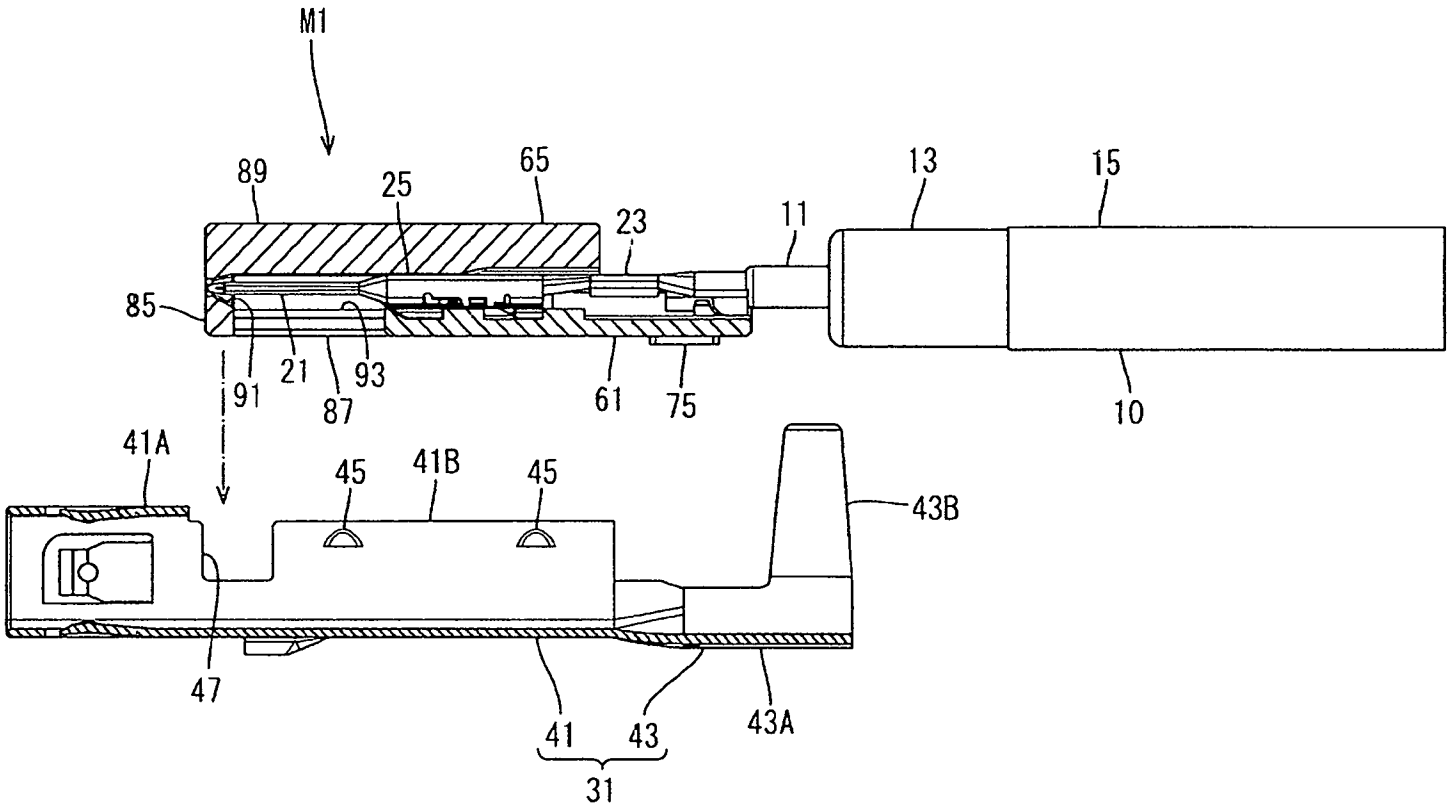
FIG. 26 is a section in the state before the terminal holding member is assembled with the lower outer conductor shell.

As shown in FIGS. 23 and 24, the lower terminal holding member 61 having the terminals 20 accommodated therein is assembled with the upper terminal holding member 65. Specifically, the lower terminal holding member 61 is inserted through the rear opening 65A of the upper terminal holding member 65. Then, the lower terminal holding member 61 is pushed forward while the rails 81 of the lower terminal holding member 61 are sliding in the guide grooves 93 of the upper terminal holding member 65. Then, as shown in FIG. 26, the pushing of the lower terminal holding member 61 is stopped at a position where the electrically connecting portions 21 of the terminals 20 are located in the terminal insertion holes 91 of the upper terminal holding member 65 (terminal tip protection position). At the terminal tip protection position, the electrically connecting portions 21, which are tip parts of the terminals 20 projecting from the lower terminal holding member 61, are held in a state covered by the upper terminal holding member 65.

Subsequently, as shown in FIGS. 25 and 26, the terminal holding member 60 is accommodated into the lower outer conductor shell 31. The terminal holding member 60 is inserted through the opening 31A of the lower outer conductor shell 31 from above so that the upper terminal holding member 65 is accommodated into the lower body 41. At this time, the opening 31A of the lower outer conductor shell 31 enables the terminal holding member 60 to be accommodated easily into the lower outer conductor shell 31 since the opening 31A is larger than the terminal holding member 60 protruding rearwardly of the upper terminal holding member 65. Further, since the electrically connecting portions 21, which are the tip parts of the terminals 20, are covered by the upper terminal holding member 65, the electrically connecting portions 21 cannot be deformed by contacting the lower outer conductor shell 31 or the like.

Figure 27:
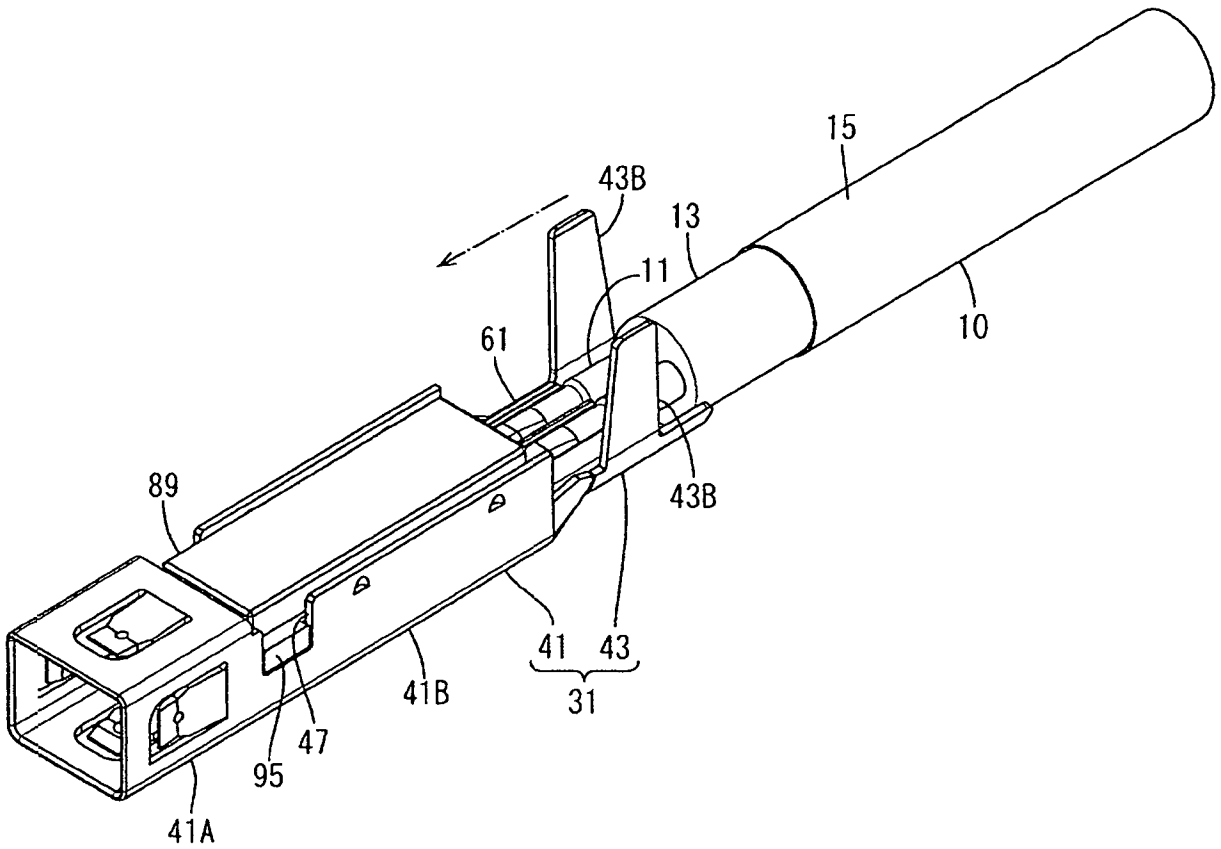
FIG. 27 is a perspective view in a state before the lower terminal holding member is moved forward.
Figure 2B:
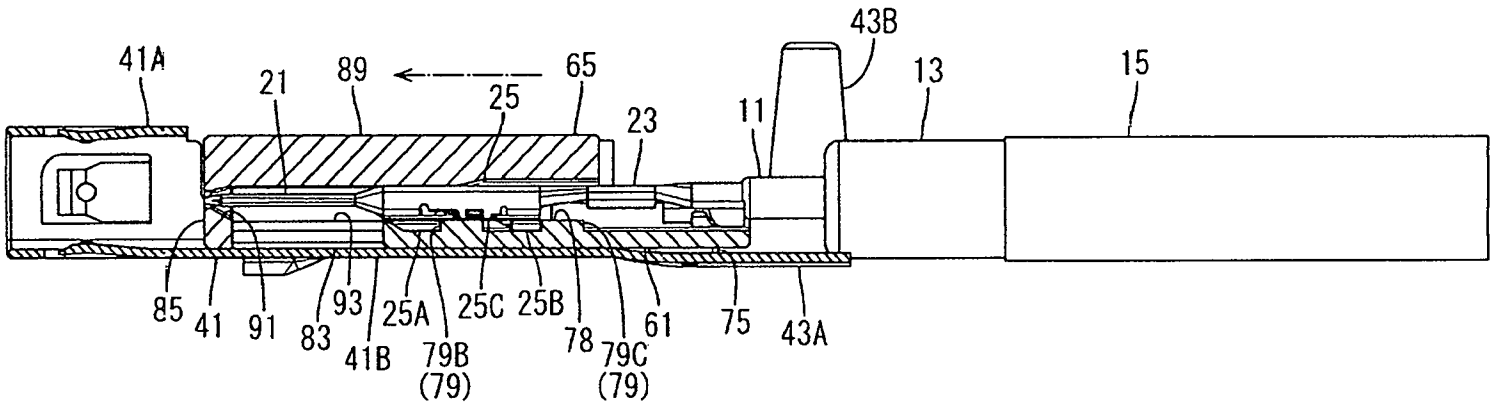

Then, as shown in FIGS. 27 and 28, the lower terminal holding member 61 is pushed forward. The lower terminal holding member 61 is pushed forward while the rails 81 (see FIG. 25) thereof are sliding in the guide grooves 93 of the upper terminal holding member 65, and stops when butting against the upper terminal holding member 65. When the lower terminal holding member 61 reaches a proper position (position shifted toward the ends of the signal wires), the electrically connecting portions 21 project from the front wall 85 to be accommodated into the front end part 41A of the lower body 41. On the other hand, the terminal locked portions 25 and the crimping portions 23 are sandwiched and accommodated between the lower terminal holding member 61 and the upper terminal holding member 65. Further, the locking portion 75 (an example of a "first locking portion") is locked to the locked portion 49 (see FIG. 6) so that the lower terminal holding member 61 is locked to the lower outer conductor shell 31.

When the lower terminal holding member 61 moves forward with respect to the upper terminal holding member 65, shifting movements of the terminals 20 are suppressed when the lower terminal holding member 61 moves since the terminal locked portions 25 are fit in the terminal locking portions 79 of the lower terminal holding member 61. Further, since the engaging portions 95 of the upper terminal holding member 65 are engaged with the cuts 47 of the lower outer conductor shell 31, a movement of the upper terminal holding member 65 can be prevented even if the lower terminal holding member 61 moves. Thus, the lower terminal holding member 61 is moved easily with respect to the upper terminal holding member 65.

Then, as shown in FIGS. 29 and 30, the upper outer conductor shell 33 is mounted from above to cover the opening 31A of the lower outer conductor shell 31. The upper outer conductor shell 33 is assembled so that the side surface plates 51B of the upper body 51 slip inside the side surfaces of the lower body 41. Further, the struck pieces 55 cover the terminal locking portions 79 and the cuts 47. The locking protrusions 45 enter the locking holes 57 to fix the upper body 51 to the lower body 41. On the other hand, the hollow cylindrical barrel 37 covers the shield layer 13 by assembling the lower barrel portion 43 and the upper barrel portion 53. Then, as shown in FIGS. 29 and 31, the barrel pieces 43B, 53B of the barrel 37 are caulked to the shield layer 13 to connect the barrel 37 and the shield layer 13 and also to fix the barrel 37 by the barrel pieces 43B, 53B. Further, since the upper outer conductor shell 33 can cover the opening 31A of the lower outer conductor shell 31, frequency characteristic deterioration can be suppressed by entirely covering the opening 31A by the upper outer conductor shell 33 and the lower outer conductor shell 31 even if the opening 31A through which the terminal holding member 60 is insertable is provided.

As described above, in the first embodiment, the terminal holding member 60 capable of accommodating the terminals 20 and to be covered by the outer conductor shell 30 is divided into the lower terminal holding member 61 and the upper terminal holding member 65. In a state before being covered by the outer conductor shell 30, the upper terminal holding member 65 is at the terminal tip protection position. Thus, the tip parts (electrically connecting portions 21) of the terminals 20 are covered by the upper terminal holding member 65. By relatively moving the upper terminal holding member 65 and the lower terminal holding member 61 after being covered by the outer conductor shell 30, the upper terminal holding member 65 moves to the proper position and the electrically connecting portions 21 of the terminals 20 are exposed to project forward of the upper terminal holding member 65. The electrically connecting portions 21 of the terminals 20 are protected by being covered by the upper terminal holding member 65 before being covered by the outer conductor shell 30 so that the terminals 20 cannot be deformed.

Second Embodiment

A second embodiment is described with reference to FIGS. 32 to 82.

Figure 32:
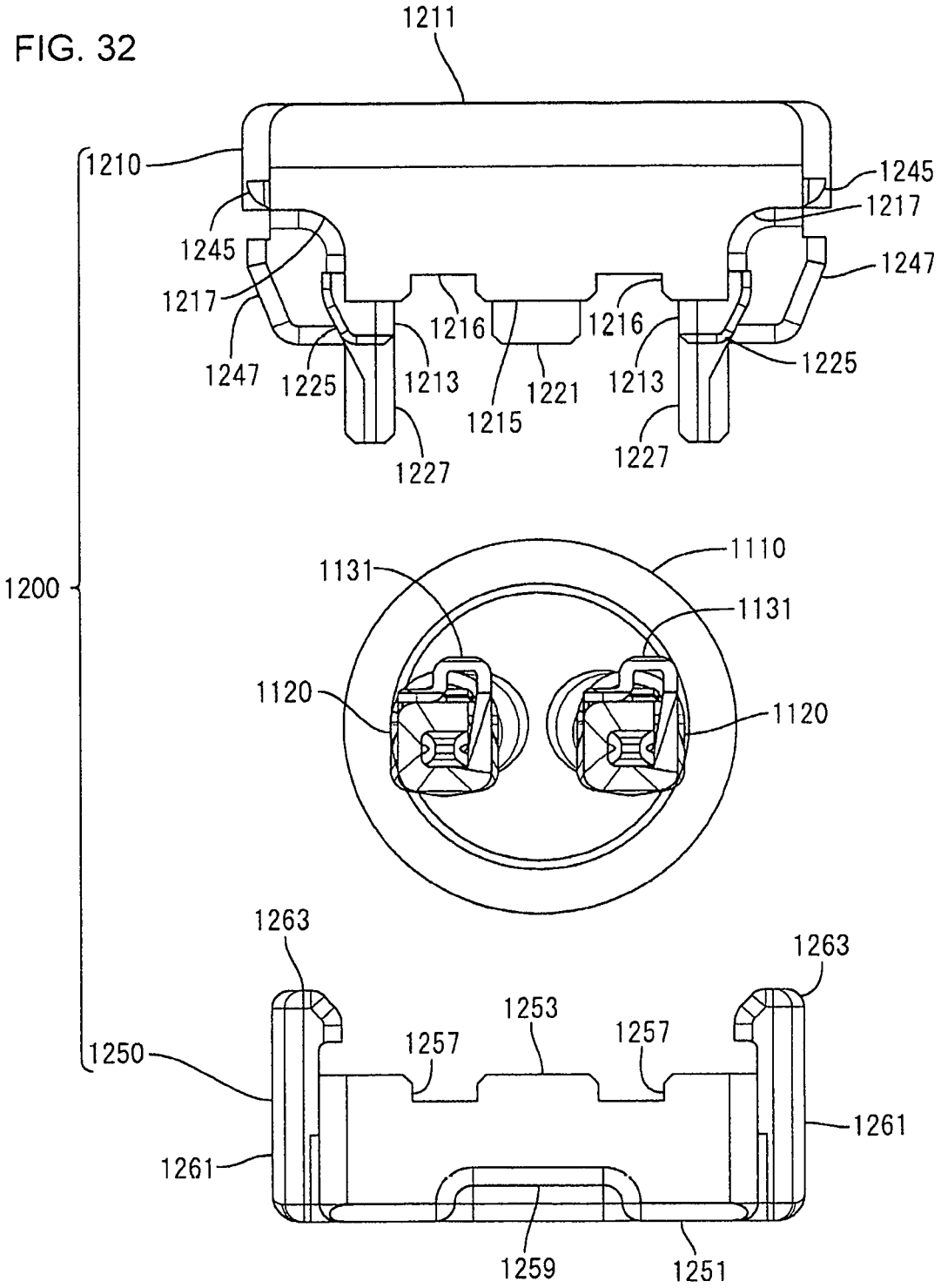
FIG. 32 is an exploded front view of a terminal module in a second embodiment.
Figure 33:
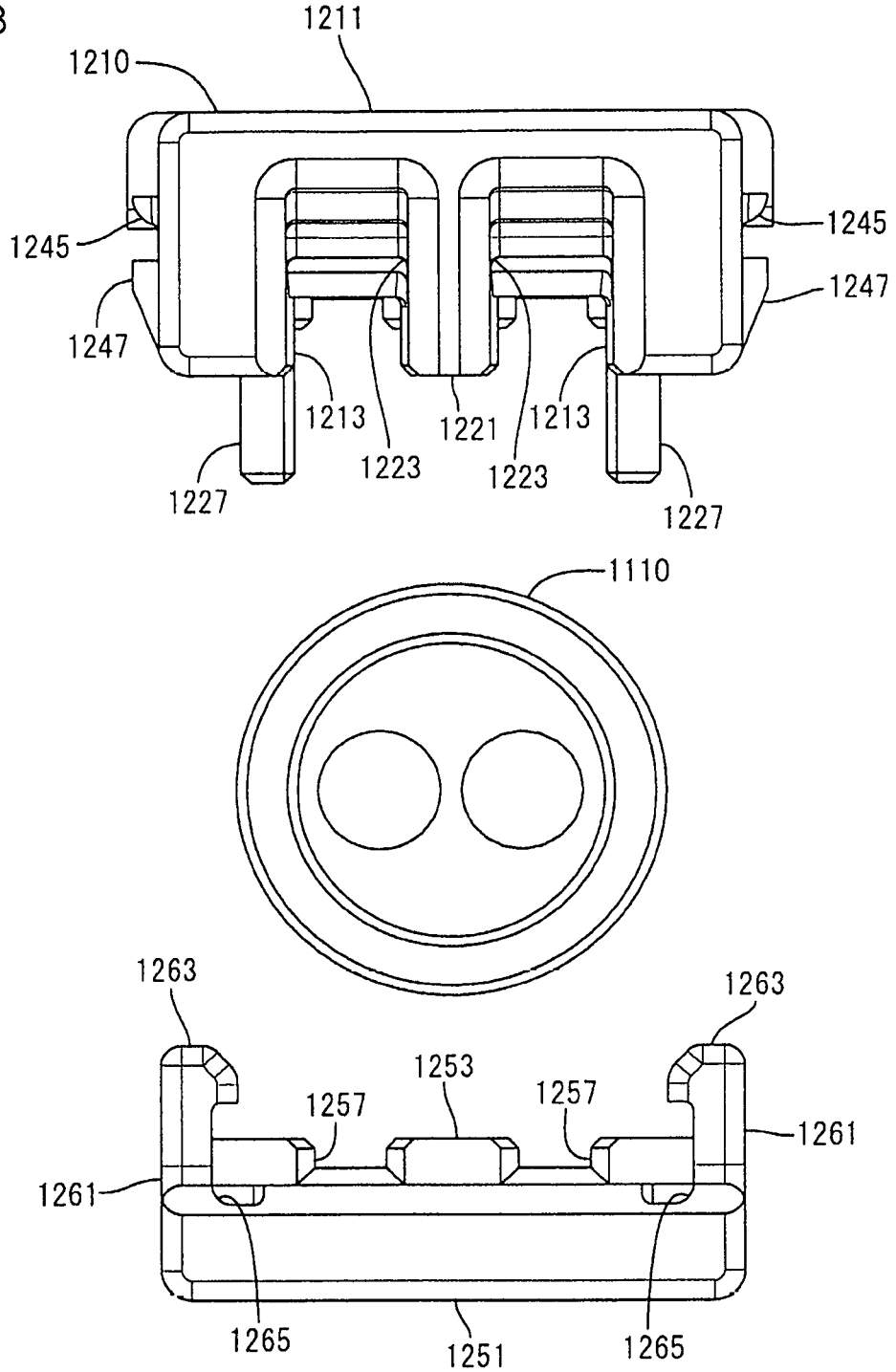
FIG. 33 is an exploded back view of the terminal module.
Figure 34:
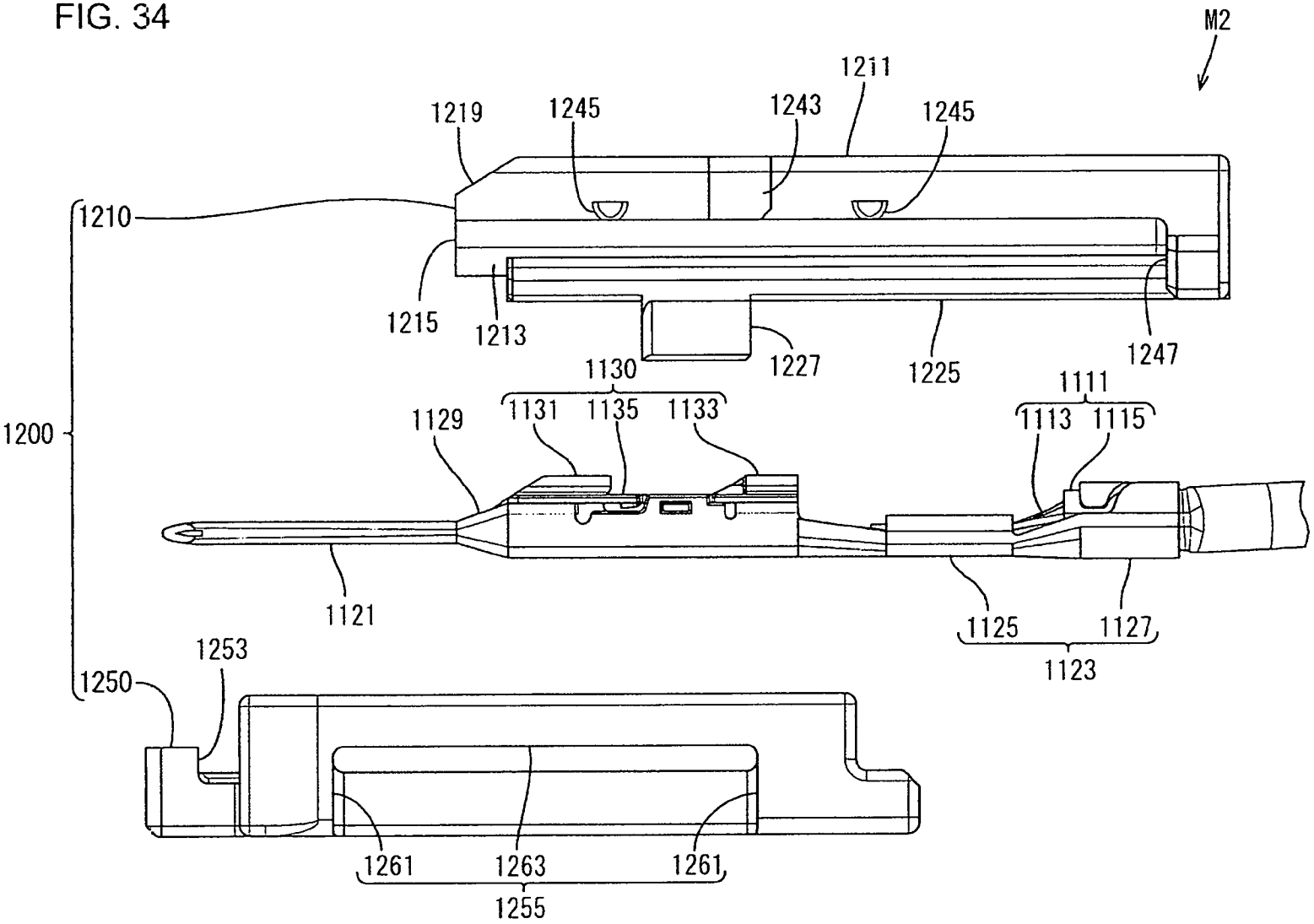
FIG. 34 is an exploded side view of the terminal module.
Figure 35:
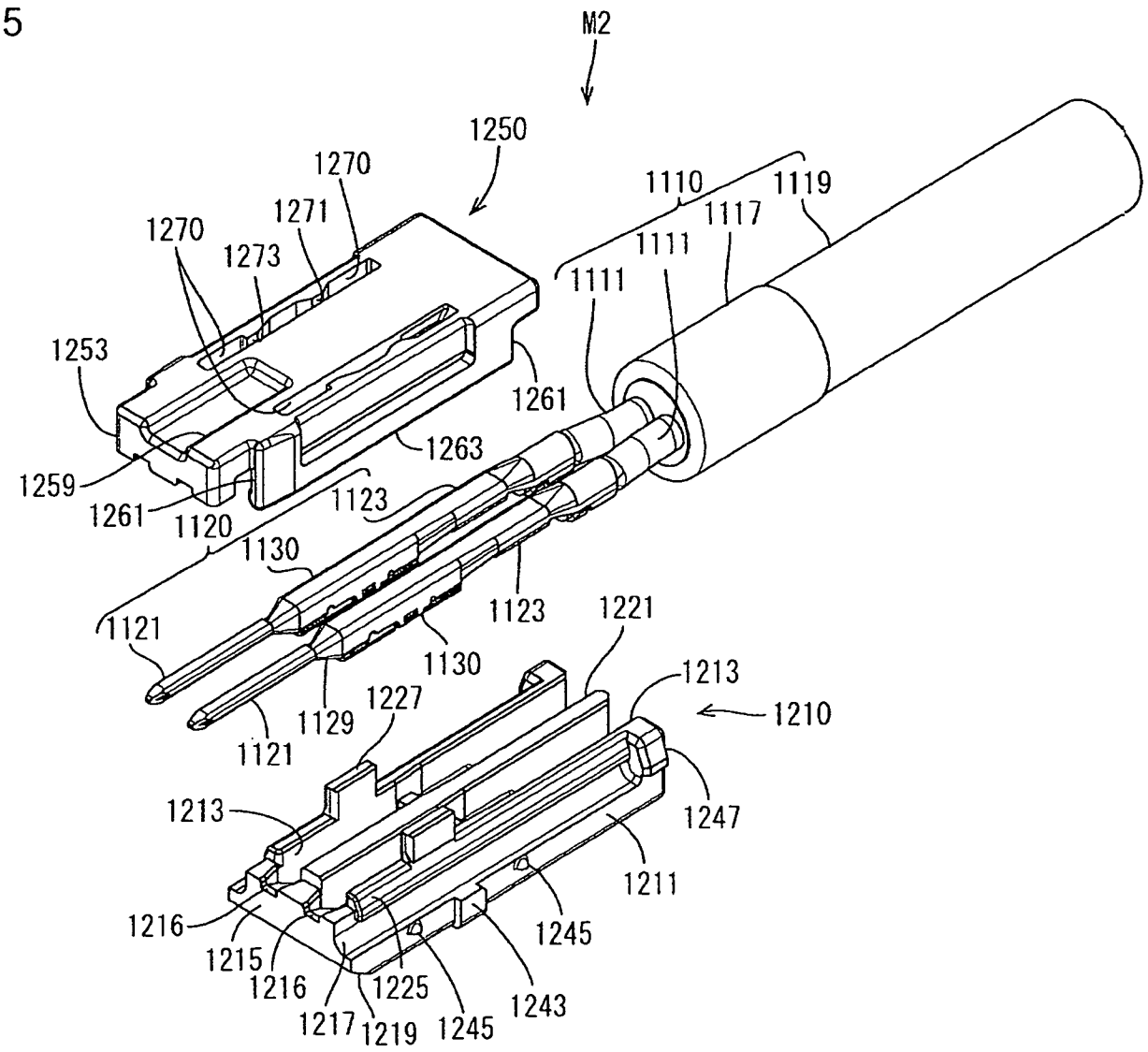
FIG. 35 is an exploded perspective view of the terminal module viewed from below.
Figure 66:
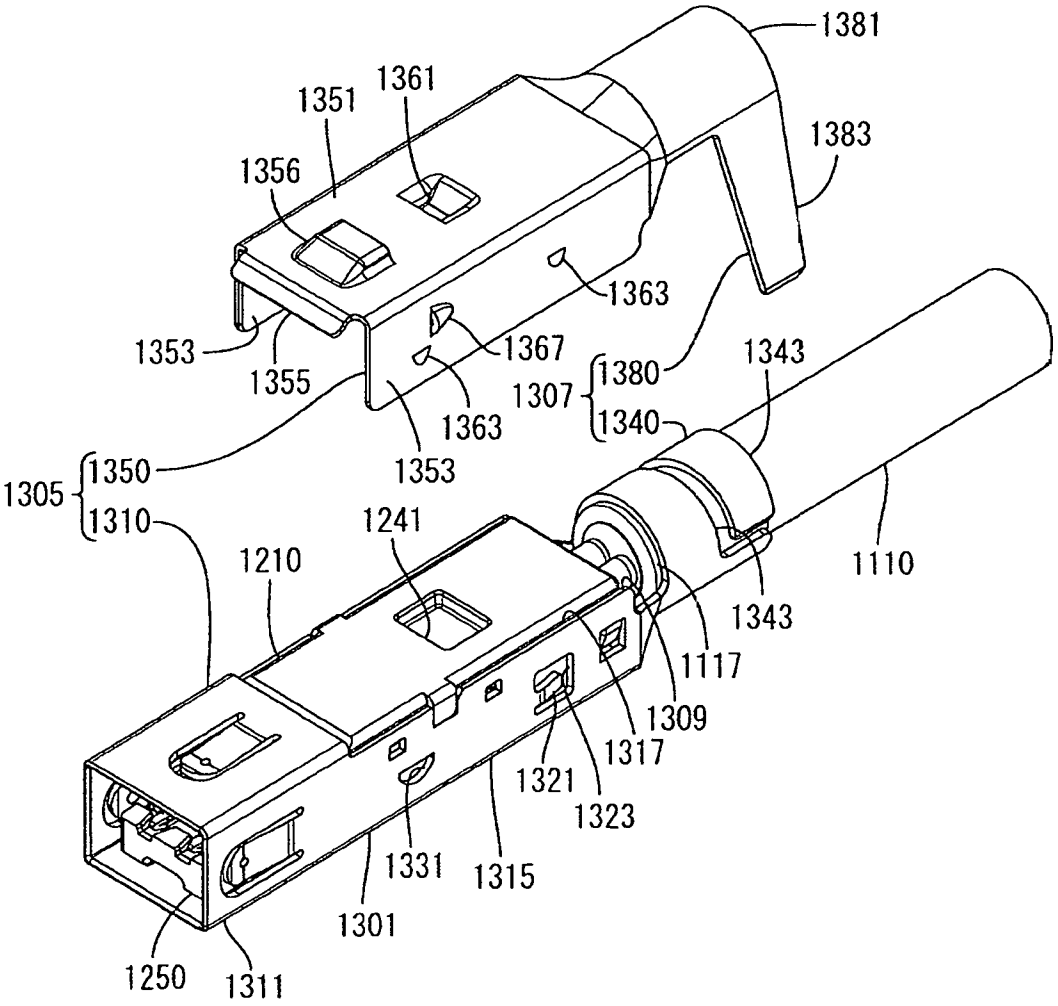
FIG. 66 is a perspective view in a state before the upper outer conductor shell is assembled with the lower outer conductor shell.
Figure 71:
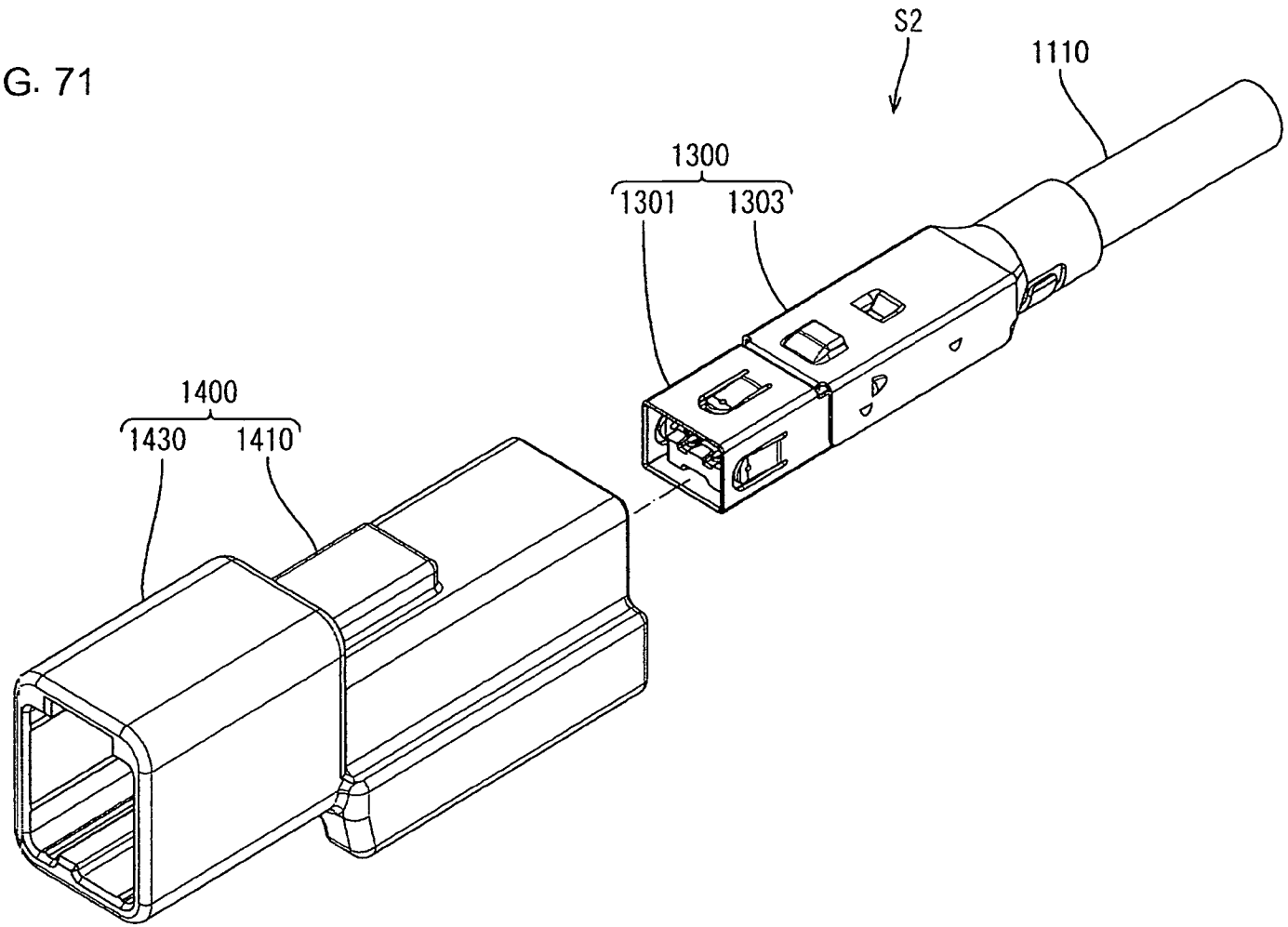
FIG. 71 is a perspective view in a state before a connector subassembly is assembled with a connector housing.

A terminal module M2 and a connector C2 of this embodiment are used for a multipolar shielded cable including a plurality of signal wires. The terminal module M2 of this embodiment includes terminals 1120 connected to signal wires 1111 of a shielded cable 1110 and a terminal holding member 1200 for holding the terminals 1120 as shown in FIGS. 34 and 35. The connector C2 of this embodiment includes a connector subassembly S2 composed of terminal module M2 and an outer conductor shell 1300 and a connector housing 1400, as shown in FIGS. 66 and 71. Note that, in the following description, a left side of FIG. 73 (connecting direction of the connector C2) is referred to as a front and a right side of FIG. 73 (side of the shielded cable 1110) is referred to as a rear concerning a front-rear direction. Further, a vertical direction is based on FIG. 32 and upper and lower sides of FIG. 32 are referred to as upper and lower sides.

As shown in FIGS. 34 and 35, the shielded cable 1110 is configured by bundling signal wires 1111 (two in this embodiment), covering around the signal wires 1111 by a shield layer 1117 and covering around the shield layer 1117 by an insulation coating 1119. The signal wire 1111 is formed by covering an inner conductor 1113 by an inner insulation coating 1115. Further, the signal wire 1111 is for transmitting a signal and the inner conductor 1113 has a small diameter. At an end of the shielded cable 1110, the insulation coating 1119 and the shield layer 1117 are stripped to expose the signal wires 1111 for connection to the terminals 1120. Further, the shield layer 1117 is folded at an end of the insulation coating 1119 and a folded part is put on the outer periphery of the insulation coating 1119 to expose the shield layer 1117.

The terminal 1120 is a male terminal fitting and formed by press-working a conductive metal plate, as shown in FIGS. 34 and 35. The terminal 1120 includes a tab-like electrically connecting portion 11121 (an example of the "tip part"), a crimping portion 1123 (an example of the "connecting part") to be crimped to the signal wire 1111 and a terminal locked portion 1130 provided between the electrically connecting portion 1121 and the crimping portion 1123. Further, a part between the terminal locked portion 1130 and the electrically connecting portion 1121 is formed into a tapered portion 1129 becoming narrower toward a tip side. The crimping portion 1123 is composed of crimping pieces in the form of open barrels and includes a wire barrel 1125 to be caulked to the inner conductor 1113 and an insulation barrel 1127 to be caulked to the inner insulation coating 1115.

As shown in FIGS. 34 and 35, the terminal locked portion 1130 is box-shaped and occupies about ⅓ of the terminal 1120 in the front-rear direction. The terminal locked portion 1130 is provided with two projections 1131, 1133 projecting up and a front stop portion 1135. A front part of each of the two projections 1131, 1133 is inclined to reduce a vertical dimension toward the front. Further, the projections 1131, 1133 of the terminal locked portion 1130 are displaced toward one side and a front stop 1135 is provided laterally to the front projection 1131. The front stop 1135 projects slightly farther up than a ceiling plate of the terminal locked portion 1130 and occupies a dimension that is about half the dimension of the terminal locked portion 1130 in the front-rear direction.

As shown in FIGS. 34 and 35, the terminal holding member 1200 is vertically (direction perpendicular to the extending direction of the terminals 1120) divided into two, configured by assembling an upper terminal holding member 1210 (an example of the "first terminal holding member") and a lower terminal holding member 1250 (an example of the "second terminal holding member"), and has a box shape long in the front-rear direction. Further, the lower terminal holding member 1250 is slidable along the extending direction of the terminals 1120 with respect to the upper terminal holding member 1210.

Figure 50:
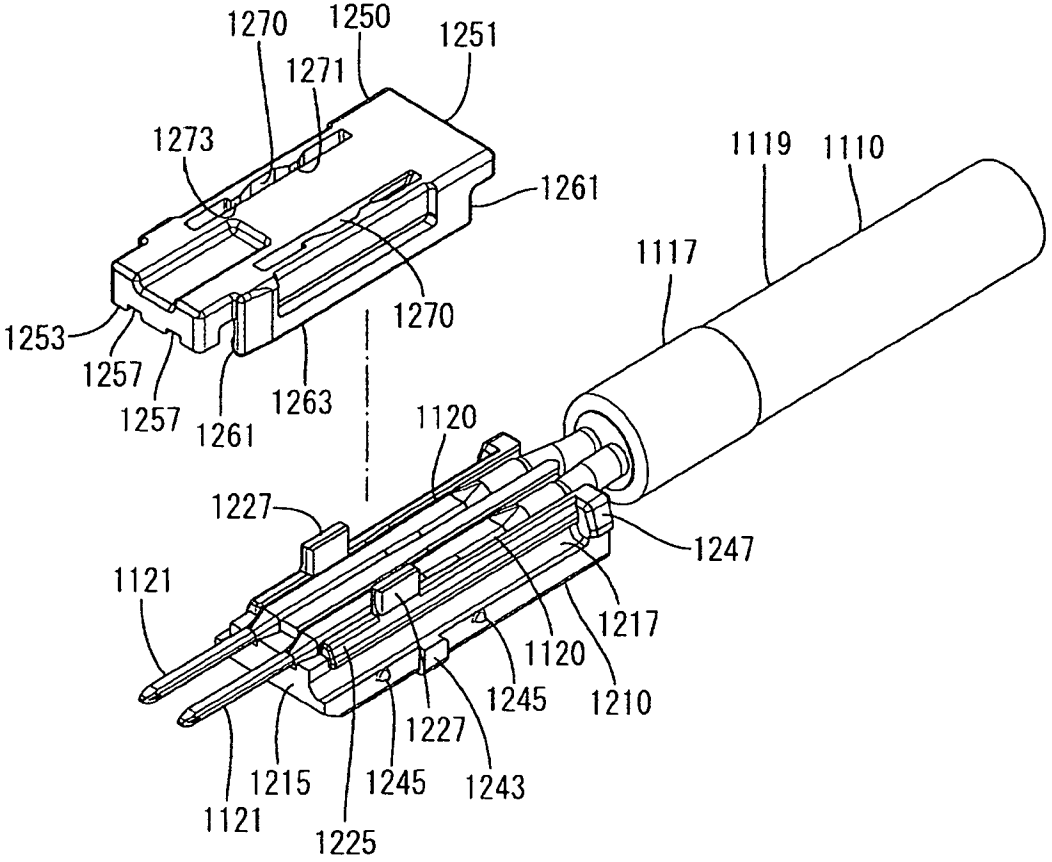
FIG. 50 is a perspective view in a state before the lower terminal holding member is assembled with the upper terminal holding member.
Figure 51:
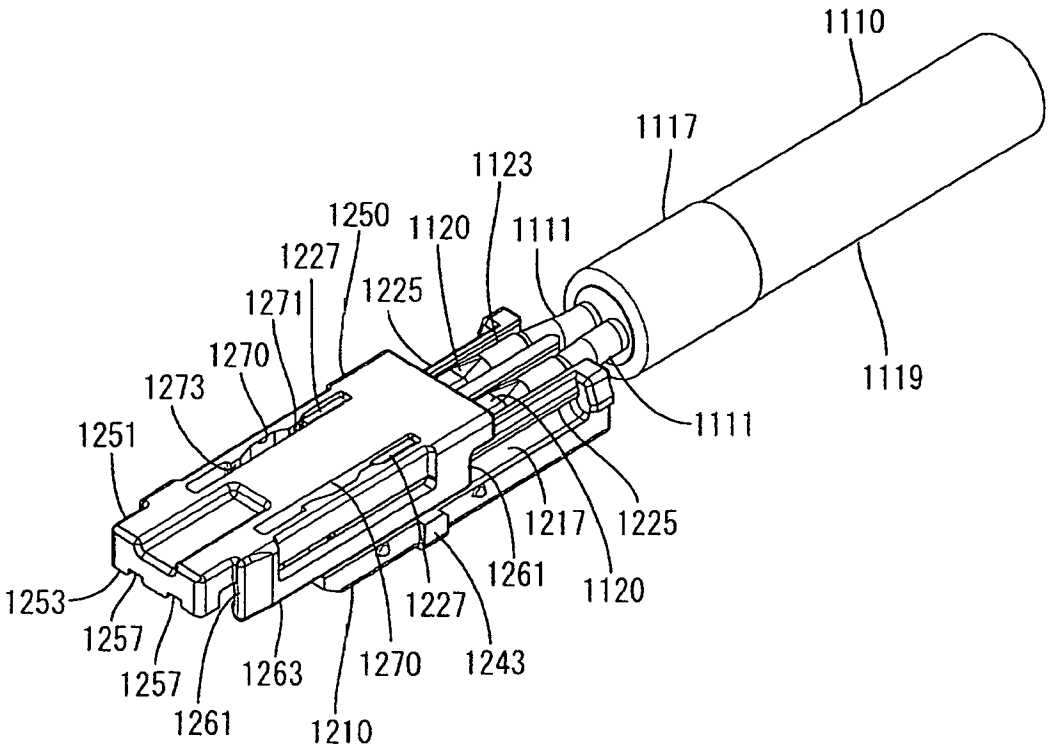
FIG. 51 is a perspective view in a state after the lower terminal holding member is assembled with the upper terminal holding member.

The upper terminal holding member 1210 is made of synthetic resin and holds the crimping portions 1123 and the terminal locked portions 1130 of the terminals 1120, as shown in FIGS. 35 and 50. The upper terminal holding member 1210 includes a ceiling wall 1211, two side walls 1213 vertically projecting from the ceiling wall 1211 and an upper front wall 1215, and is open up and rearward. The upper front wall 1215 is integrated with a lower front wall 1253 to be described later, thereby forming a front wall of the terminal holding member 1200, and the upper front wall 1215 is provided with upper insertion grooves 1216 to form insertion holes into which the electrically connecting portions 1121 of the terminals 1120 are insertable. The side walls 1213 project down from positions inwardly of widthwise end parts of the ceiling wall 1211, and surfaces between the ceiling wall 1211 and the side walls 1213 are formed into rounded surfaces 1217. Further, the lower end positions of the side walls 1213 are at the same height as the lower end positions of the terminal locked portions 1130 of the accommodated terminals 1120. Further, an inclined surface 1219 is formed from a front part of the ceiling wall 1211 to the upper front wall 1215 to reduce a vertical dimension toward a front end.

Figure 37:
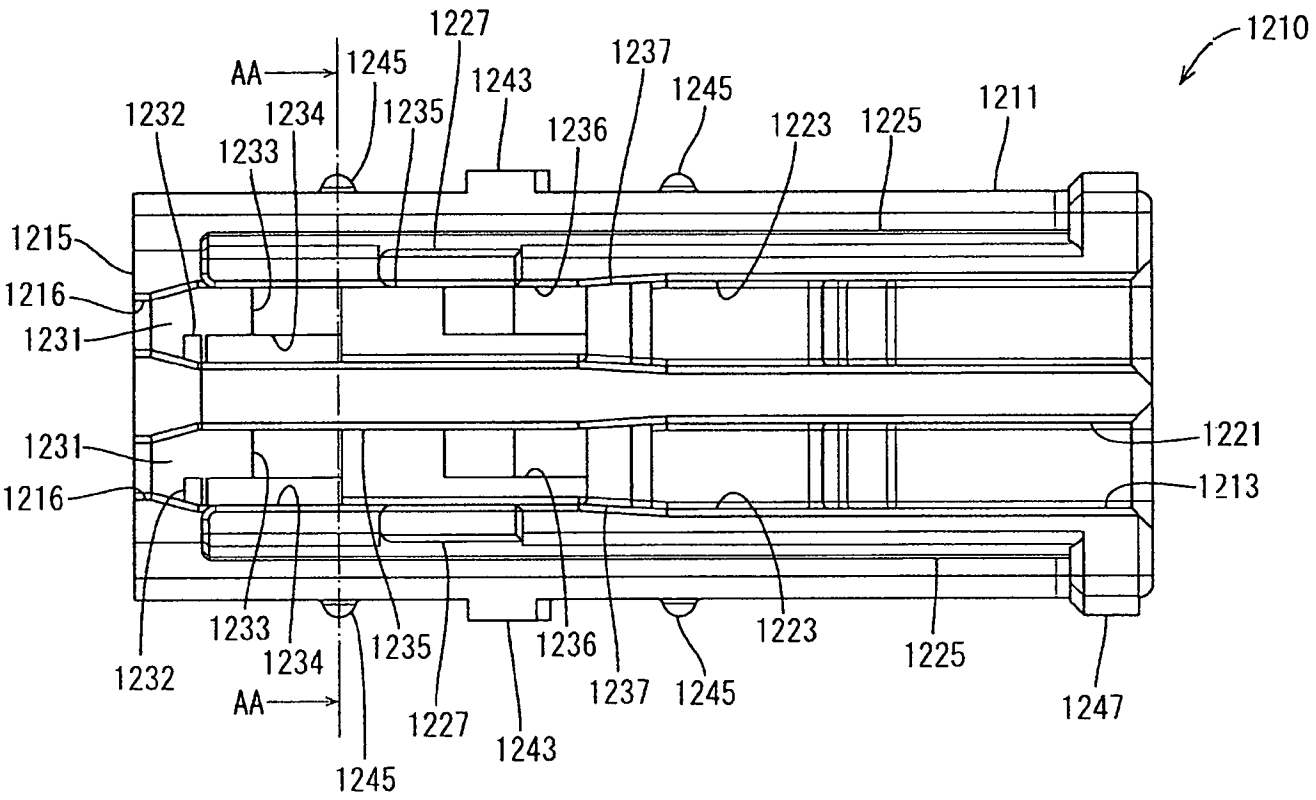
FIG. 37 is a bottom view of the upper terminal holding member.
Figure 38:
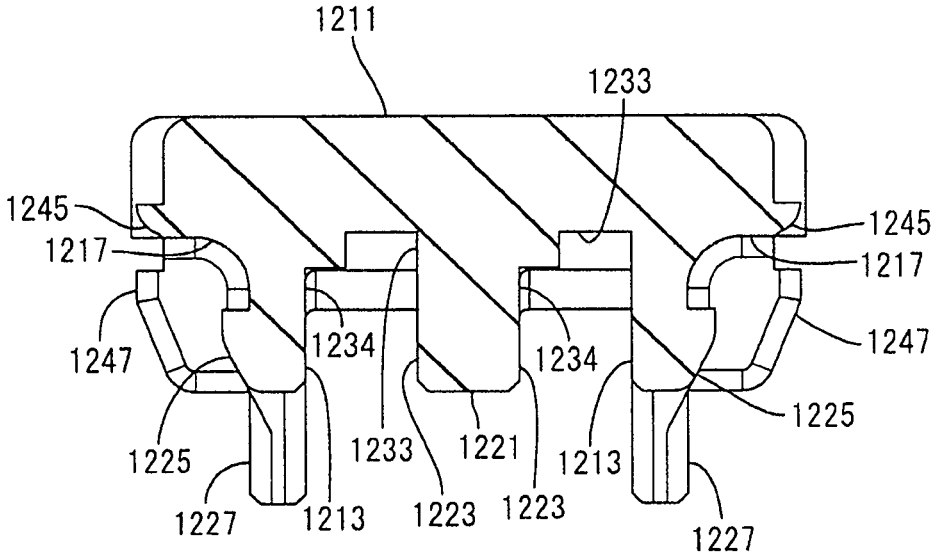
FIG. 38 is a section at position AA-AA in FIG. 37.

As shown in FIGS. 35 and 37, a partition wall 1221 is provided between the side wall 1213 to partition between the terminals 1120. The partition wall 1221 projects down to the same height as the lower end positions of the side walls 1213 from the ceiling wall 1211. An area enclosed by each side wall 1213, the partition wall 1221 and the ceiling wall 1211 serves as an accommodation recess 1223 for accommodating the crimping portion 1123 and the terminal locked portion 1130 of the terminal 1120. The accommodation recess 1223 is open down, and the terminal 1120 can be accommodated therein from below with the electrically connecting portion 1121 projecting. Further, an inner dimension between each side wall 1213 and the partition wall 1221 (of the accommodation recess 1223) is substantially equal to an outer dimension of the terminal locked portion 1130. The inner dimension between each side wall 1213 and the partition wall 1221 (of the accommodation recess 1223) becomes larger toward a rear side, and is substantially equal to or slightly larger than an outer dimension of the crimping portion 1123 at a rear half part.

Figure 54:
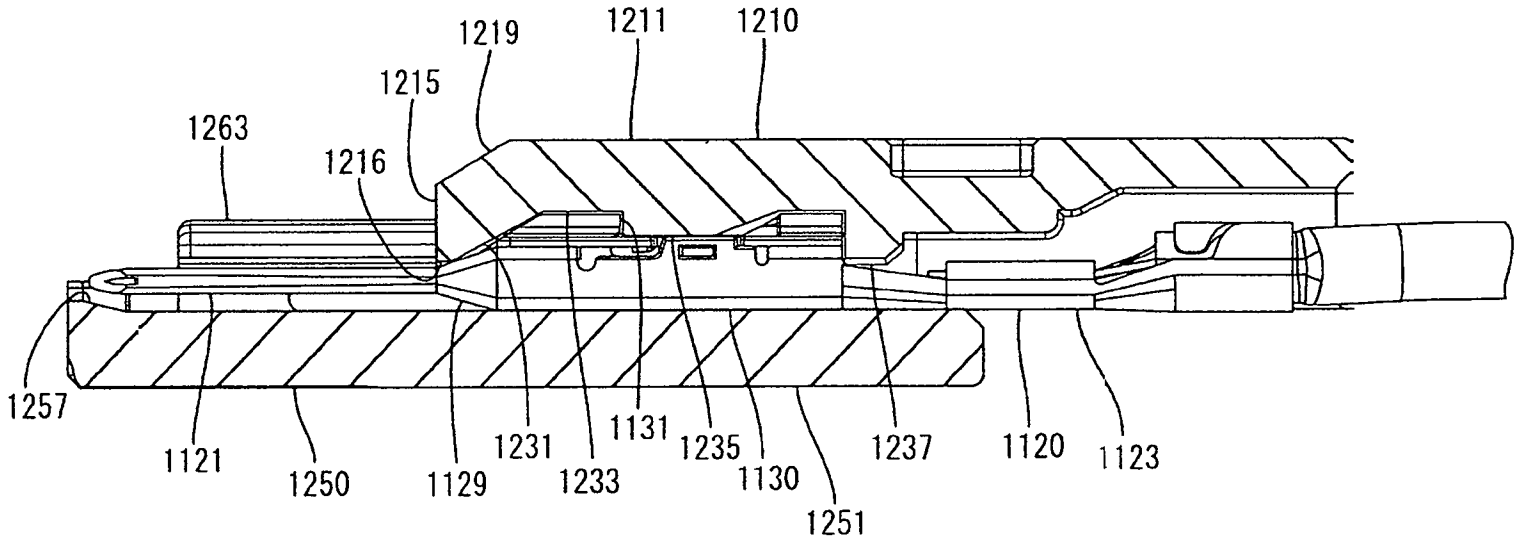
FIG. 54 is a section in the state after the lower terminal holding member is assembled with the upper terminal holding member.

As shown in FIGS. 37 and 54, the upper surface of the accommodation recess 1223 is shaped in conformity with the shape of an upper part of the terminal 1120. Particularly, a terminal locking portion 1230 into which the terminal locked portion 1130 is to be fit is provided in the lower surface of the ceiling wall 1211 (upper surface of a front part of the accommodation recess 1223) in a part where the terminal locked portion 1130 is to be accommodated.

Figure 39:
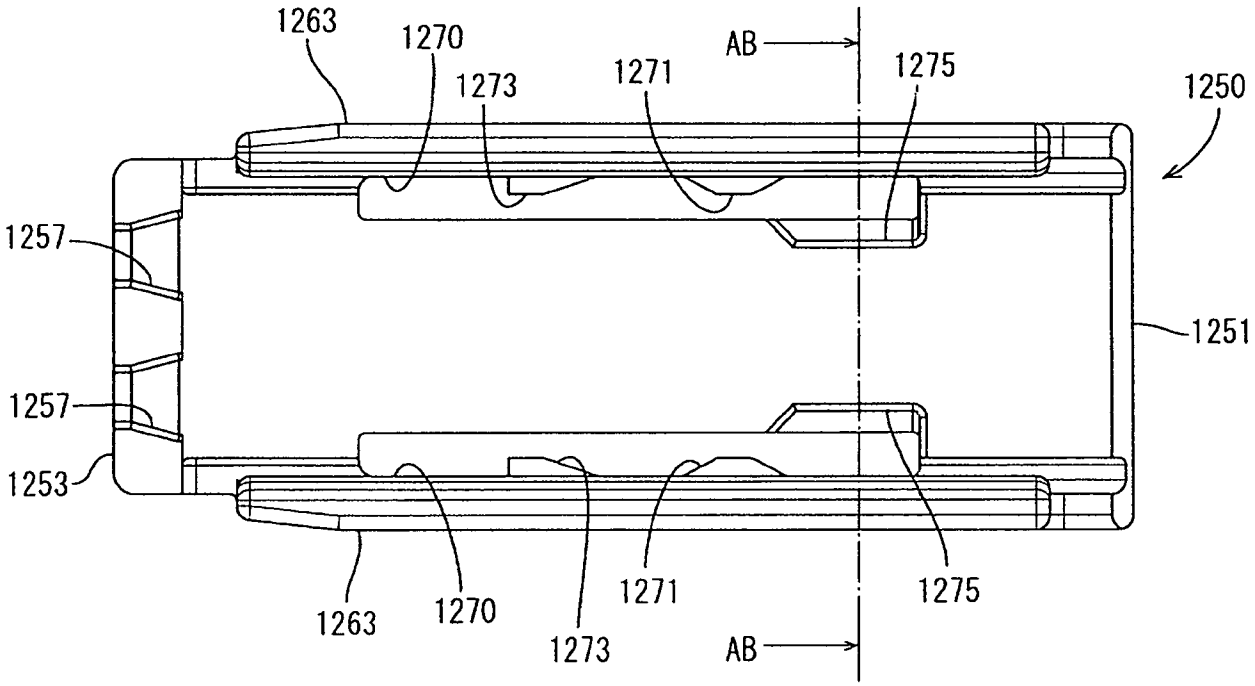
FIG. 39 is a plan view of a lower terminal holding member.

As shown in FIGS. 37 and 54, a front part of the terminal locked portion 1130 has a tapered surface 1231 for accommodating the tapered portion 1129 of the terminal 1120 and the inclined surface of the front projection 1131. The tapered surface 1231 is formed to reduce a vertical dimension of the ceiling wall 1211 toward a rear side from the lower end position of the upper insertion groove 1216. As shown in FIGS. 37 and 39, a front stop wall 1232 is provided at an intermediate position of the tapered surface 1231 in the front-rear direction and displaced toward one side. The front stop wall 1232 is rectangular in a bottom view and has a flat bottom surface. As shown in FIGS. 37 and 54, a first accommodating portion 1233 for accommodating the front projection 1131 is provided on a side opposite to the front stop wall 1232 behind the tapered surface 1231. Further, a second accommodating portion 1234 for accommodating the front stop 1135 of the terminal 1120 is formed from a position behind the front stop wall 1232 to a position lateral to the first accommodating portion 1233. A first projecting portion 1235 projecting farther down than the first and second accommodating portions 1233, 1234 is formed behind the first and second accommodating portions 1233, 1234. A third accommodating portion 1236 for accommodating the rear projection 1133 of the terminal 1120 is formed at a position of the first projecting portion 1235 near the first accommodating portion 1233. A front part of the third accommodating portion 1236 is inclined along an inclined surface of the projection 1133. A second projecting portion 1237 is provided behind the first projecting portion 1235 and the third accommodating portion 1236. The second projecting portion 1237 projects farther down than the first projecting portion 1235 and projects to the same height as the lower end position of the tapered surface 1231.

Further, as shown in FIGS. 37 and 54, a part of the accommodation recess 1223 where the crimping portion 1123 is to be accommodated is recessed in conformity with the shape of the crimping portion 1123 with a clearance provided between the crimping portion 1123 and this recess. More specifically, a part where the insulation barrel 1127 is to be accommodated is recessed more than a part where the wire barrel 1125 is to be accommodated so that a constant clearance is defined between the crimping portion 1123 of the terminal 1120 and the accommodation recess 1223.

As shown in FIGS. 35 and 37, guides 1225 project out in the width direction from the both side walls 1213. Each guide 1225 extends in the front-rear direction (extending direction of the terminals 1120) from the front end to the rear end of the side wall 1213 of the upper terminal holding member 1210. The lower end position of each guide 1225 is at the same height as that of the side wall 1213, and a surface from the lower surface of the side wall 1213 toward the side surface of the guide 1225 is a rounded surface. Further, the upper surface of the guide 1225 is a surface perpendicular to the side surface of the side wall 1213.

Further, as shown in FIGS. 34 and 35, a locking plate 1227 (parts of a "full locking portion" and a "partial locking portion") is provided at an intermediate position of each side wall 1213 in the front-rear direction. The locking plate 1227 is slightly thinner than the side wall 1213 and is rectangular in a side view. The locking plate 1227 projects down, and projects to reach a position slightly above the lower end position of the lower terminal holding member 1250 when the upper terminal holding member 1210 is assembled with the lower terminal holding member 1250.

Figure 36:
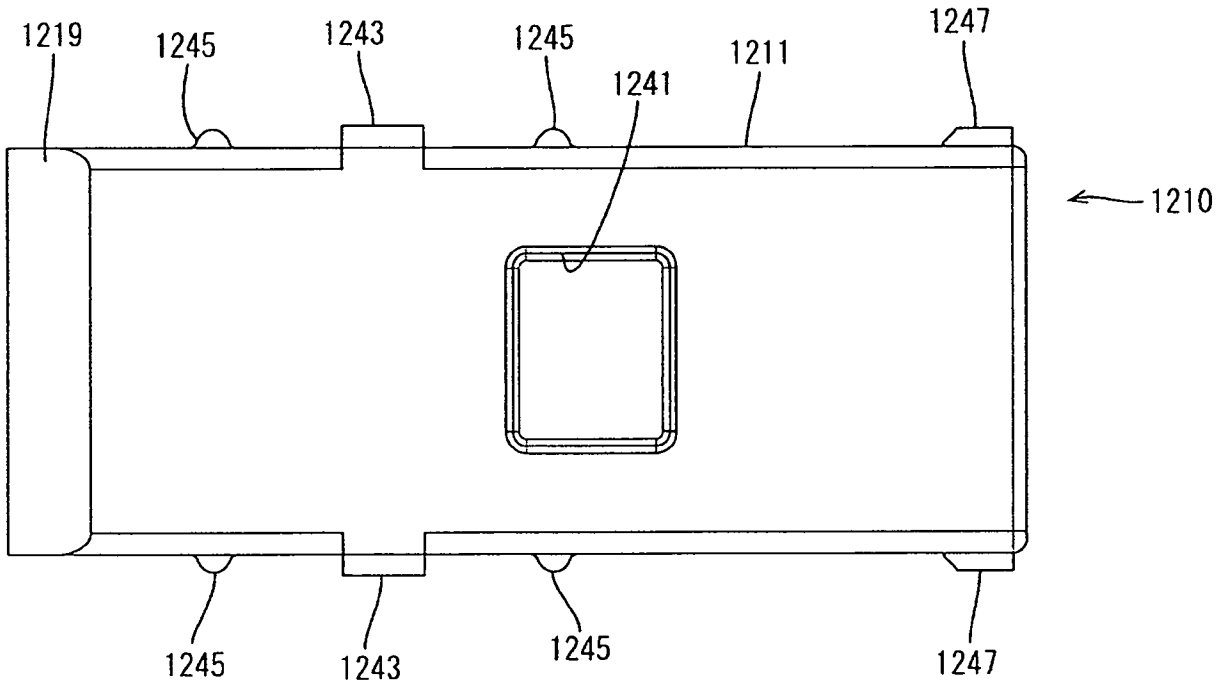
FIG. 36 is a plan view of an upper terminal holding member.

In the upper surface of the ceiling wall 1211 at a center position in the front-rear direction, an engaging recess 1241 (an example of a "first engaging portion") is recessed farther down than the upper surface, as shown in FIGS. 35 and 36. The engaging recess 1241 is rectangular in a plan view, and is engaged with a struck portion 1361 (see FIG. 66) for engagement of an upper outer conductor surface 1303. Further, engaging portions 1243 (an example of the "first engaging portion") to be engaged with cuts 1325 of a lower outer conductor surface 1301 are provided on side surfaces of the ceiling wall portion 1211. The engaging portions 1243 are provided on each side surface of the ceiling wall 1211 at a position closer to the front end than a center of the ceiling wall 1211 in the front-rear direction, and projects out in the width direction by a plate thickness of the lower outer conductor surface 1301. Further, two engaging projections 1245 (an example of the "first engaging portion") having ¼ shape of a sphere are provided on the side surface at front and rear sides of each engaging portion 1243, i.e. a total of four engaging projections 1245 are provided. A projecting dimension of the engaging projection 1245 in the width direction is smaller than that of the engaging portion 1243 in the width direction. Further, an engaging claw 1247 is provided on a rear end part of each side wall 1213. The engaging claw 1247 extends over to each guide 1225, and in the form of a claw projecting more outward in the width direction toward an upper side.

The lower terminal holding member 1250 is made of synthetic resin and, as shown in FIGS. 34 and 39, accommodates the crimping portions 1123 and the terminal locked portions 1130 of the terminals 1120 together with the upper terminal holding member 1210. The lower terminal holding member 1250 includes a bottom wall 1251, the lower front wall 1253 and rail walls 1255. The bottom wall 1251 is a flat plate having a flat upper surface. The lower front wall 1253 is provided with lower insertion grooves 1257 forming the insertion holes, into which the electrically connecting portions 1121 of the terminals 1120 are insertable, together with the upper insertion grooves 1216.

Figure 40:
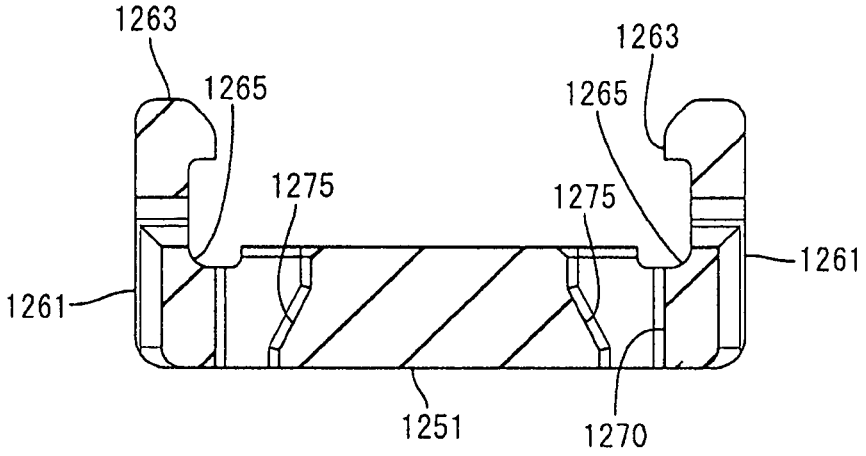
FIG. 40 is a section at position AB-AB in FIG. 39.

As shown in FIGS. 34 and 40, the rail walls 1255 of the lower terminal holding member 1250 are positioned to cover the side walls 1213 of the upper terminal holding member 1210 from outer sides in the width direction. Each rail wall 1255 is composed of two arms 1261 projecting up from a position where a tiny clearance is provided in the front-rear direction between the rail wall 1255 and the lower front wall 1253 so as not to interfere with a spring 1313 to be described later and a front position where the rail wall 1255 is assembled with the engaging claw 1247, and a rail 1263 configured to slide by being fit to the guide 1225. The rail 1263 is in the form of a claw projecting inward, and extends in the front-rear direction (extending direction of the terminals 1120) between the arms 1261. A surface from the upper end of the rail 1263 toward the inner claw part is rounded. Further, the lower surface of the rail 1263 is a surface configured to slide on the upper surface of the guide 1225. Further, a groove 1265 having a rounded surface is provided at a position of the bottom wall 1251 inwardly of the arms 1261. The groove 1265 extends in the front-rear direction and is provided from the rear end of the lower front wall 1253 to the rear end position of the bottom wall 1251 so that the arms 1261 easily are deflected and deformed outward in the width direction.

Figure 59:
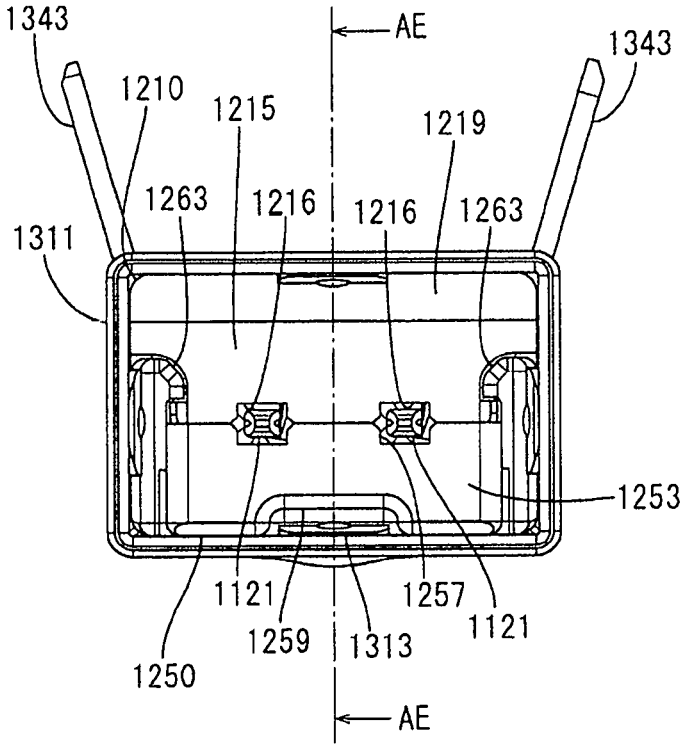
FIG. 59 is a front view in the state after the terminal holding member is assembled with the lower outer conductor shell.
Figure 60:
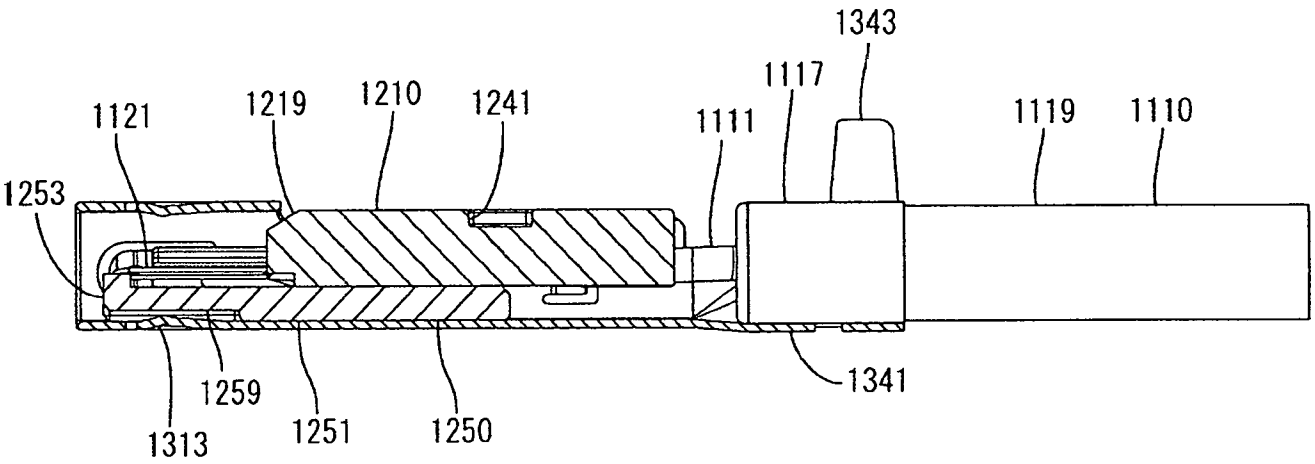
FIG. 60 is a section at position AE-AE in FIG. 59.

As shown in FIGS. 35 and 59, an escaping groove 1259 is provided in the lower surface of the bottom wall 1251 at a front end position and allows the spring 1313 of the lower outer conductor shell 1301 (described later) to escape. The escaping groove 1259 is rectangular in a bottom view and extends from the front end position of the bottom wall 1251 by recessing the lower surface of the bottom wall 1251 upwardly.

As shown in FIGS. 39 and 40, the bottom wall 1251 is provided with two penetrating rails 1270 into which the locking plates 1227 are to be fit. Each penetrating rail 1270 penetrates through the bottom wall 1251 in a plate thickness direction and extends in the front-rear direction between the arms 1261. A width of the penetrating rail 1270 is equal to or slightly larger than that of the locking plate 1227.

The penetrating rail 1270 is provided with a partial locking projection 1271 (an example of the "partial locking portion") and a full locking projection 1273 (an example of the "full locking portion"). The partial locking projection 1271 is provided at a position separated from the rear end position of the penetrating rail 1270 by a dimension of the locking plate 1227 in the front-rear direction, and has the same plate thickness (vertical dimension) as the bottom wall 1251. The partial locking projection 1271 projects inward of the penetrating rail 1270 from a side surface of the penetrating rail 1270, and suppresses a movement of the locking plate 1227 in the front-rear direction by narrowing the penetrating rail 1270. The front and rear surfaces of the partial locking projection 1271 are formed into inclined surfaces so that the locking plat 1227 easily passes through a position where the partial locking projection 1271 is provided.

On the other hand, the full locking projection 1273 is provided at a position separated from the front position of the penetrating rail 1270 by the dimension of the locking plate 1227 in the front-rear direction, and has the same plate thickness (vertical dimension) as the bottom wall 1251. The full locking projection 1273 projects inward of the penetrating rail 1270 from the side surface of the penetrating rail 1270, and suppresses a movement of the locking plate 1227 in the front-rear direction by narrowing the penetrating rail 1270. The rear surface of the full locking projection 1273 is formed into an inclined surface, whereas the front surface thereof is perpendicular to an inner side surface of the penetrating rail 70 to suppress a rearward return of the locking plate 1227 that has passed through the full locking projection 1273 once.

A guide groove 1275 is provided at the rear end position of the penetrating rail 1270 for guiding the locking plate 1227 when fitting the locking plate 1227 into the penetrating rail 1270. The guide groove 1275 gradually inclines down from an inner side toward an outer side in the width direction, thereby making the locking plat 1227 easily fittable into the penetrating rail 1270.

Figure 67:
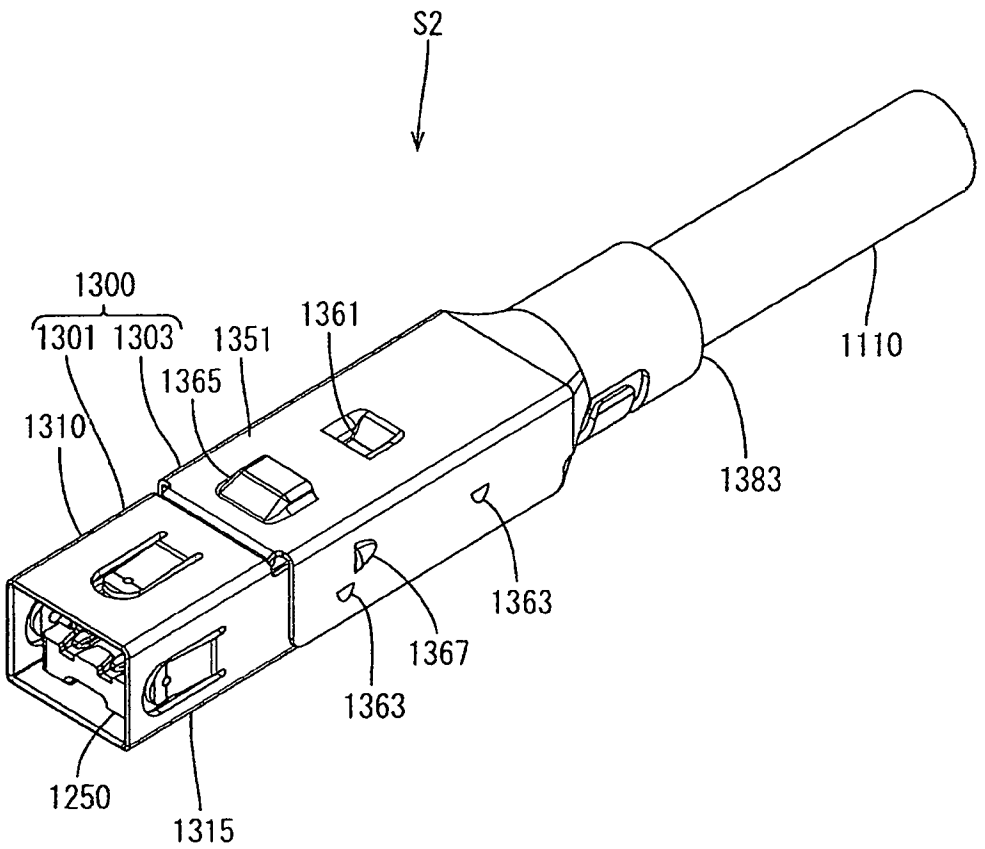
FIG. 67 is a perspective view in a state after the upper outer conductor shell is assembled with the lower outer conductor shell.
Figure 68:
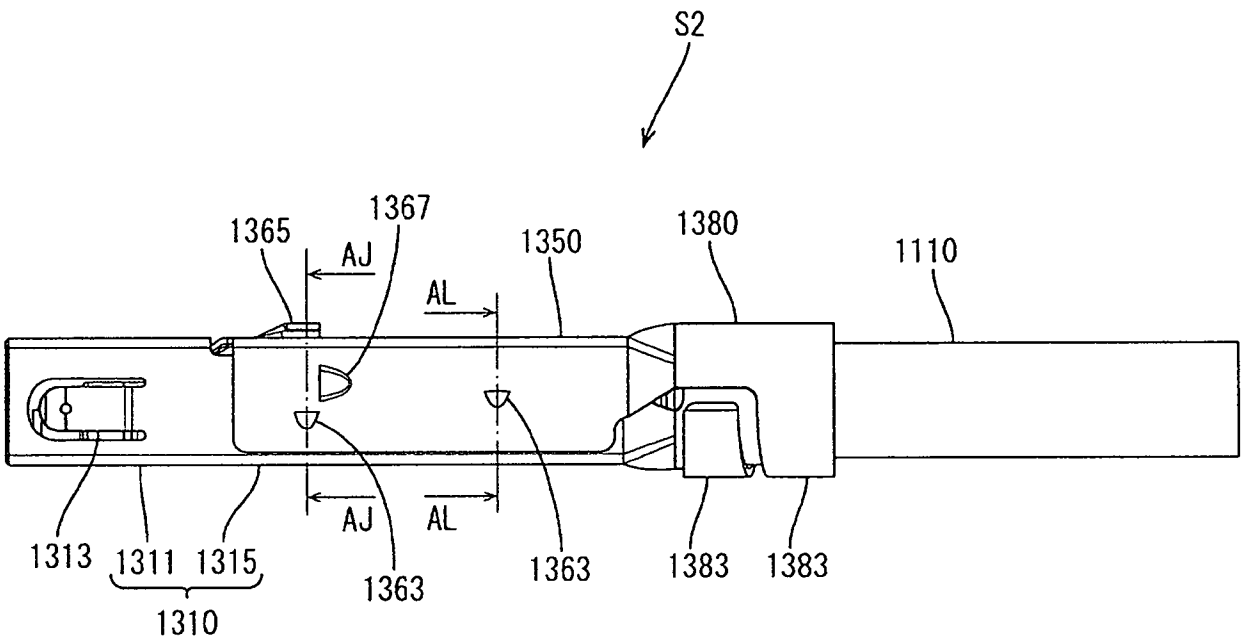
FIG. 68 is a perspective view in the state after the upper outer conductor shell is assembled with the lower outer conductor shell.

As shown in FIGS. 66 and 67, the outer conductor shell 1300 is divided vertically (direction perpendicular to the extending direction of the terminals 1120) into two, and is configured by assembling the lower outer conductor shell 1301 (an example of the "first outer conductor shell" and an upper outer conductor shell 1303 (an example of the "second outer conductor shell"). Further, the outer conductor shell 1300 includes a body 1305 in the form of a rectangular tube for accommodating the terminal holding member 1200 and a barrel 1307 to be connected to the shield layer 1117 of the shielded cable 1110.

The lower outer conductor shell 1301 is formed by press-working a conductive plate material. As shown in FIG. 66, the lower outer conductor shell 1301 includes a lower body 1310 in the form of a rectangular tube constituting a part of the body 1305 and a lower barrel portion 1340 constituting a part of the barrel 1307.

Figure 41:
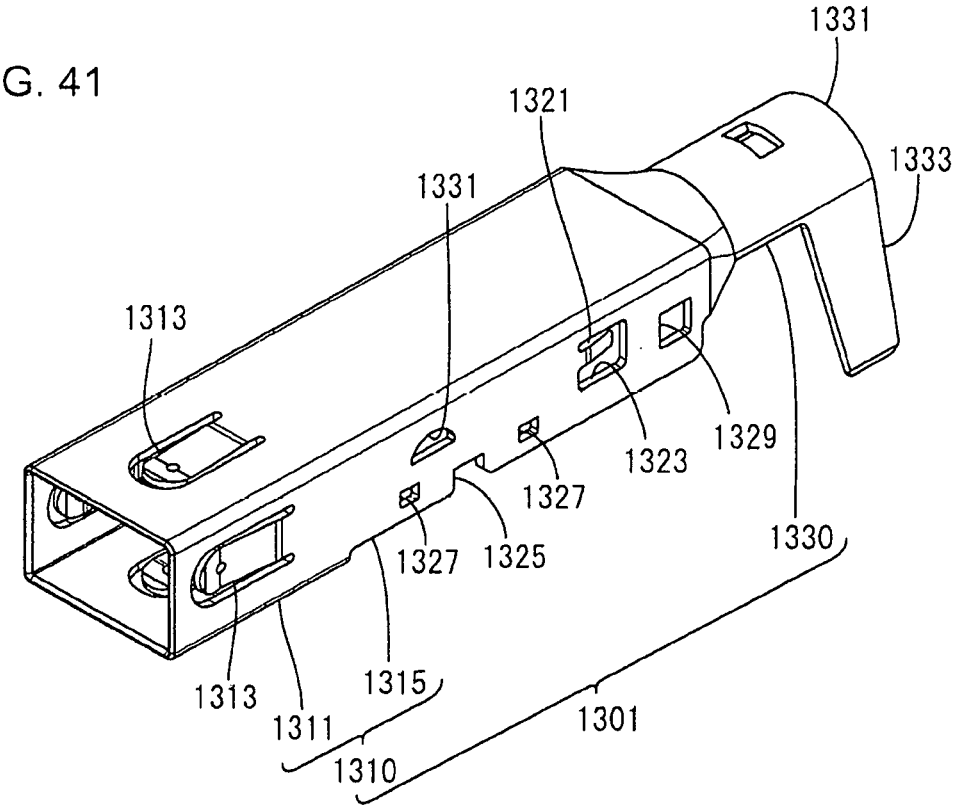
FIG. 41 is a perspective view of a lower outer conductor shell viewed from below.
Figure 42:
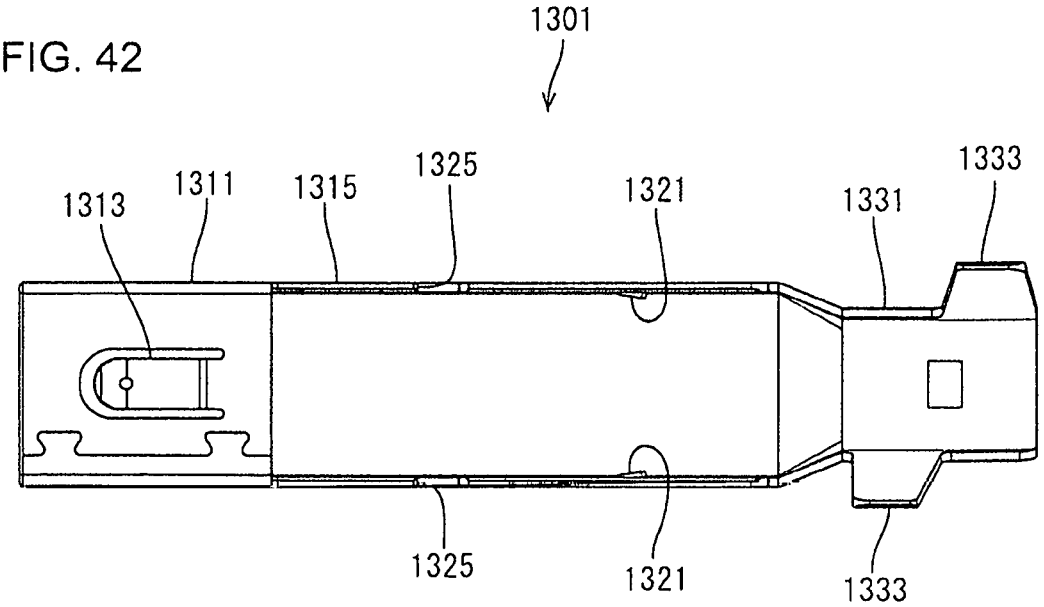
FIG. 42 is a plan view of the lower outer conductor shell.
Figure 55:
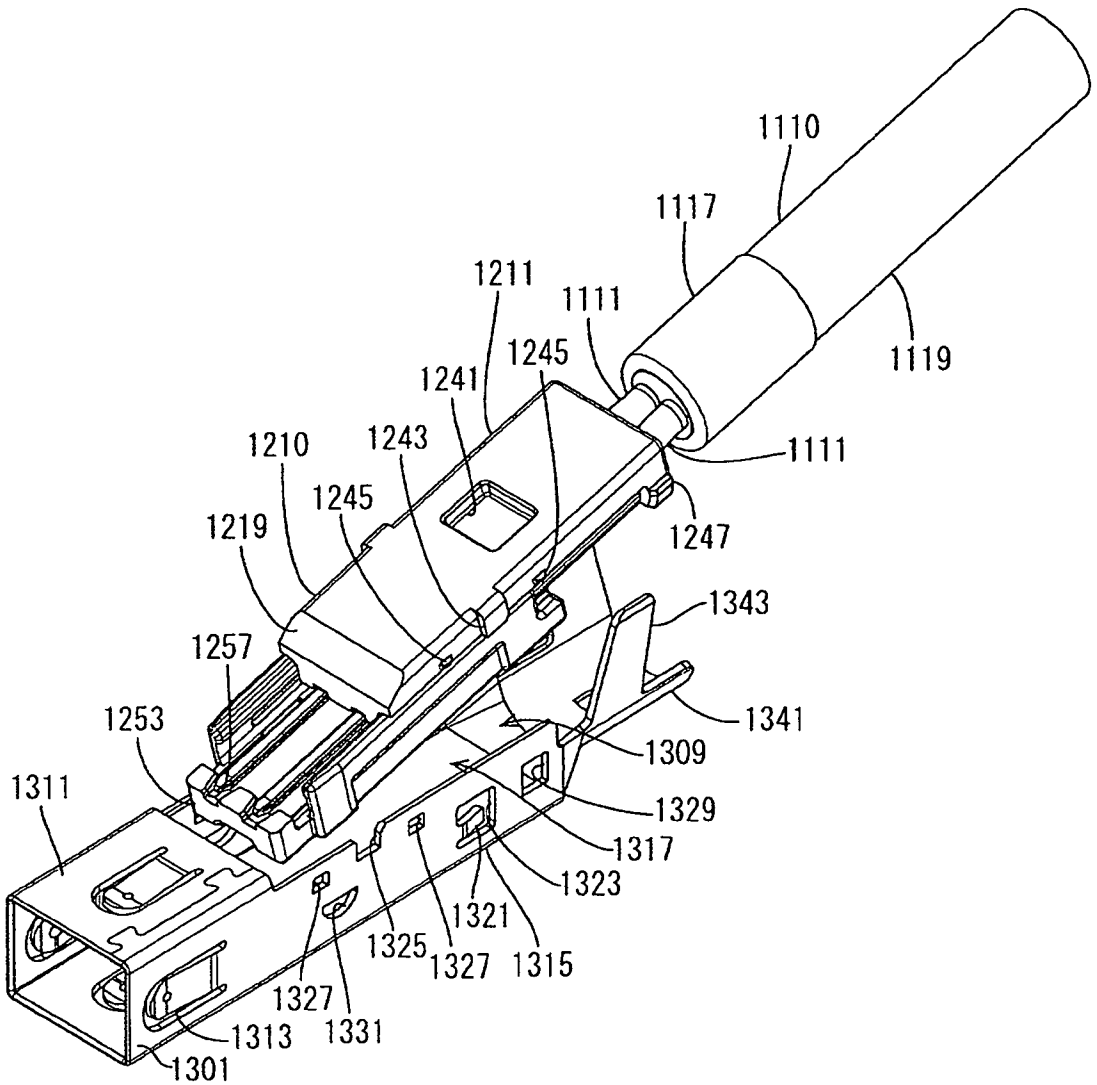
FIG. 55 is a perspective view in a state before a terminal holding member is assembled with the lower outer conductor shell.

As shown in FIGS. 41 and 55, the lower body 1310 is substantially in the form of a rectangular tube open in the front-rear direction and a front part 1311 of the lower body 1310 has four surrounding surfaces. The spring 1313 configured to contact a mating shell is provided on each surface of the front part 1311. On the other hand, a rear part 1315 of the lower body 1310 is provided with a body-side opening 1317 entirely open upward, and has a U-shaped cross-section. Further, the electrically connecting portions 1121 of the terminals 1120 can be accommodated into the front part 1311 of the lower body 1310, and the terminal holding member 1200 can be accommodated into the rear part 1315. A dimension of the rear part 1315 of the lower body 1310 in the front-rear direction is substantially equal to that of the terminal holding member 1200 in the front-rear direction.

Figure 63:
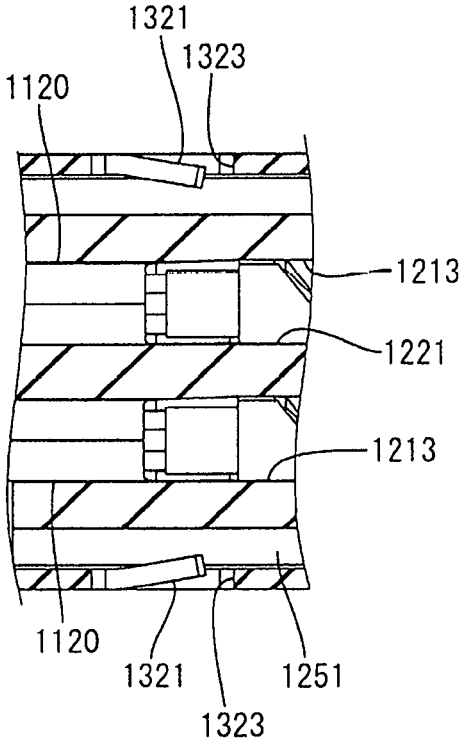
FIG. 63 is a section at position AG-AG in FIG. 61.

Both side surfaces of the rear part 1315 of the lower body 1310 are struck inward to provide locking pieces 1321, as shown in FIGS. 55 and 63. The locking pieces 1321 are fit between the bottom wall 1251 and the rails 1263 of the lower terminal holding member 1250 to suppress a movement of the lower terminal holding member 1250 in the vertical direction. Further, a cut-and-raised hole 1323 penetrating in the plate thickness direction is provided on a peripheral edge part of the locking piece 1321.

Figure 61:
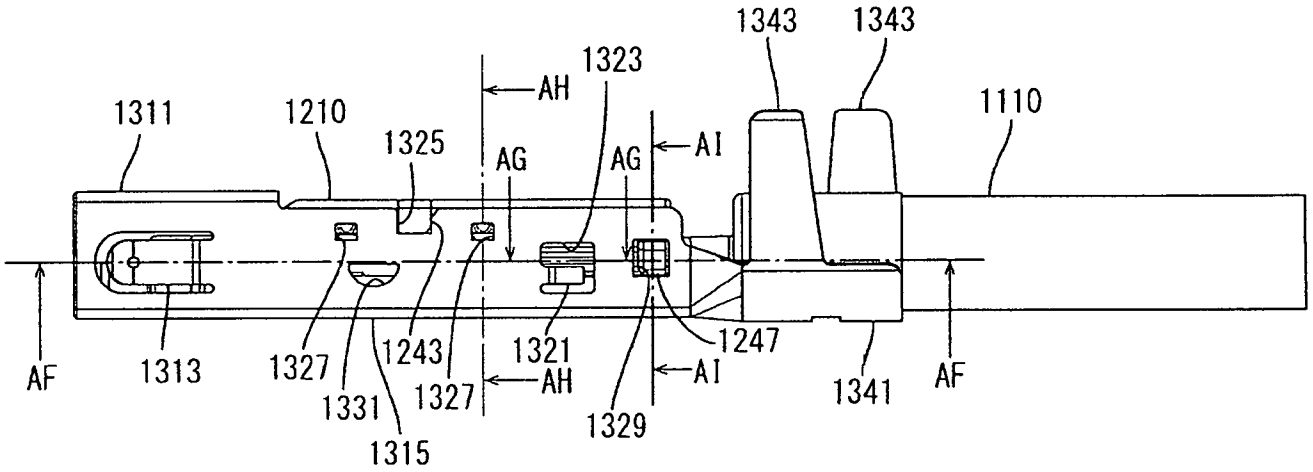
FIG. 61 is a side view in the state after the terminal holding member is assembled with the lower outer conductor shell.
Figure 62:
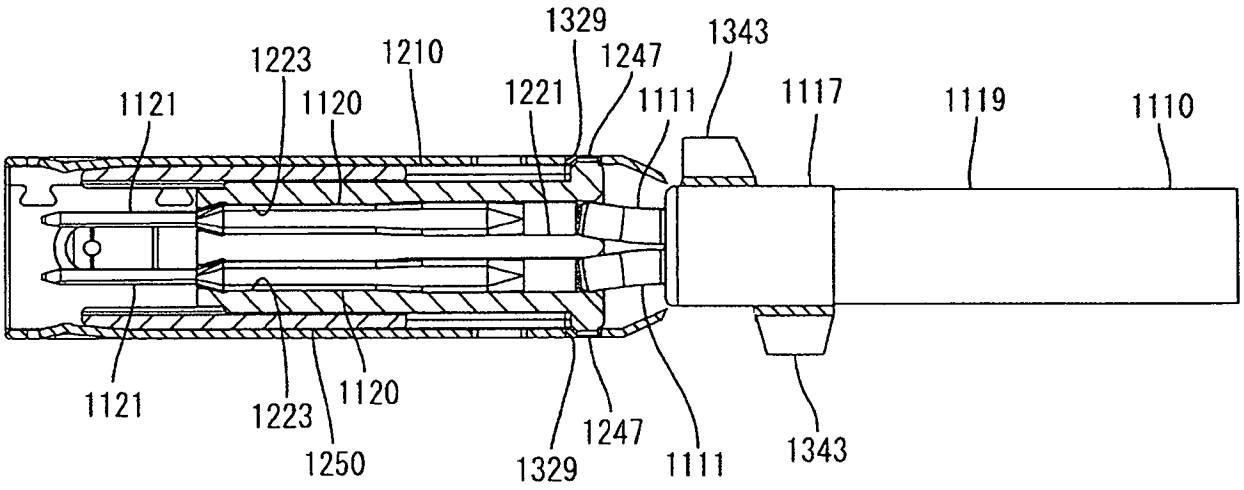
FIG. 62 is a section at position AF-AF in FIG. 61.
Figure 64:
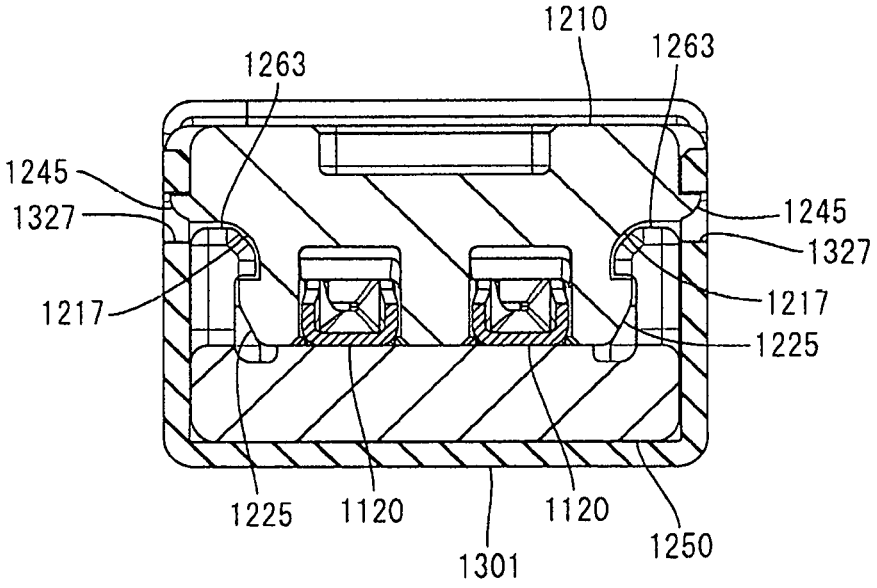
FIG. 64 is a section at position AH-AH in FIG. 61.
Figure 65:
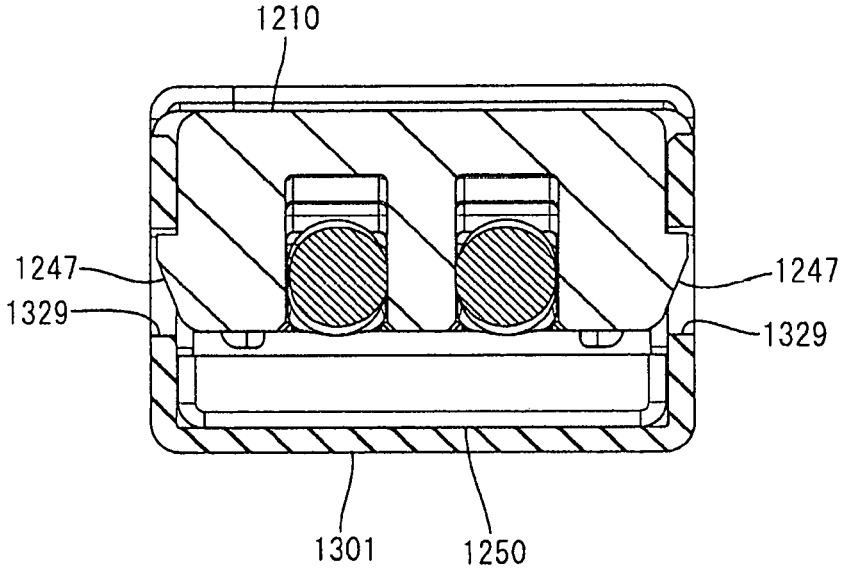
FIG. 65 is a section at position AI-AI in FIG. 61.

Further, as shown in FIGS. 55 and 61, rectangular cuts 1325 are provided by being cut dow from the upper edges of both side surfaces of the rear end part 1315 of the lower body 1310. The engaging portions 1243 of the upper terminal holding member 1210 are engaged with the cuts 1325, thereby suppressing a movement of the upper terminal holding member 1210 in the front-rear direction. Further, as shown in FIGS. 55 and 64, two small holes 1327 with which the engaging projections 1245 are to be engaged are provided in front of and behind the cut 1325 of each side surface of the rear end part 1315. Engaging the engaging projections 1245 with the small holes 1327 prevents vertical movement of the upper terminal holding member 1210. As shown in FIGS. 55 and 65, engaging holes 1329 with which the engaging claw portions 1247 are to be engaged are provided in the both side surfaces of the rear end part 1315. Engaging the engaging claws 1247 with the engaging holes 1329 prevents movements of the upper terminal holding member 1210 in the front-rear and vertical directions. Semicircular holes 1331 penetrate through the side surfaces of the rear end parts 1315 in the plate thickness direction.

As shown in FIGS. 41 and 55, the lower barrel portion 1340 includes a bottom plate 1341 continuous with the lower body 1310 and barrel pieces 1343 rising up from the bottom plate 1341. Further, the bottom plate 1341 of the lower barrel portion 1340 has an arcuate cross-section. Further, the lower barrel portion 1340 is open upward, and constitutes an opening 1309 of the lower outer conductor shell 1301, into which the terminal holding member 1200 is insertable, together with the body-side opening 1317 of the lower body 1310.

Figure 43:
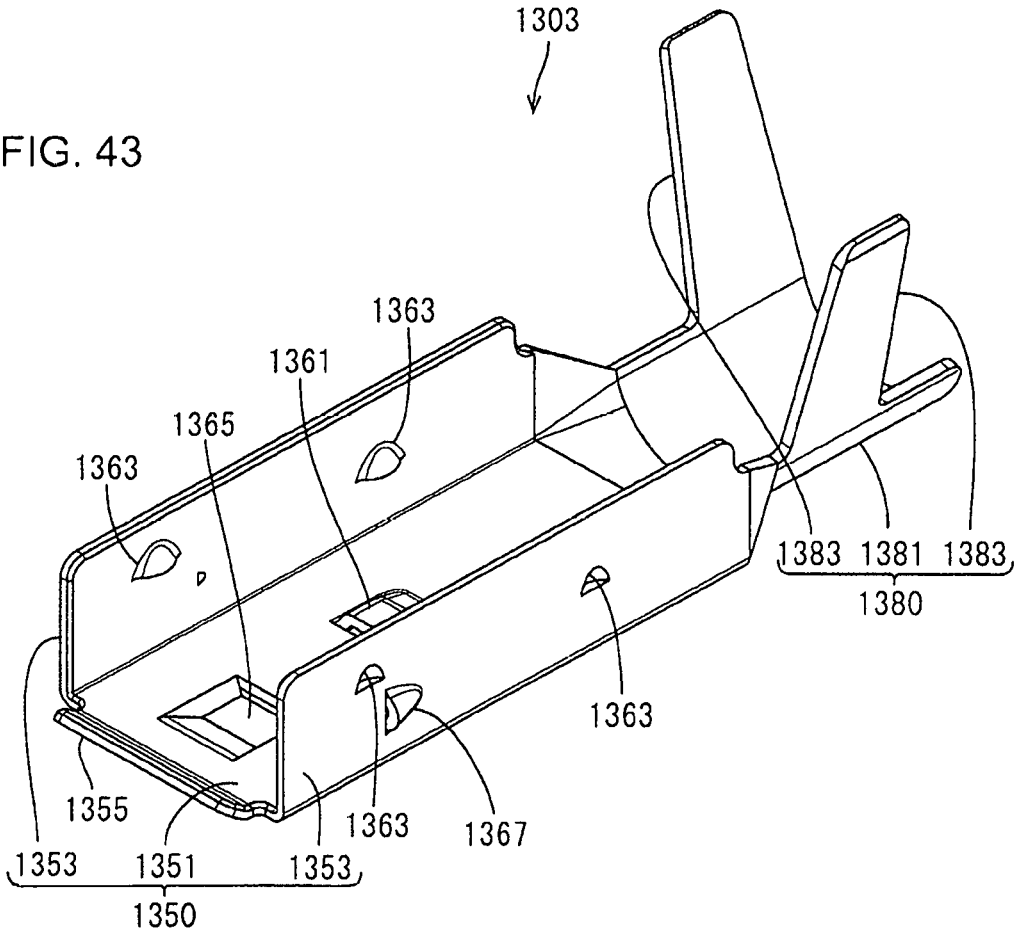
FIG. 43 is a perspective view of an upper outer conductor shell viewed from below.
Figure 44:
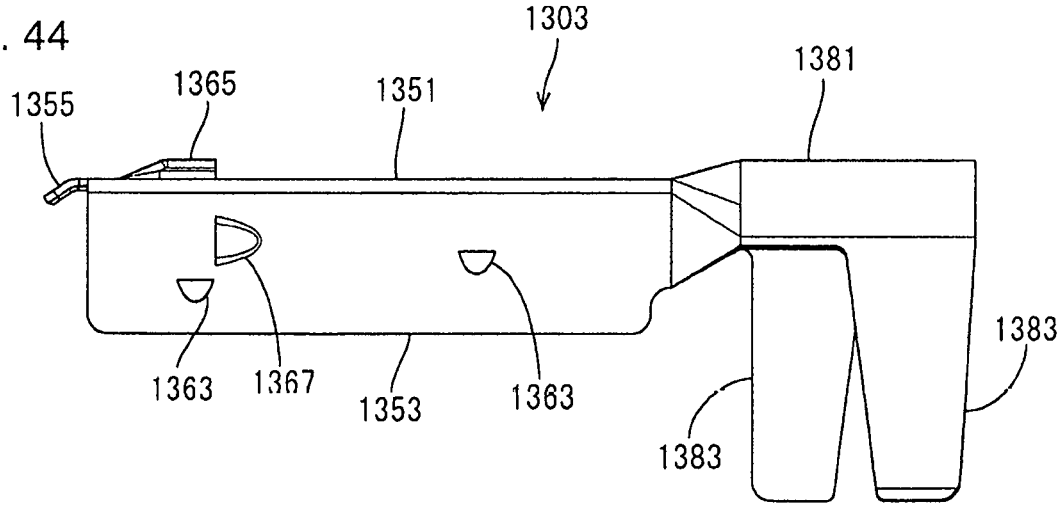
FIG. 44 is a side view of the upper outer conductor shell.
Figure 45:
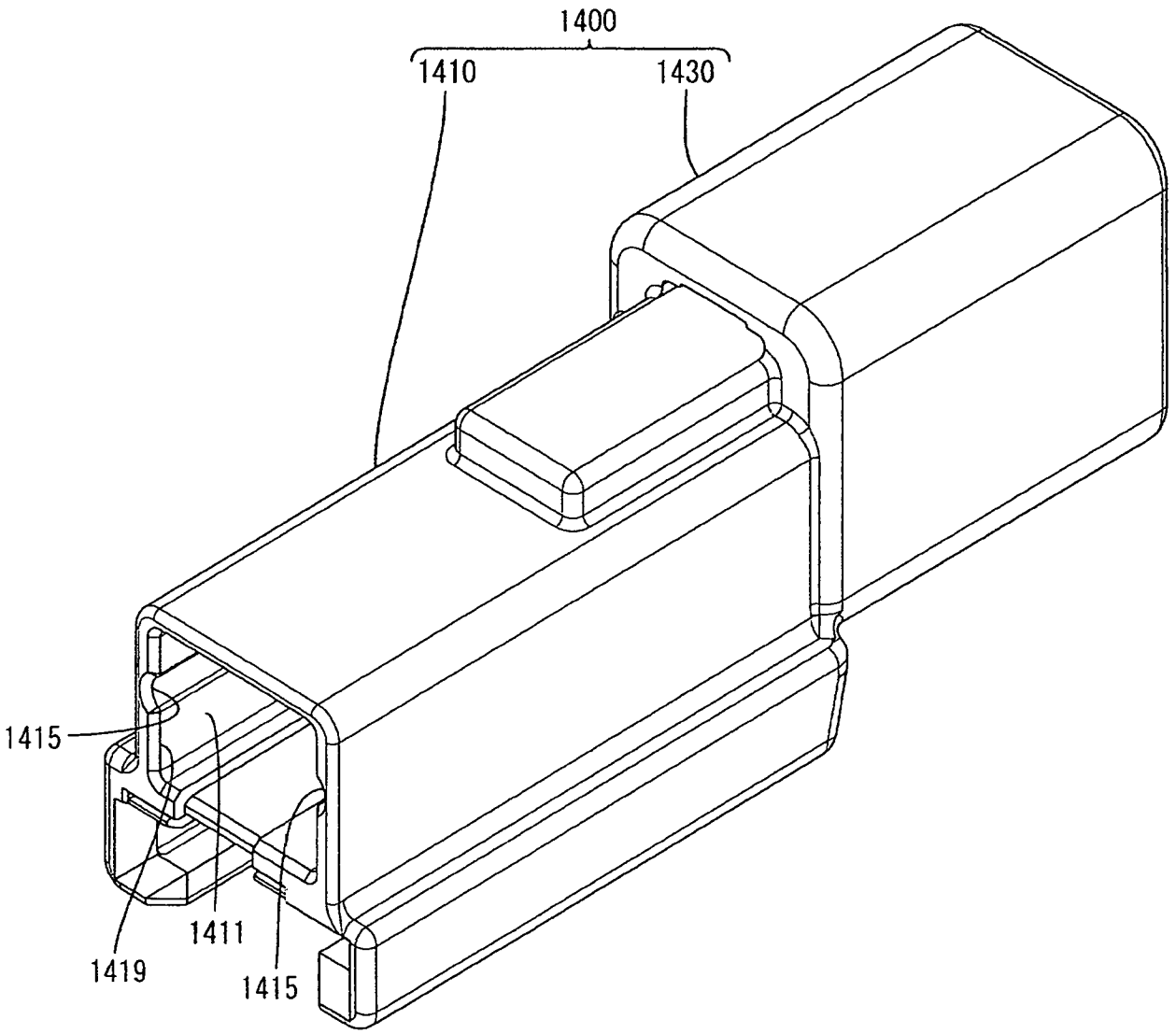
FIG. 45 is a perspective view of a connector housing viewed from an upper-rear side.
Figure 46:
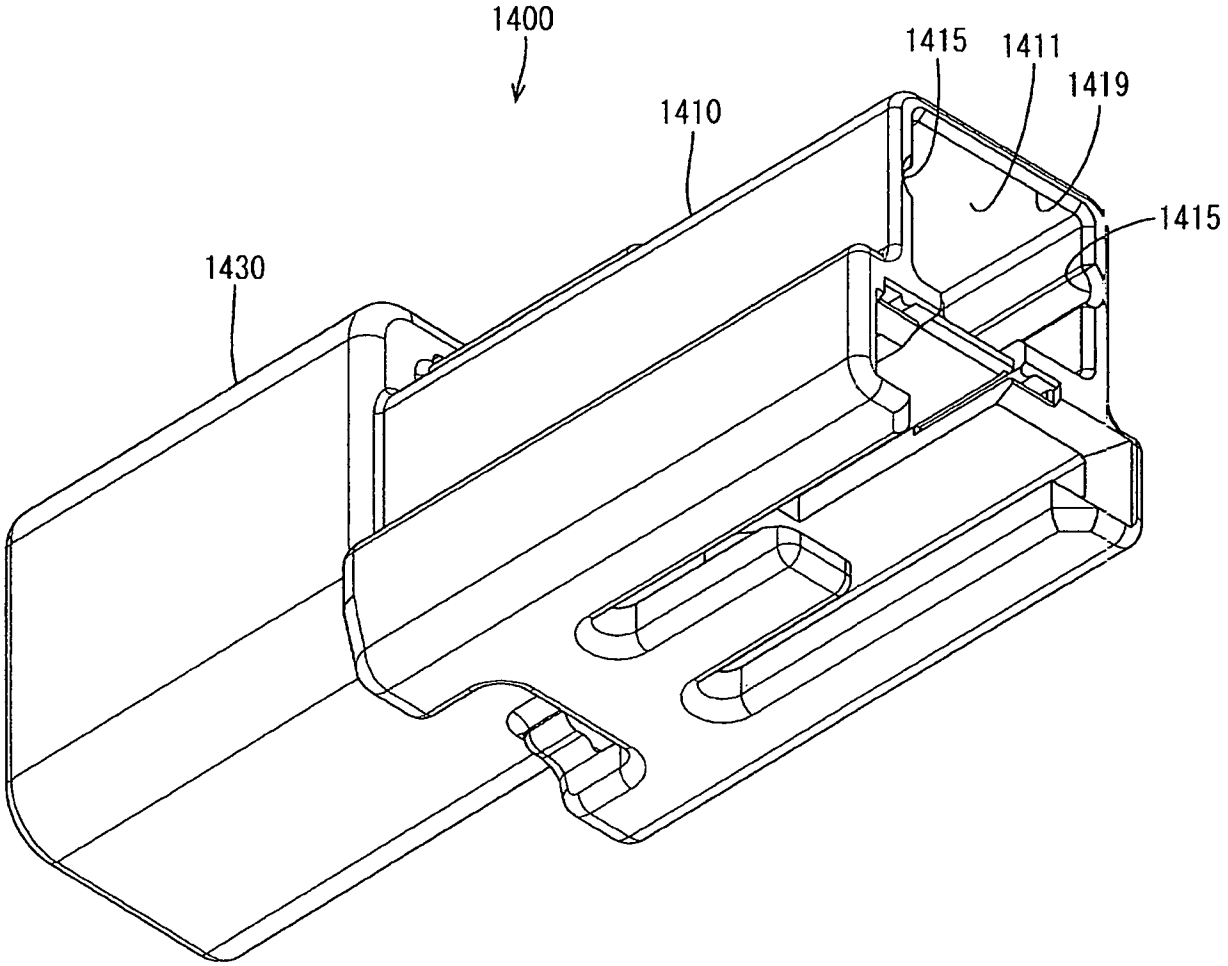
FIG. 46 is a perspective view of the connector housing viewed from a lower-rear side.

The upper outer conductor shell 1303 is formed by press-working a conductive plate material. As shown in FIGS. 43 and 66, the upper outer conductor shell 1303 includes an upper body 1350 constituting a part of the body 1305 and an upper barrel portion 1380 constituting a part of the barrel 1307. Further, the upper outer conductor shell 1303 covers the opening 1309 of the lower outer conductor shell 1301 from above.

The upper body 1350 is formed by a ceiling plate 1351 substantially parallel to the bottom plate of the lower body 1310 and two side plates 1353 bent into a substantially L shape from side ends of the ceiling plate 1351, is open in the front-rear direction and has a U-shaped cross-section. The ceiling plate 1351 of the upper body 1350 covers the body-side opening 1317 of the lower body 1310, and inner surfaces of the side plates 1353 of the upper body 1350 are in contact with outer surfaces of the side surfaces of the rear end part 1315 of the lower body 1310. That is, the side plates 1353 of the upper body 1350 overlap to cover the rear end part 1315 of the lower body 1310 from outside. Further, a struck piece 1355 extends toward a front-lower side from the front end of the ceiling plate 1351. The struck piece 1355 can cover the body-side opening 1317 without any clearance by slipping under the ceiling plate of the front part 1311 of the lower body 1310. The upper body 1350 overlaps the lower body 1310 so that the body 130 forms a rectangular tube open in the front-rear direction. Further, a dimension of the upper body 1350 excluding the struck piece 1355 in the front-rear direction is equal to that of the terminal holding member 1200 in the front-rear direction.

Figure 69:
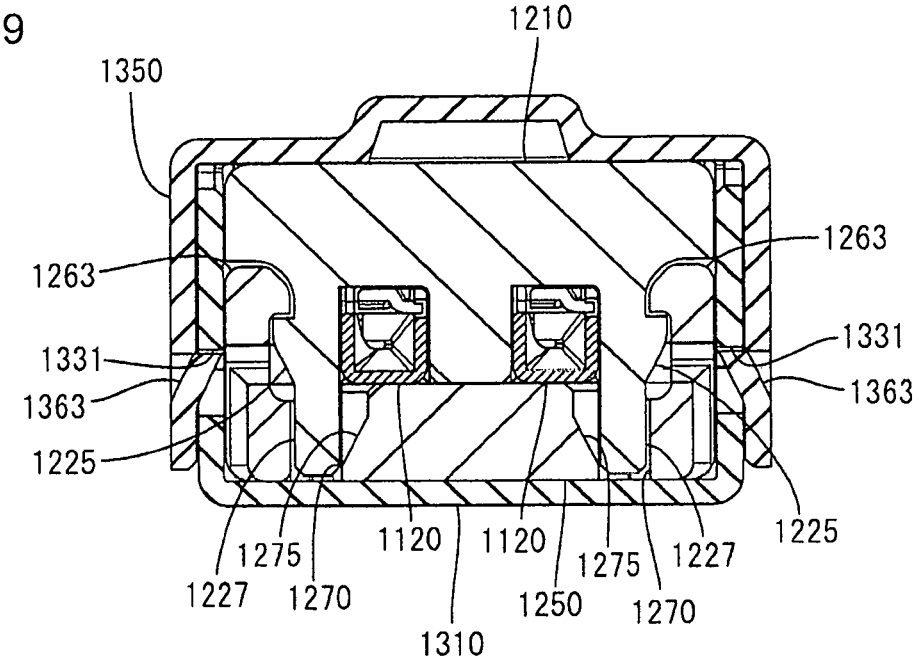
FIG. 69 is a section at position AJ-AJ in FIG. 68.
Figure 70:
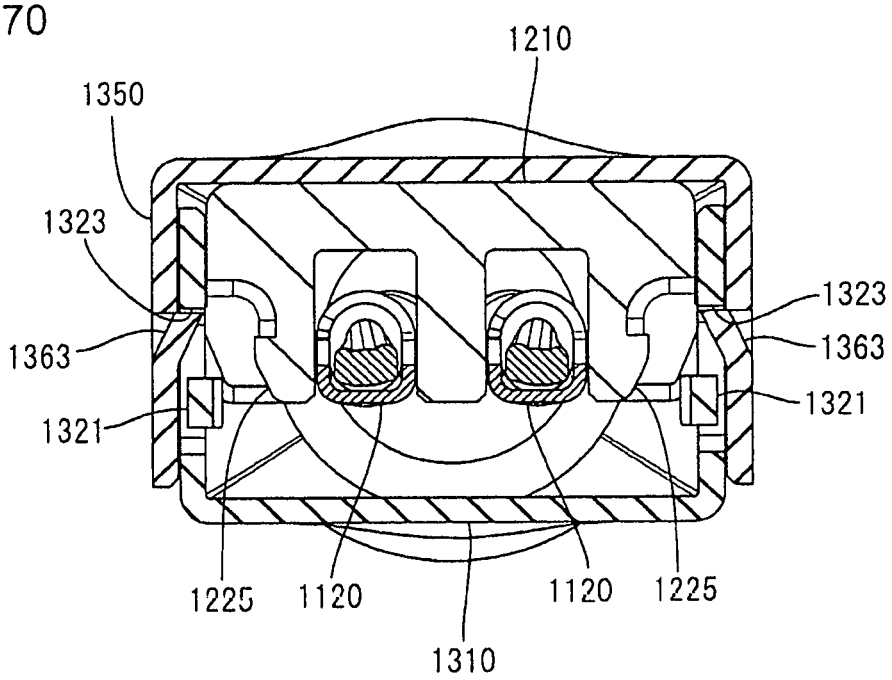
FIG. 70 is a section at position AL-AL in FIG. 68.
Figure 73:
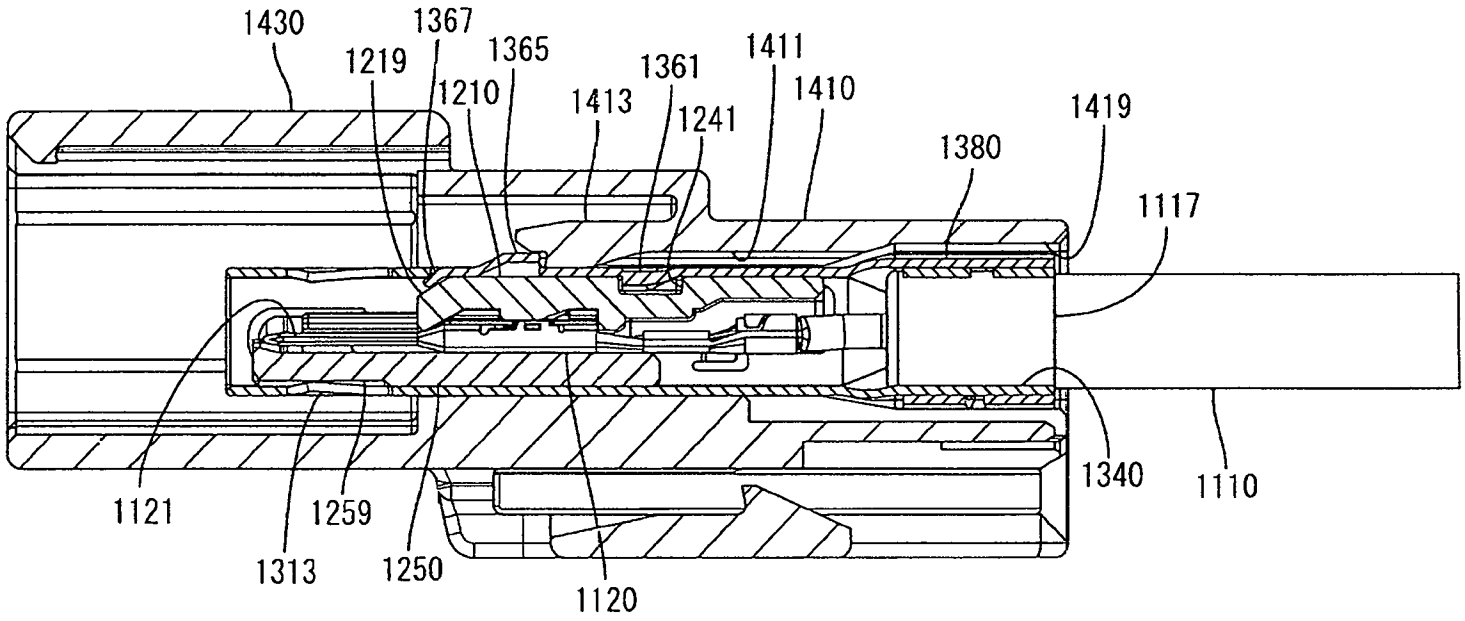
FIG. 73 is a section at position AM-AM in FIG. 72.

The ceiling plate 1351 of the upper body 1350 is struck down to provide an engaging struck portion 1361, as shown in FIGS. 66 and 73. The engaging struck portion 1361 is accommodated into the engaging recess 1241 of the upper terminal holding member 1210 and the front end of the engaging struck portion 1361 is engaged with an end surface of the engaging recess 1241, thereby suppressing a movement of the upper terminal holding member 1210 in the front-rear direction with respect to the upper outer conductor shell 1303. As shown in FIG. 66, two struck projections 1363 are formed on each side surface of the upper body 1350 by being struck inwardly to have ¼ shape of a sphere. The upper outer conductor shell 1303 is locked to the lower outer conductor shell 1301 by locking the front struck projections 1363 to upper hole edges of the semicircular holes 1331 of the lower outer conductor shell 1301, as shown in FIGS. 66 and 69, and locking the rear struck projections 1363 to upper hole edges of the cut-and-raised holes 1323, as shown in FIGS. 66 and 70.

Figure 74:
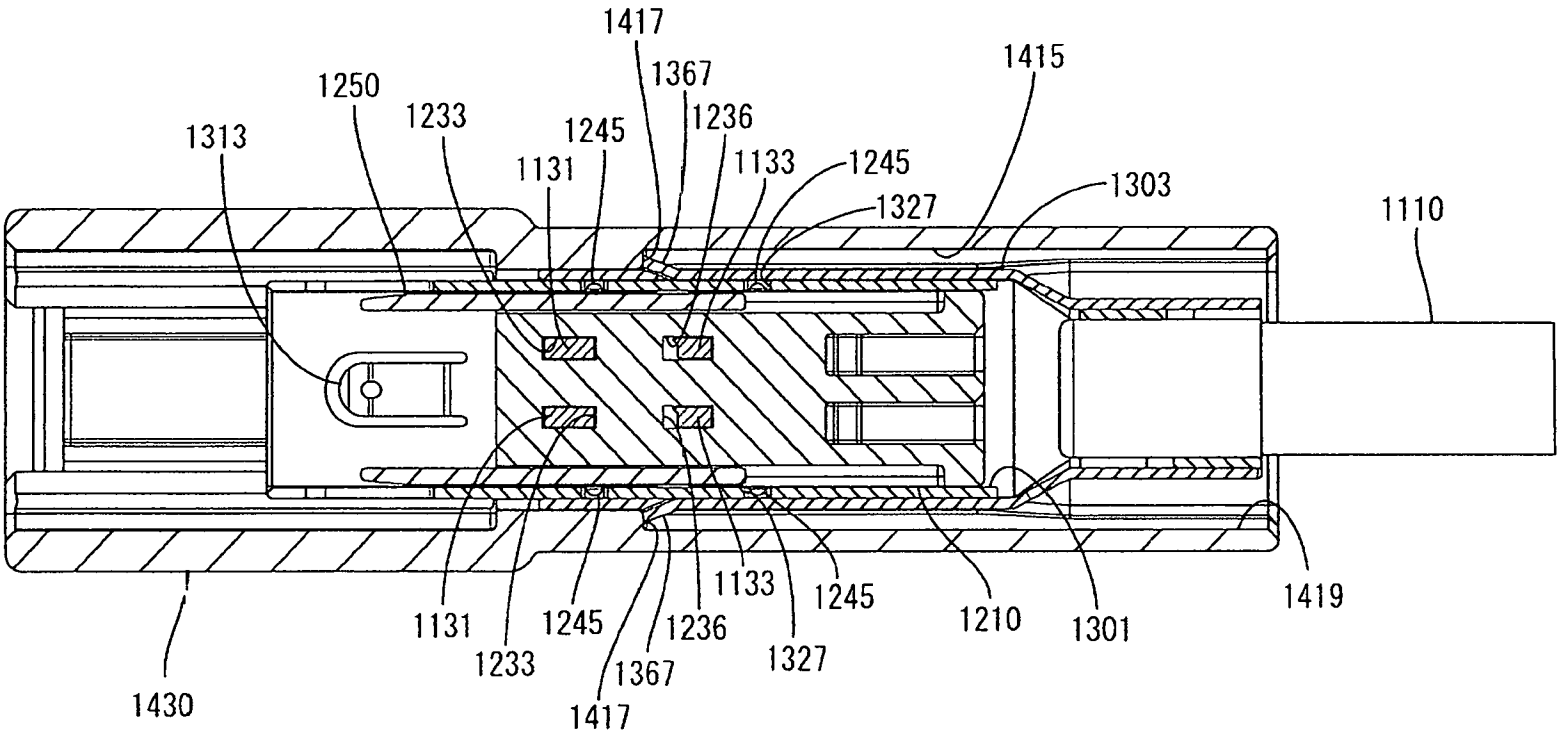
FIG. 74 is a section at position AN-AN in FIG. 72.

Further, as shown in FIGS. 66 and 73, a lance locking portion 1365 projects up on a front end part of the ceiling plate 1351 of the upper body portion 1350. The lance locking portion 1365 can fix the outer conductor shell 1300 in the connector housing 1400 by locking a locking lance 1413 of the connector housing 1400 to be described later. As shown in FIGS. 66 and 74, each side plate 1353 of the upper body 1350 is struck outwardly, thereby providing a struck portion 1367. The struck portions 1367 stop the outer conductor shell 1300 in front by planar front edges thereof contacting contact surfaces 1417 in the connector housing 1400.

As shown in FIGS. 43 and 66, the upper barrel portion 1380 includes an upper plate 1381 continuous with the upper body 1350 and barrel pieces 1383 extending down toward outer sides from the upper plate 1381. Further, the upper plate 1381 of the upper barrel portion 1380 has an arcuate cross-sectional shape. When the upper barrel portion 1380 is put to cover the lower barrel portion 1340, a hollow cylindrical shape is formed. The barrel pieces 1343, 1383 are caulked to connect the barrel portion 1307 to the shield layer 1117 of the shielded cable 1110.

Figure 72:
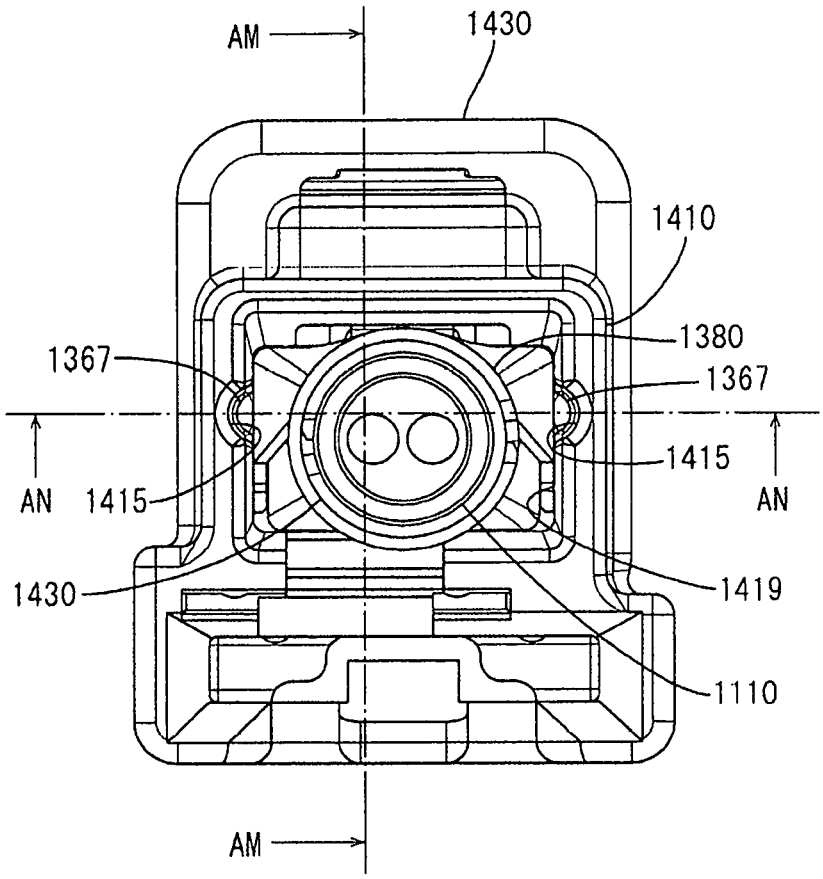
FIG. 72 is a back view in a state after the connector subassembly is assembled with the connector housing.

The connector housing 1400 is made of synthetic resin and, as shown in FIGS. 71 and 72, is in the form of a rectangular tube open in the front-rear direction. The connector housing 1400 includes a connector body 1410 for accommodating the connector subassembly S2 and a receptacle 1430 to be fit externally to a mating connector. As shown in FIGS. 73 and 74, the front part 1311 of the lower outer conductor shell 1301 is disposed in the receptacle 1430.

Figure 47:
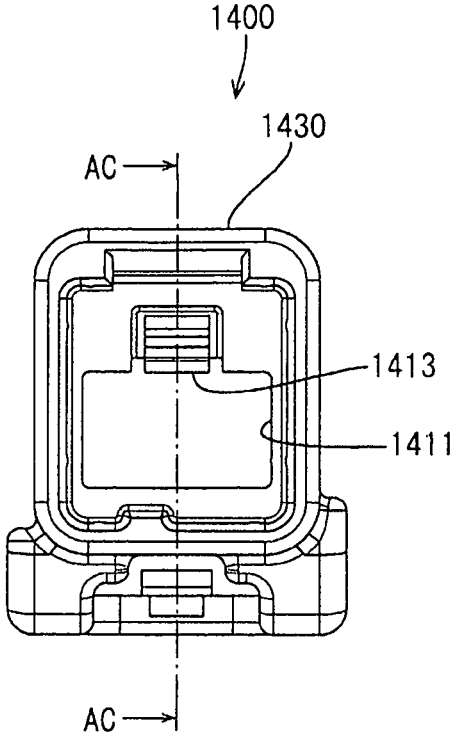
FIG. 47 is a front view of the connector housing.
Figure 48:
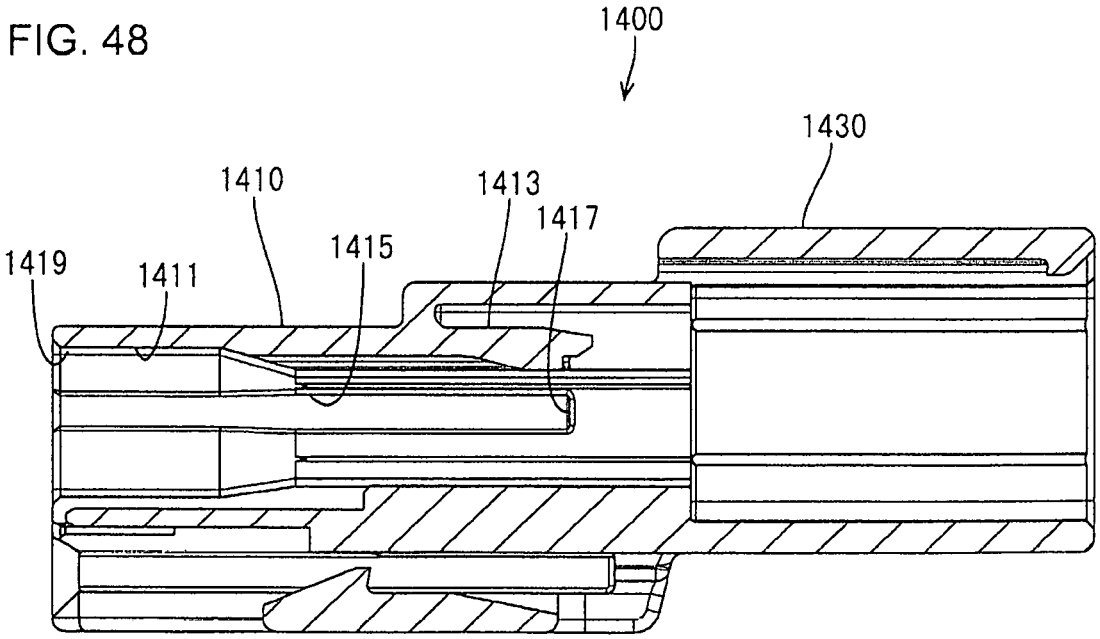
FIG. 48 is a section at position AC-AC in FIG. 47.

As shown in FIGS. 47 and 74, a cavity 1411 for accommodating the connector subassembly S2 penetrates the connector body 1410 in the front-rear direction. The cavity 1411 communicates with the receptacle 1430 and is shaped in conformity with the outer shape of the connector subassembly S2. A locking lance 1413 is provided on an upper wall of the cavity 1411 to be resiliently deformable in the vertical direction. Further, semicircular insertion grooves 1415 extend forward from an insertion opening 1419 on a rear end on side walls of the cavity 1411 and receive the struck portions 1367 of the upper outer conductor shell 1303. Front end parts of the insertion grooves 1415 serve as the contact surfaces 1417 with which the struck portions 1367 come into contact. Note that a rear end opening of the cavity 1411 serves as the insertion opening 1419 through which the connector subassembly S2 is insertable forward (extending direction of the terminals 1120) from a rear end.

Next, an example of an assembling procedure of the connector C2 is described.

First, as shown in FIGS. 34 and 35, the insulation coating 1119 of the shielded cable 1110 is stripped to expose the ends of the signal wires 1111 and the shield layer 1117 is folded onto the outer periphery of the insulation coating. Then, the signal wires 1111 are connected to the terminals 1120. Specifically, the wire barrels 1125 of the crimping portions 1123 are crimped to the inner conductors 1113 of the signal wires 1111 and the insulation barrels 1127 of the crimping portions 1123 are caulked to the inner insulation coatings 1115 of the signal wires 1111.

Subsequently, as shown in FIG. 35, the terminals 1120 connected to the signal wires 1111 of the shielded cable 1110 are accommodated into the upper terminal holding member 1210 from below so that each terminal 1120 is accommodated into each accommodation recess 1223. In the case of accommodating the first terminal 1120 into the downwardly open accommodation recesses 1223 in this way, the second terminal 1120 merely is retracted outwardly of one accommodation recess 1223 when accommodating first terminal 1120 into the corresponding one accommodation recess 1223. Thus, a stripping dimension of the shield layer 1117 may be short as compared to the case where the terminals 1120 are accommodated in the extending direction of the terminals 1120. Therefore, there is less influence of noise.

Figure 49:
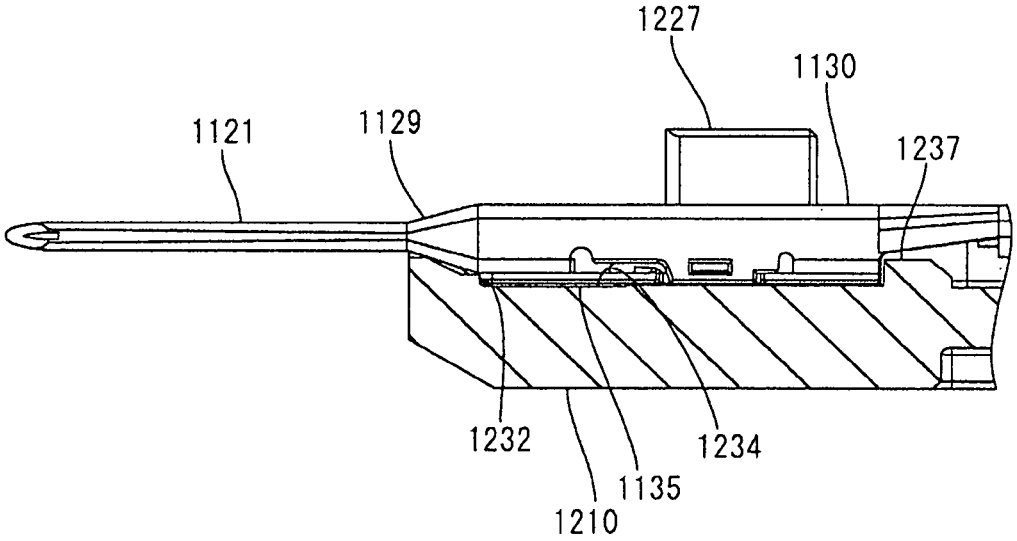
FIG. 49 is a view partly in section in a state where a terminal is held in an upper terminal holding member.

When the terminal 1120 is disposed at a predetermined position of the upper terminal holding member 1210, the terminal locked portion 1130 is locked by the terminal locking portion 1230, as shown in FIGS. 49 and 50. Thus, the terminal 1120 is held not to move with respect to the upper terminal holding member 1210. Specifically, the tapered portion 1129 of the terminal 1120 is disposed on the tapered surface 1231 of the terminal locking portion 1230, the front projection 1131 of the terminal locked portion 1130 is accommodated into the first accommodating portion 1233, and the rear end of the front projection 1131 is locked to the first projecting portion 1235. Simultaneously, the rear projection 1133 is accommodated into the third accommodating portion 1236 and the rear end of the rear projection 1133 and the rear end of the terminal locked portion 1130 are locked to the second projecting portion 1237. Further, the front end of the front stop 1125 of the terminal 1120 contacts the front stop wall 1232 of the upper terminal holding member 1210. Then, the front stop 1135 is accommodated into the second accommodating portion 1134. Note that, at this time, the electrically connecting portion 1121 of the terminal 1120 is held in a state projecting from the front end of the upper terminal holding member 1210.

Figure 53:
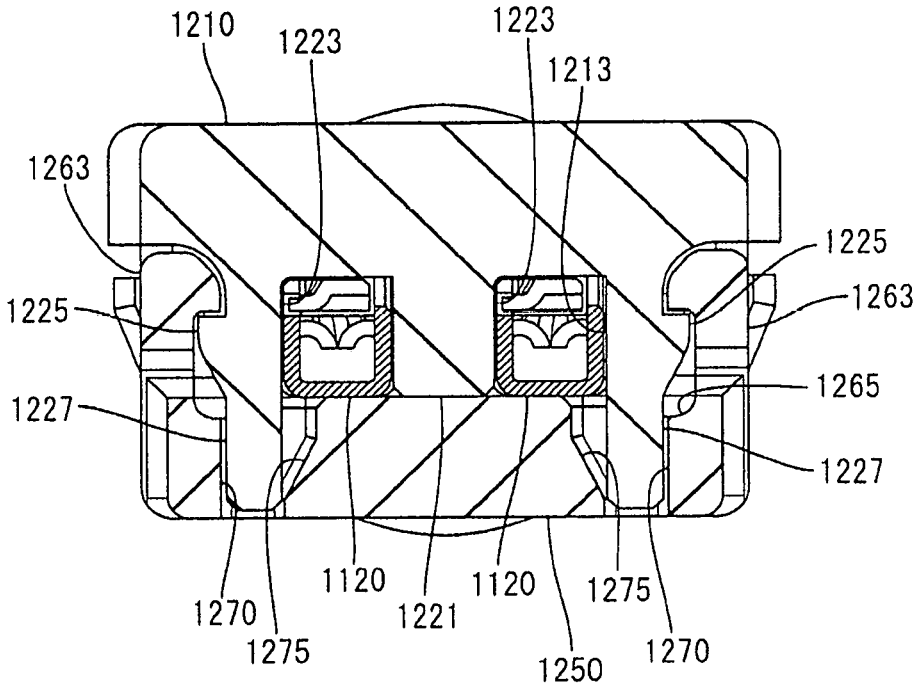
FIG. 53 is a section at position AD-AD in FIG. 52.

Then, as shown in FIG. 50, the upper terminal holding member 1210 having the terminals 1120 accommodated therein is assembled with the lower terminal holding member 1250. Specifically, the lower terminal holding member 1250 is inserted from below the upper terminal holding member 1210. By deforming the rails 1263 outward while the guides 1225 of the upper terminal holding member 1210 are deformed inward, the guides 1225 and the rails 1263 are made slidable by moving over each other. As shown in FIG. 53, the rounded surfaces 1217 of the upper terminal holding member 1210 conform to the rounded shape of upper sides of the rails 1263 and the lower end surfaces of the rails 1263 and the upper surfaces of the guides 1225 are fit to slide on each other. Thus, the upper terminal holding member 1210 and the lower terminal holding member 1250 are not relatively movable in the vertical direction, but are relatively movable in the front-rear direction.

Figure 52:
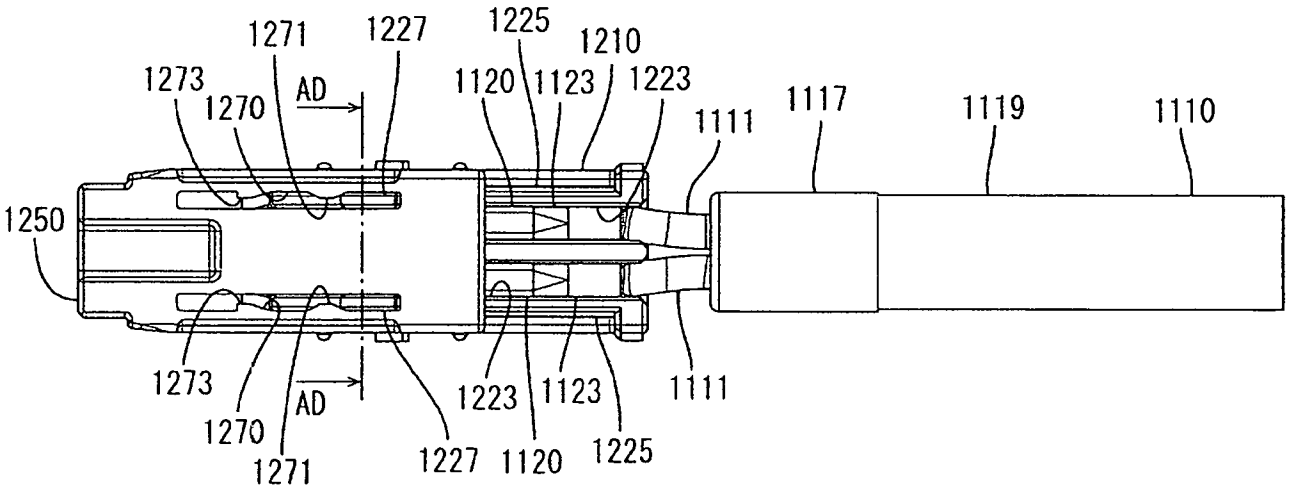
FIG. 52 is a plan view in the state after the lower terminal holding member is assembled with the upper terminal holding member.

Further, as shown in FIGS. 52 and 53, the locking plates 1227 are guided by the guide grooves 1275 of the lower terminal holding member 1250, fit into the rear end parts of the penetrating rails 1270 and locked to the partial locking projections 1271. At a terminal tip protection position where the locking plates 1227 are locked to the partial locking projections 1271, the electrically connecting portions 1121, which are tip parts of the terminals 1120, projecting from the upper terminal holding member 1210 are held in a state covered by the lower terminal holding member 1250, as shown in FIG. 54. Further, tip parts of the electrically connecting portions 1121 are disposed in the lower insertion grooves 1257 of the lower front wall 1253. On the other hand, the crimping portions 1123 of the terminals 1120 are exposed without being covered by the lower terminal holding member 1250.

Figure 56:
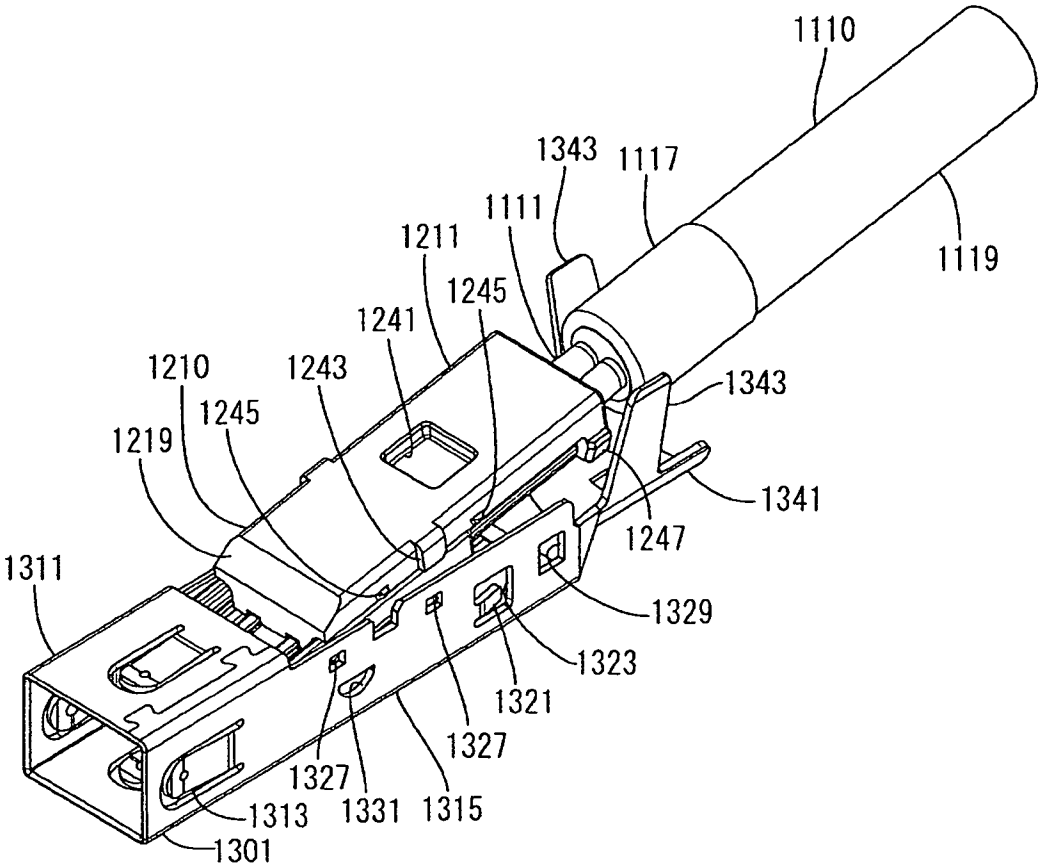
FIG. 56 is a perspective view in a state while the terminal holding member is being assembled with the lower outer conductor shell.
Figure 57:
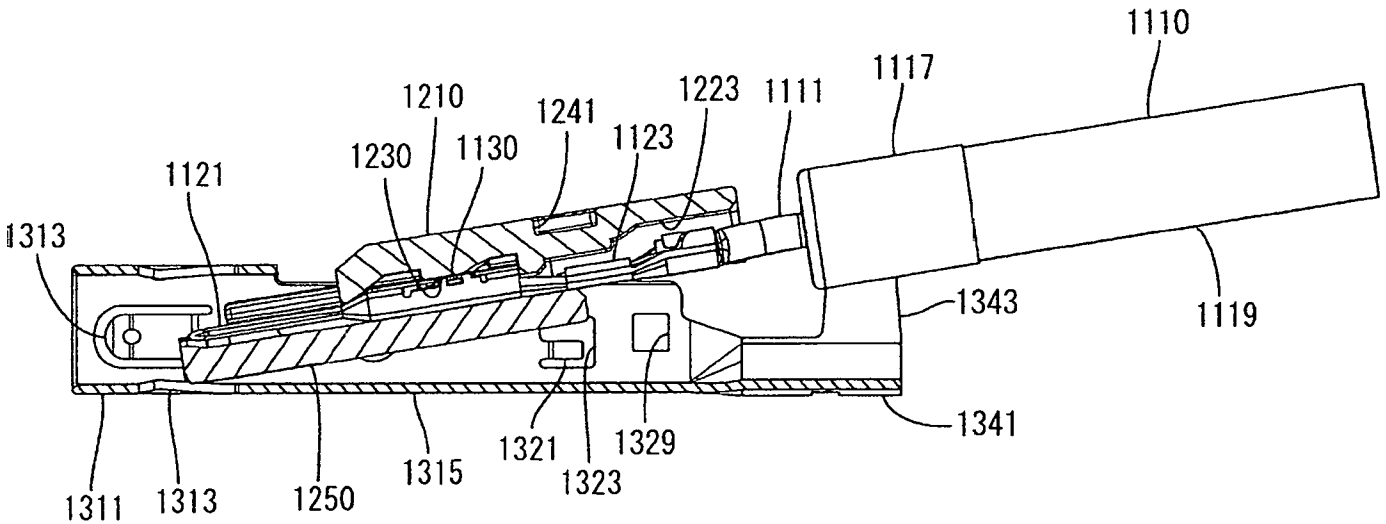
FIG. 57 is a section in the state while the terminal holding member is being assembled with the lower outer conductor shell.
Figure 58:
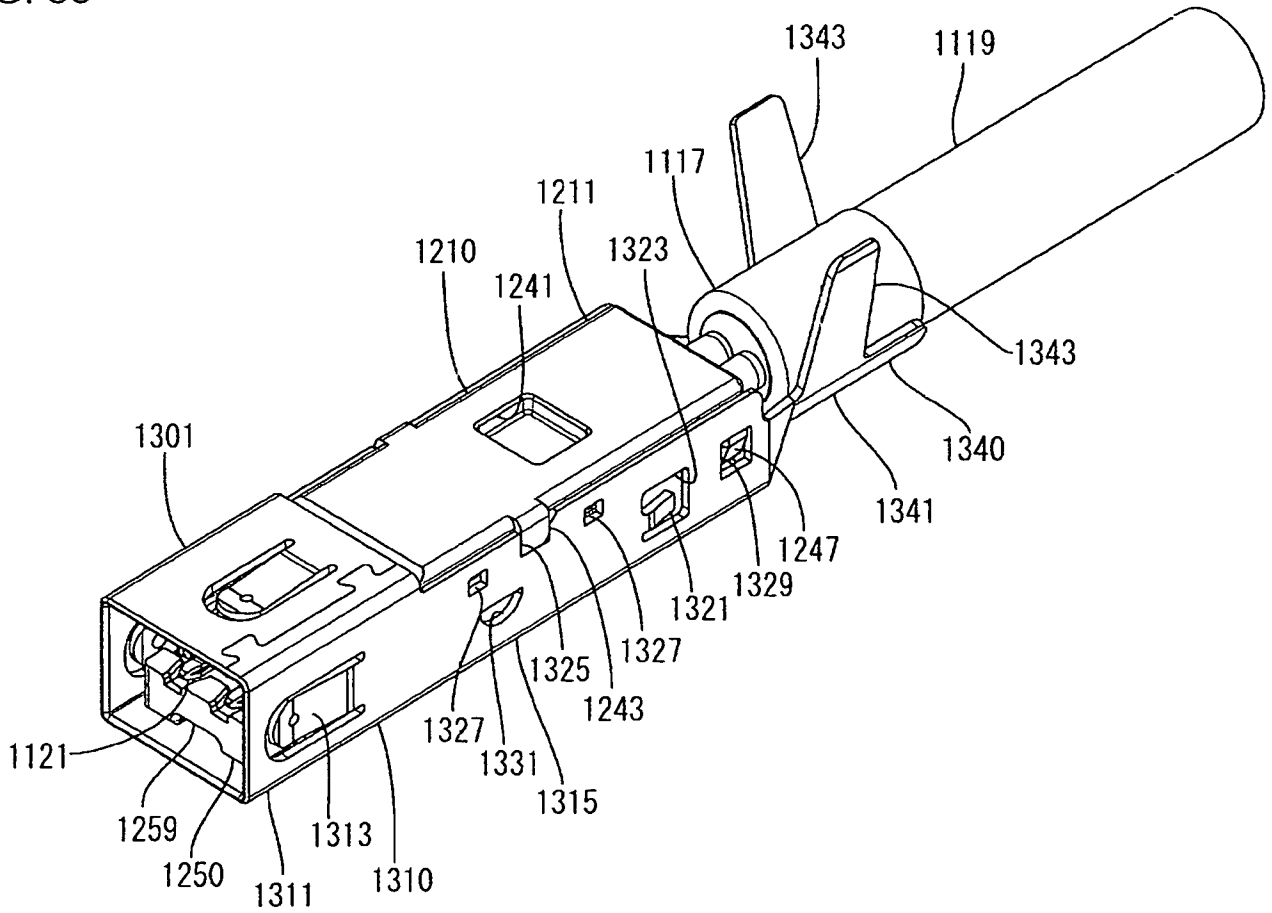
FIG. 58 is a perspective view in a state after the terminal holding member is assembled with the lower outer conductor shell.

Subsequently, as shown in FIGS. 55 to 57, the terminal holding member 1200 is accommodated into the lower outer conductor shell 1301. The terminal holding member 1200 is inserted into the opening 1309 of the lower outer conductor shell 1301 from above in an oblique posture with the front end of the terminal holding member 1200 on a lower side. Then, the terminal holding member 1200 is accommodated so that the electrically connecting portions 1121 of the terminals 1120 are disposed in the front part 1131 of the lower outer conductor shell 1301 in the oblique posture. At this time, the opening 1309 of the lower outer conductor shell 1301 is larger than the terminal holding member 1200 at the terminal tip protection position. Thus, the terminal holding member 1200 easily can be accommodated into the lower outer conductor shell 1301. Since the upper terminal holding member 1210 is provided with the inclined surface 1219, there is no possibility that the upper terminal holding member 1210 is caught by the rear end edge of the front end part 1311. Further, the electrically connecting portions 1121, which are the tip parts of the terminals 1120, are covered by the lower terminal holding member 1250. Therefore, even in the oblique posture, the electrically connecting portions 1121 are not deformed by contacting the lower outer conductor shell 1301.

As shown in FIGS. 58 to 65, the engaging portions 1243 of the upper terminal holding member 1210 engage the cuts 1325 with the terminal holding member 1200 accommodated in the lower outer conductor shell 1301, thereby suppressing a movement of the upper terminal holding member 1210 in the front-rear direction. Further, the engaging projections 1245 are engaged with the small holes 1327 to suppress a movement of the upper terminal holding member 1210 in the vertical direction. The engaging claws 1247 engage the engaging holes 1329 to suppress movements of the upper terminal holding member 1210 in the front-rear and vertical directions. Note that since the lower terminal holding member 1250 is provided with the escaping groove 1259, there is no possibility that the spring 1313 of the front part 1311 contacts the lower terminal holding member 1250.

Then, as shown in FIG. 66, the upper outer conductor shell 1303 is mounted from above to cover the opening 1309 of the lower outer conductor shell 1301 after the barrel pieces 1343 of the lower barrel portion 1340 are caulked to the shield layer 1117 of the shielded cable 1110. The upper outer conductor shell 1303 is assembled by causing the struck piece 1355 of the upper body 1350 to slip under the front end part 1311 of the lower body 1310 and causing the side plates 1353 of the upper body 1350 to cover the side surfaces of the lower body 1310 from outside. Note that since the inclined surface 1219 is provided on the front part of the upper terminal holding member 1210, there is no possibility that the struck piece 1355 interferes with the upper terminal holding member 1210 when entering.

Then, as shown in FIGS. 66 to 70 and 73, the engaging struck portion 1361 is accommodated into the engaging recess 1241 of the upper terminal holding member 1210 and the front end of the engaging struck portion 1361 is engaged with the end surface of the engaging recess 1241, thereby suppressing a movement of the upper terminal holding member 1210 with respect to the upper outer conductor shell 1303 in the front-rear direction. As just described, the upper terminal holding member 1210 is locked to the upper outer conductor shell 1303 and the lower outer conductor shell 1301 to prevent a relative movement thereof with respect to the outer conductor shell 1300. Further, the upper outer conductor shell 1303 is locked to the lower outer conductor shell 1301 by locking the front struck projections 1363 of the upper body 1350 to the upper hole edges of the semicircular holes 1331 of the lower outer conductor shell 1301 and locking the rear struck projections 1363 to the upper hole edges of the cut-and-raised holes 1323.

On the other hand, the upper barrel 1380 is put on the lower barrel 1340 so that the hollow cylindrical barrel 1307 covers the shield layer 1117. Then, as shown in FIG. 67, the upper barrel 1380 also is connected to the shield layer 1117 via the lower barrel portion 1340 by caulking the barrel pieces 1383 of the upper barrel portion 1380. Then, the upper barrel portion 1380 and the lower barrel portion 1340 also are fixed.

Further, since the opening 1309 of the lower outer conductor shell 1301 can be covered by the upper outer conductor shell 1303 and the upper outer conductor shell 1303 has no significant through hole and any opening, frequency characteristic deterioration can be suppressed by entirely covering the opening 1309 by the upper outer conductor shell 1303 and the lower outer conductor shell 1301 even if the opening 1309 through which the terminal holding member 1200 is insertable is provided.

Then, as shown in FIGS. 71 to 73, the assembled connector subassembly S2 is mounted into the connector housing 1400. The connector subassembly S2 is inserted through the insertion opening 1419 of the cavity 1411 and pushed forward. At this time, the struck portions 1367 are inserted into the insertion grooves 1415, thereby restricting the inclination of the connector subassembly S2 in the connector housing 1400. When the struck portions 1367 come into contact with the contact surfaces 1417 to stop forward insertion, the locking lance 1413 of the connector housing 1400 is locked to the lance locking portion 1365 and the connector subassembly S2 is locked to the connector housing 1400.

Figure 75:
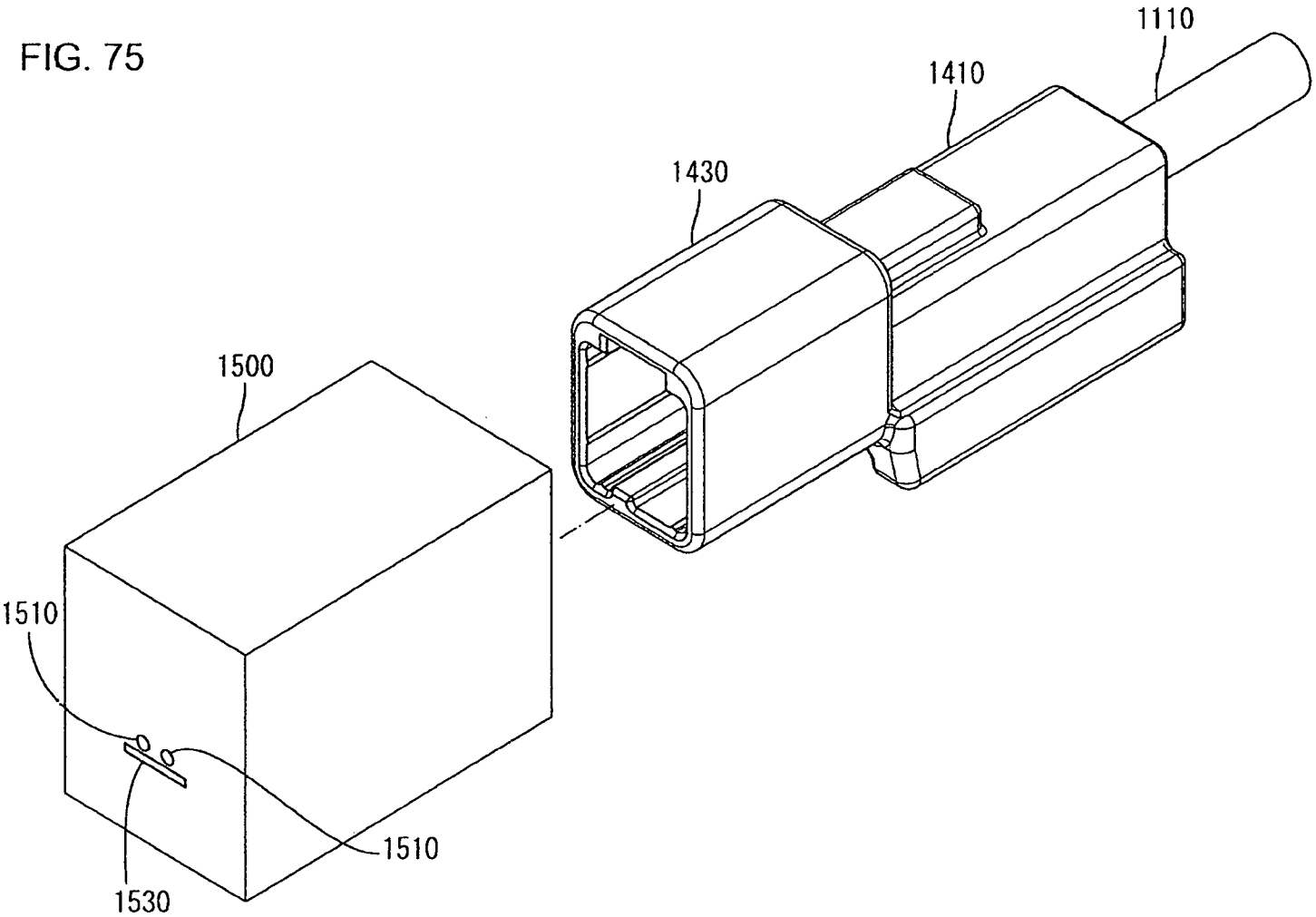
FIG. 75 is a perspective view in a state before a connector is set in a tool.
Figure 76:
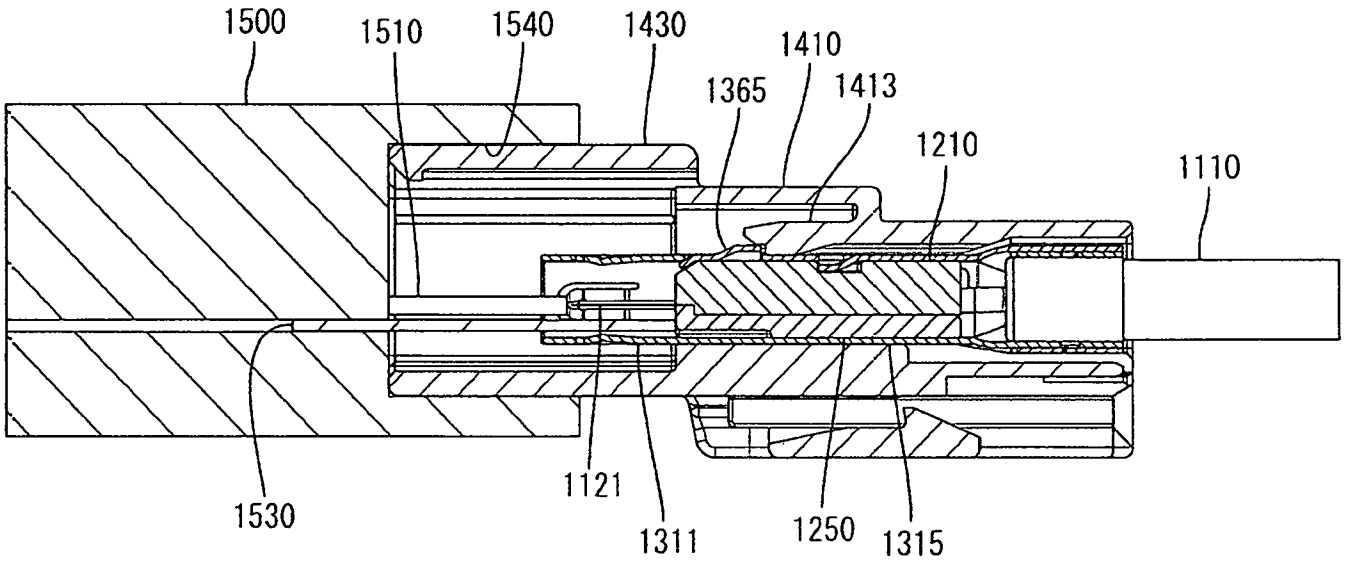
FIG. 76 is a section in a state where the connector is set in the tool.

Then, as shown in FIGS. 75 and 76, the lower terminal holding member 1250 is pushed rearward, and a tool 1500 is fit to the receptacle 1430 of the connector housing 1400 from the front. The tool 1500 includes terminal protecting portions 1510 for protecting the tip parts of the terminals 1120, a pushing portion 1530 in the form of a flat plate and a tool receptacle 1540 externally fittable to the receptacle 1430. The pushing portion 1530 is pushed rearward with the receptacle 1430 fit in the tool receptacle 1540 and the tips of the terminals 1120 butting against the terminal protecting portions 1510. Then, the pushing portion 1530 contacts the front surface of the lower terminal holding member 1250 and the lower terminal holding member 1250 is pushed rearward while the guides 1225 of the upper terminal holding member 1210 and the rails 1263 of the lower terminal holding member 1250 are sliding on each other.

Figure 78:
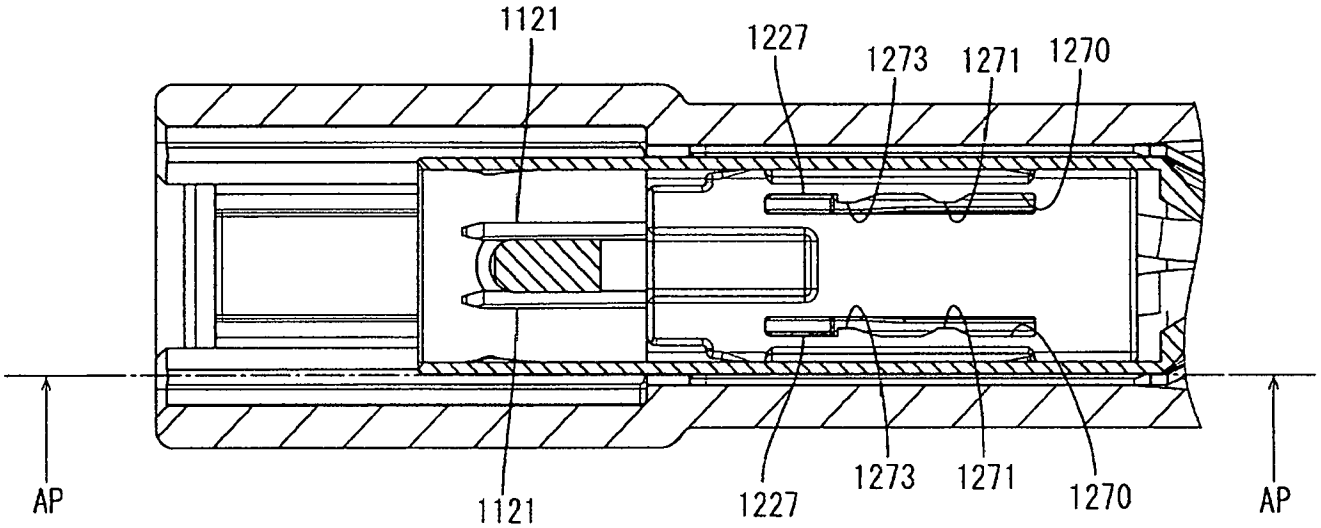
FIG. 78 is a section at position AO-AO in FIG. 77.
Figure 79:
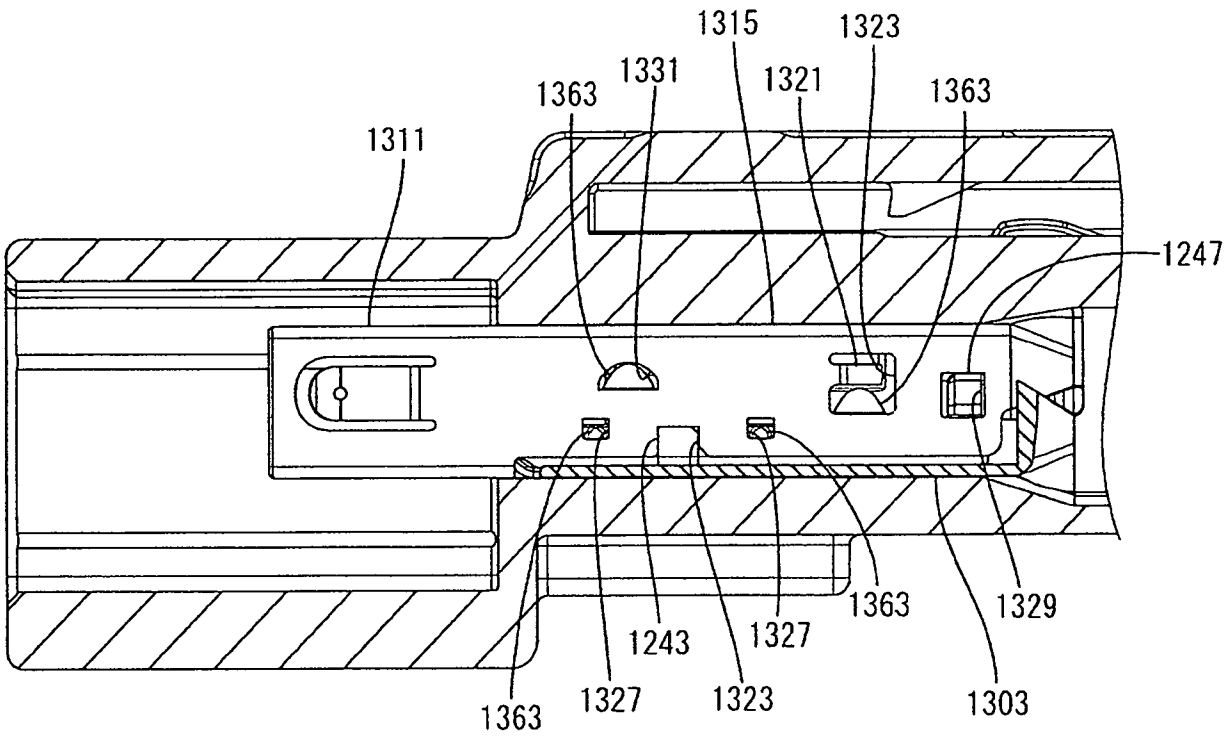
FIG. 79 is a section at position AP-AP in FIG. 78.
Figure 80:
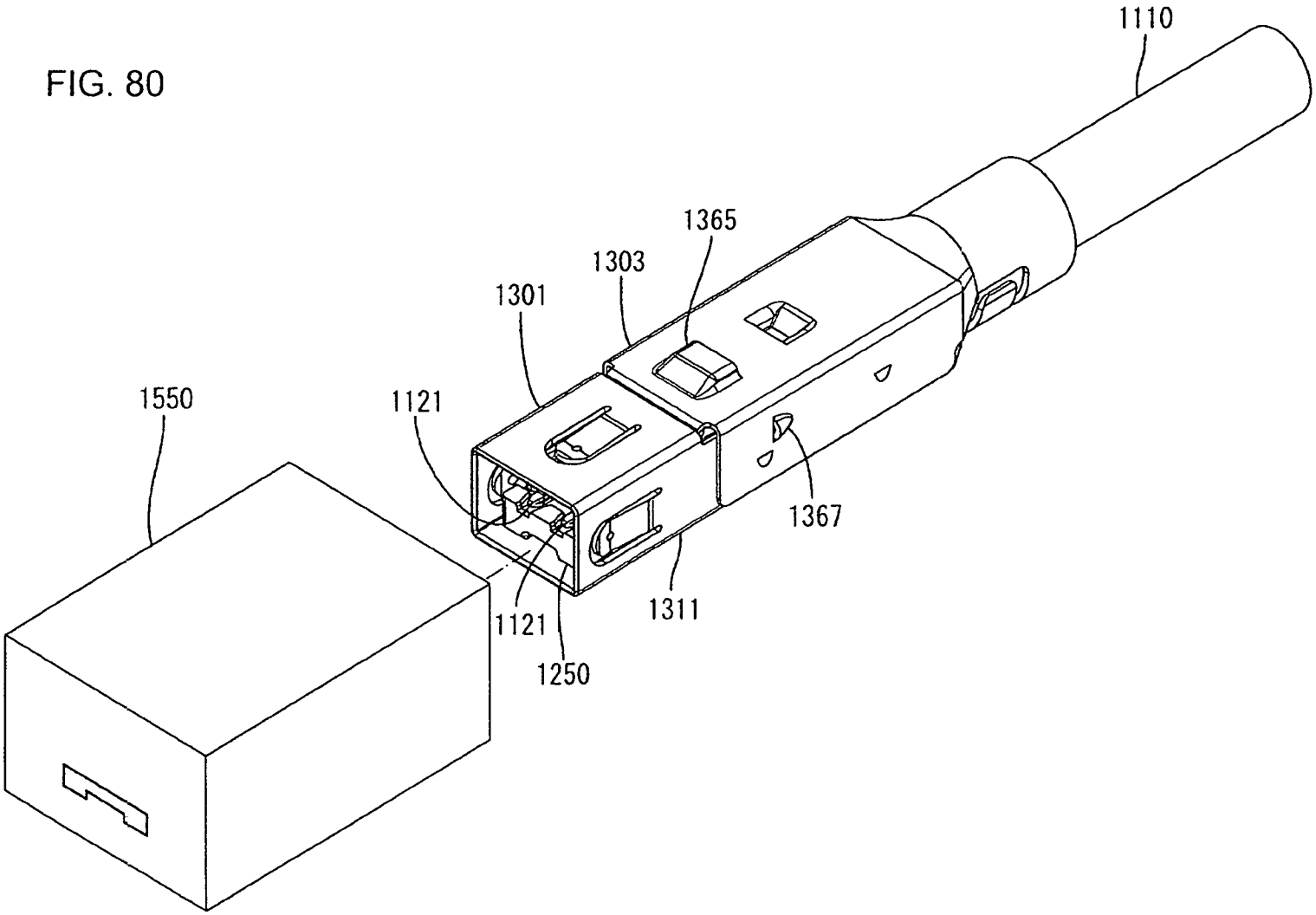
FIG. 80 is a perspective view in a state before the connector subassembly is set in a tool.
Figure 81:
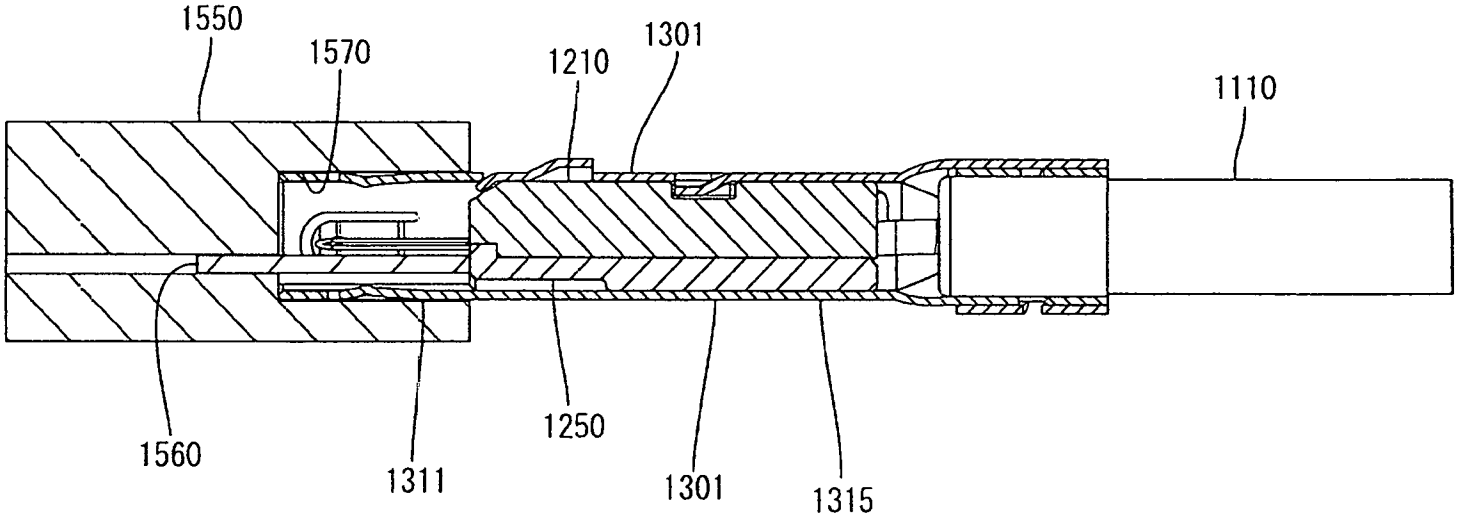
FIG. 81 is a section in a state where the connector subassembly is set in the tool.
Figure 82:
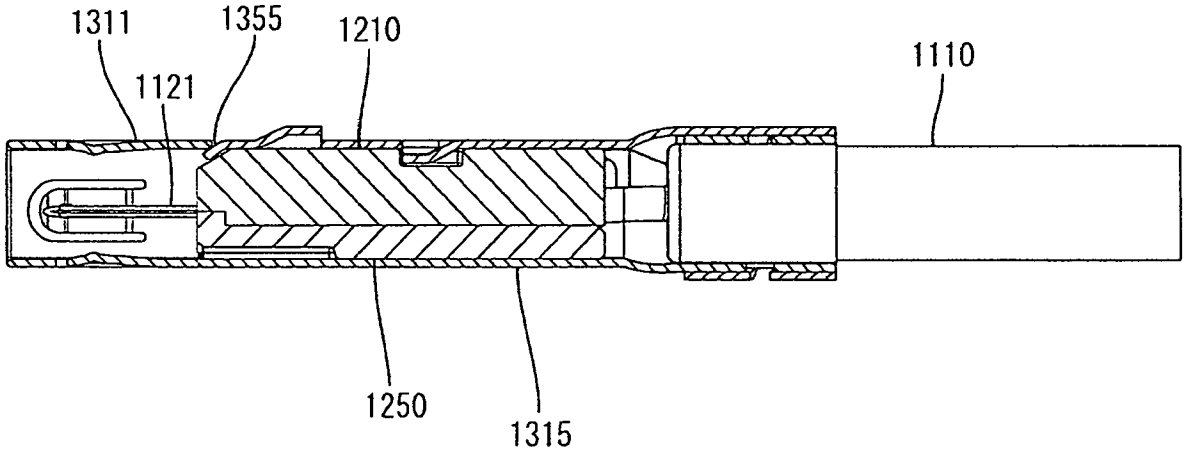
FIG. 82 is a section in a state where the connector subassembly is detached from the tool.

When the lower terminal holding member 1250 is pushed rearward, the locking plates 1227 of the upper terminal holding member 1210 move relatively forward by moving over the partial locking projections 1271 of the penetrating rails 1270 of the lower terminal holding member 1250, as shown in FIG. 78. When the lower terminal holding member 1250 is pushed farther rearward, the locking plates 1227 move over the full locking projections 1273. The lower terminal holding member 1250 cannot be moved farther rearward and the pushing is stopped when the locking plates 1227 contact the front positions of the penetrating rail portions 1270.

Figure 77:
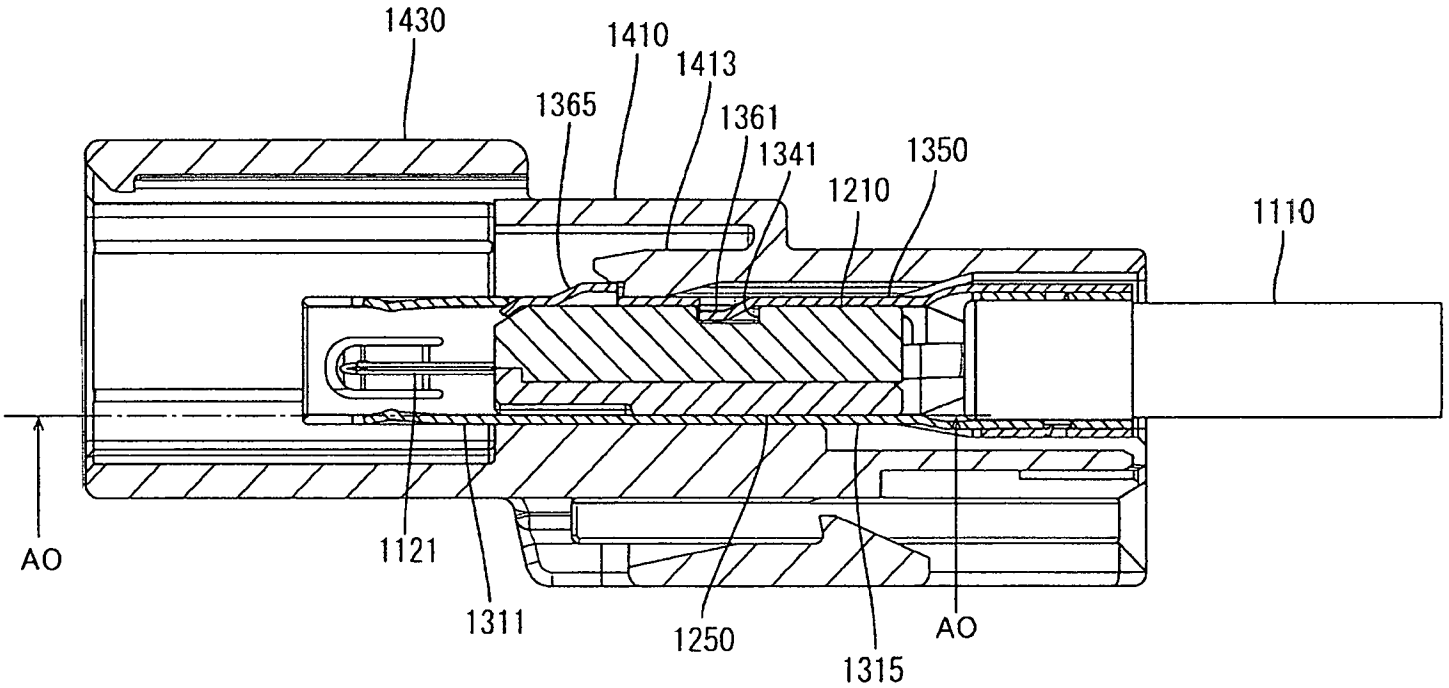
FIG. 77 is a section in a state where the connector is detached from the tool.

When the lower terminal holding member 1250 completely overlaps the upper terminal holding member 1210 and reaches a proper position, the electrically connecting portions 1121 are accommodated in the front part 1311 of the lower body 1310 while projecting from the terminal holding member 1200, as shown in FIG. 77. On the other hand, the terminal locked portions 1130 and the crimping portions 1123 are sandwiched and accommodated between the lower terminal holding member 1250 and the upper terminal holding member 1210. Further, the lower terminal holding member 1250 is disposed in the rear part 1315 of the lower body 1310. At this time, the locking plates 1227 are disposed at the front end positions of the penetrating rails 1270 and locked to the full locking projections 1273 in such a state as not to return rearward, thereby fixing the lower terminal holding member 1250 to the upper terminal holding member 1210.

Note that when the lower terminal holding member 1250 moves forward with respect to the upper terminal holding member 1210, the terminal locked portions 1130 of the terminals 1120 are fit into the terminal locking portions 1230 of the upper terminal holding member 1210. Thus, shifting movements of the terminals 1120 are suppressed when the lower terminal holding member 1250 moves. Further, the upper terminal holding member 1210 is engaged with the outer conductor shell 1300 at a plurality of positions, and the outer conductor shell 1300 is locked by the locking lance 1413 of the connector housing 1400. Thus, even if the lower terminal holding member 1250 moves, movements of the upper terminal holding member 1210 and the outer conductor shell 1300 can be prevented. Therefore, the lower terminal holding member 1250 easily is moved with respect to the upper terminal holding member 1210 when being pushed by the tool 1500.

Further, in this embodiment, the lower terminal holding member 1250 may be moved before the connector subassembly S2 is assembled and inserted into the connector housing 1400. A procedure in that case is described using FIGS. 80 to 82.

A tool 1550 is fit to the lower outer conductor shell 1301 from the front. The tool 1550 includes a tool receptacle 1570 externally fittable to the front part 1311 of the lower outer conductor shell 1301. A pushing portion 1560 is pushed rearward with the front part 1311 of the lower outer conductor shell 1301 fit in the tool receptacle 1570. Then, the pushing portion 1560 contacts the front surface of the lower terminal holding member 1250 and the lower terminal holding member 1250 is pushed rearward while the guides 1225 of the upper terminal holding member 1210 and the rails 1263 of the lower terminal holding member 1250 are sliding on each other.

When the lower terminal holding member 1250 is pushed rearward, the locking plates 1227 of the upper terminal holding member 1210 move relatively forward by moving over the partial locking projections 1271 of the penetrating rails 1270 of the lower terminal holding member 1250. When the lower terminal holding member 1250 is pushed farther rearward, the locking plates 1227 move over the full locking projections 1273. When the locking plates 1227 contact the front end positions of the penetrating rail 1270 to stop, the lower terminal holding member 1250 also cannot be moved any farther rearward and the pushing is stopped.

When the lower terminal holding member 1250 completely overlaps the upper terminal holding member 1210 and reaches a proper position, the electrically connecting portions 1121 are accommodated in the front part 1311 of the lower body 1310 while projecting from the terminal holding member 1200. On the other hand, the terminal locked portions 1130 and the crimping portions 1123 are sandwiched and accommodated between the lower terminal holding member 1250 and the upper terminal holding member 1210. Further, the lower terminal holding member 1250 is disposed in the rear end part 1315 of the lower body 1310. At this time, the locking plates 1227 are disposed at the front end positions of the penetrating rails 1270 and locked to the full locking projections 1273 in such a state as not to relatively return rearward, thereby fixing the lower terminal holding member 1250 to the upper terminal holding member 1210. In this way, the connector C2 may be assembled by accommodating the connector subassembly S2 into the connector housing 1400 after the electrically connecting portions 1121 are accommodated in an exposed state.

As described above, according to the connector C2 and the terminal module M2 of the second embodiment, the terminal holding member 1200 capable of accommodating the terminals 1120 is divided into the upper terminal holding member 1210 and the lower terminal holding member 1250. The electrically connecting portions 1121 of the terminals 1120 projecting from the upper terminal holding member 1210 are covered by the lower terminal holding member 1250, and are projecting forward of the lower terminal holding member 1250 to be exposed by relatively moving the lower terminal holding member 1250 toward the ends of the signal wires 1111. That is, since the electrically connecting portions 1121 of the terminals 1120 can be accommodated into the lower outer conductor shell 1301 while being covered and protected by the lower terminal holding member 1250, the deformation of the terminals 1120, such as when the terminals 1120 are accommodated into the lower outer conductor shell 1301 can be suppressed.

Further, the upper terminal holding member 1210 and the lower terminal holding member 1250 are locked in the state where the electrically connecting portions 1121 of the terminals 1120 are covered by the lower terminal holding member 1250 (at the terminal tip protection position) by locking the locking plates 1227 to the partial locking projections 1271. Thus, there is no possibility that the upper terminal holding member 1210 and the lower terminal holding member 1250 inadvertently move to expose the electrically connecting portions 1121 of the terminals 1120 such as while the terminals 1120 are being accommodated into the lower terminal holding member 1250. Further, the upper terminal holding member 1210 and the lower terminal holding member 1250 are locked in the state where the electrically connecting portions 1121 of the terminals 1120 are exposed (at the proper position) by locking the locking plates 1227 to the full locking projection 1273. Thus, there is no possibility that the upper terminal holding member 1210 and the lower terminal holding member 1250 inadvertently move to return to the state where the electrically connecting portions 1121 of the terminals 1120 are covered.

Third Embodiment

A third embodiment is described with reference to FIGS. 83 to 113.

A connector C3 of the third embodiment differs from the second embodiment in that no outer conductor shell is used and a terminal module M3 is directly accommodated into a connector housing 1400. Note that terminals 1120 are the same as those in the second embodiment and, hence, not described. Further, the connector housing 1400 is also similar to that of the second embodiment. Members and parts having the same functions as in the second embodiment are not described or briefly described by being denoted by the same reference signs. Note that vertical and front-rear directions are the same directions as in the second embodiment.

Figure 83:
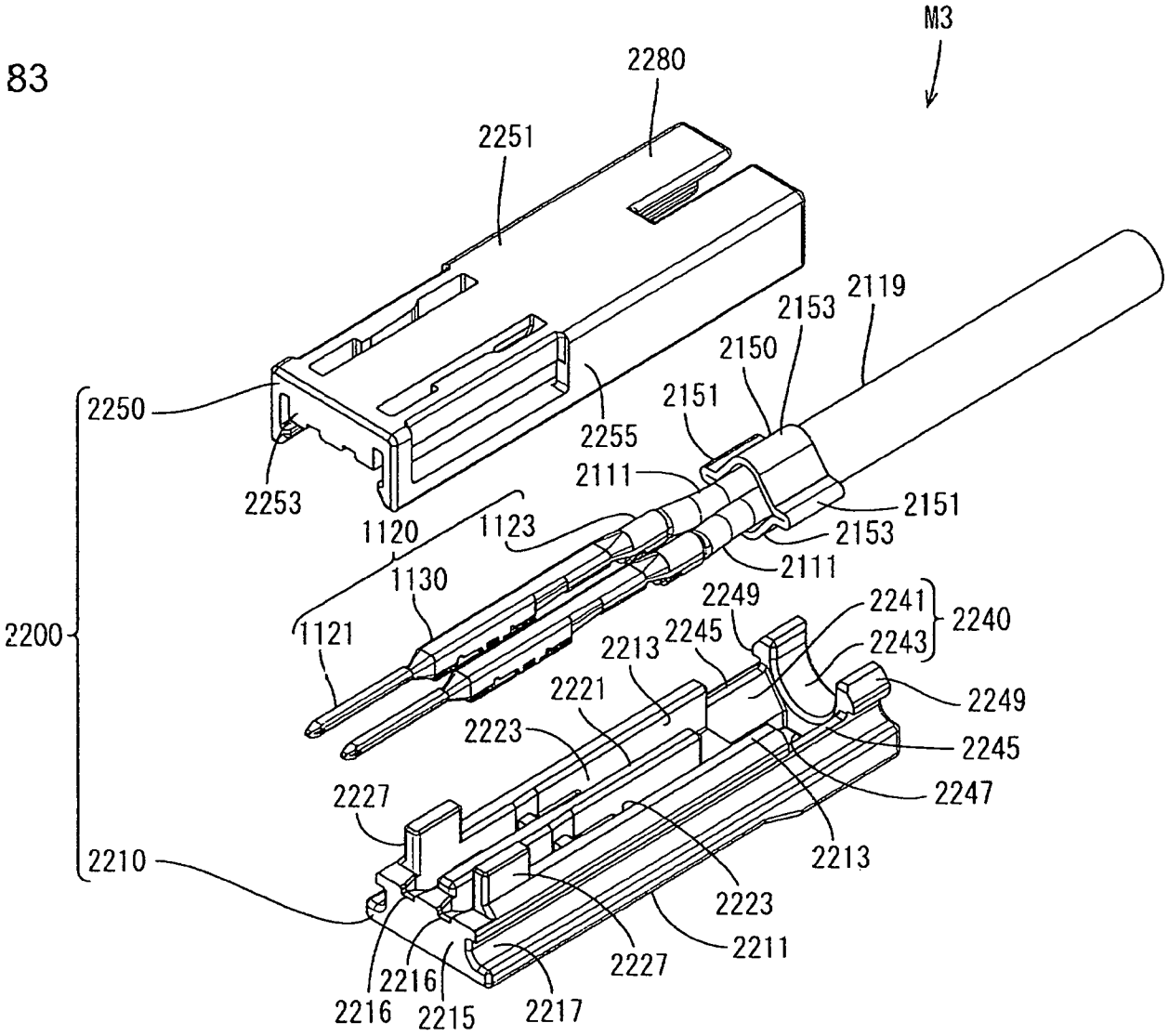
FIG. 83 is an exploded perspective view of a terminal module viewed from below in a third embodiment.
Figure 103:
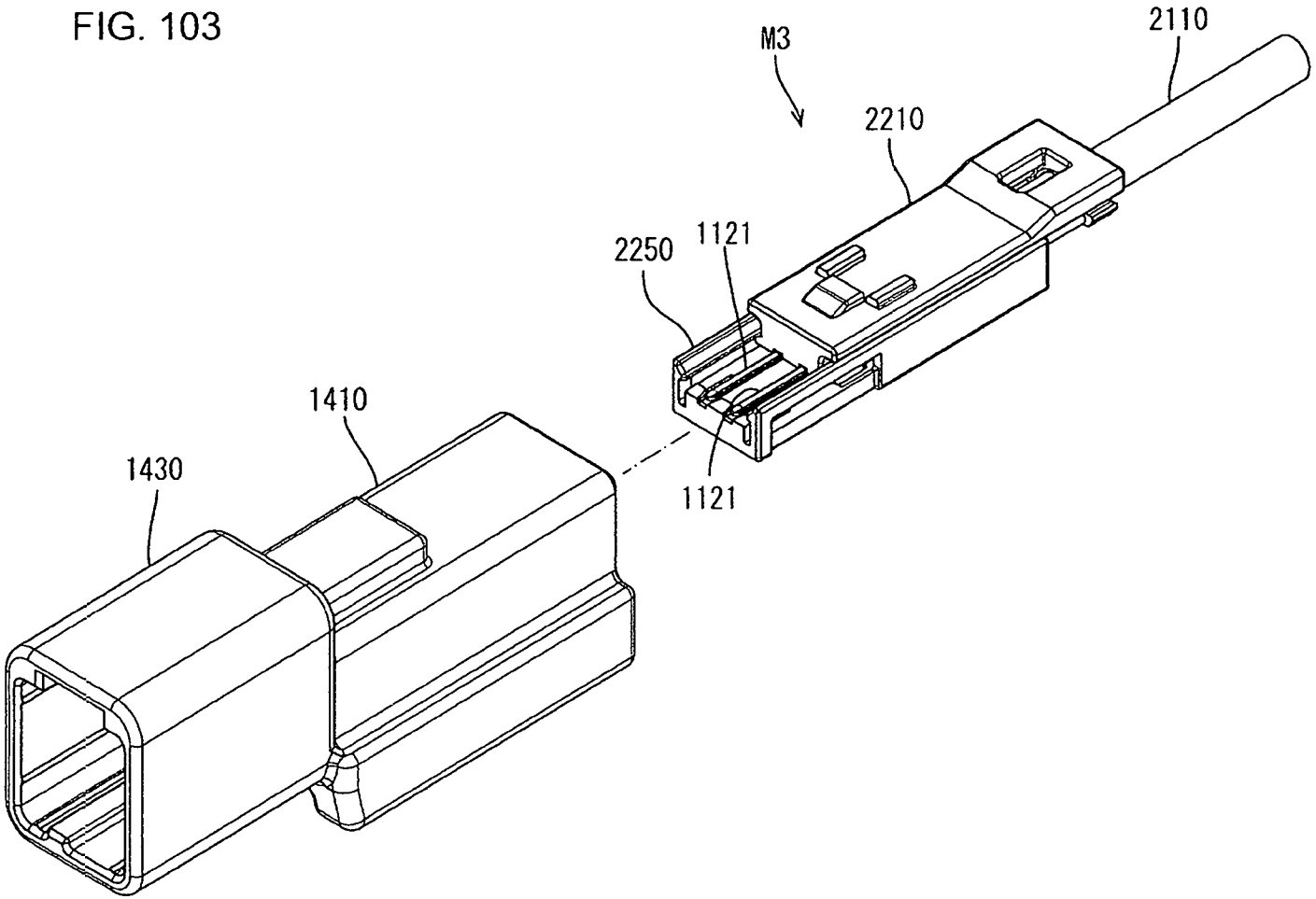
FIG. 103 is a perspective view in a state before the terminal module is assembled with a connector housing.
Figure 104:
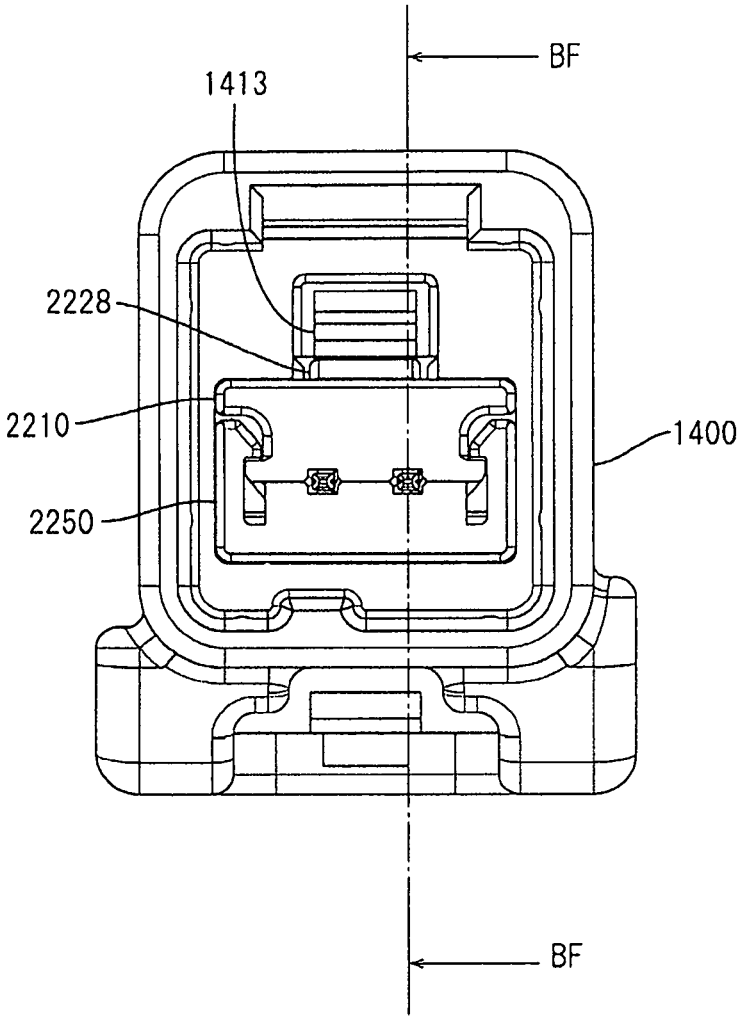
FIG. 104 is a front view in a state after the terminal module is assembled with the connector housing.
Figure 105:
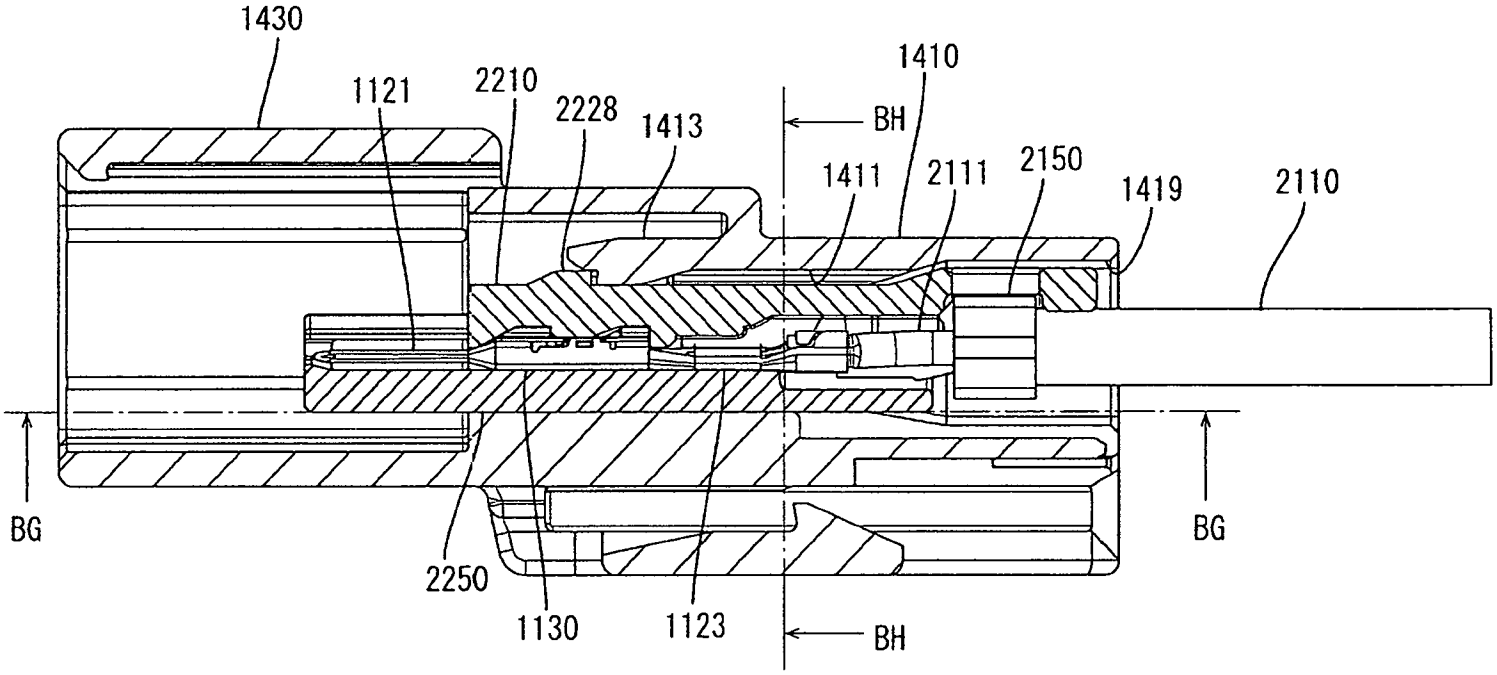
FIG. 105 is a section at position BF-BF in FIG. 104.
Figure 106:
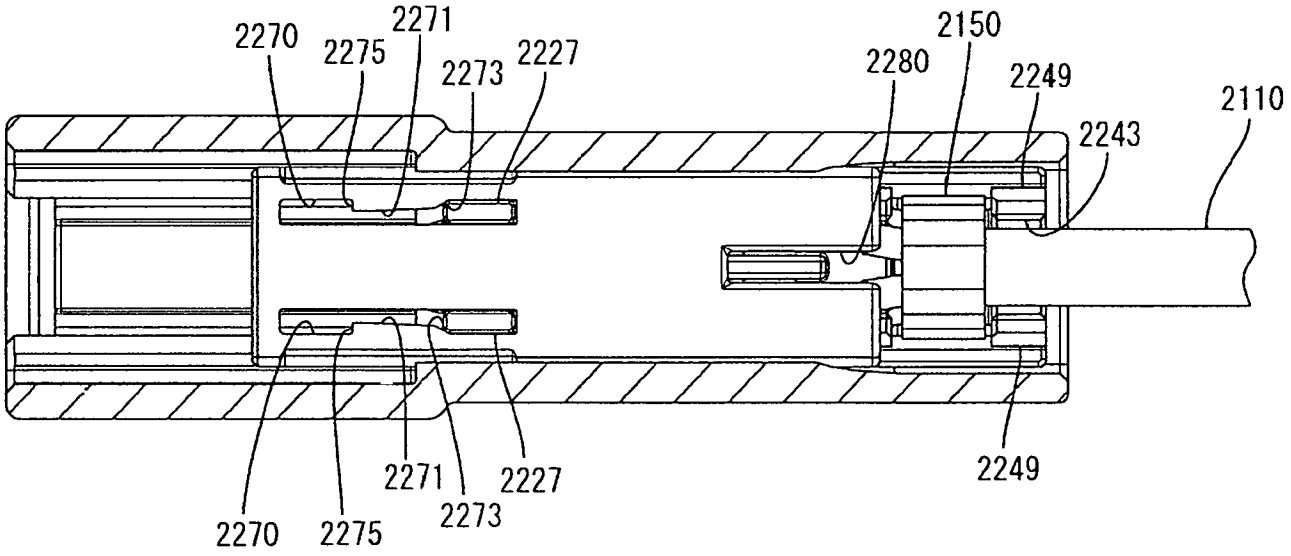
FIG. 106 is a section at position BG-BG in FIG. 105.

A terminal module M3 and the connector C3 of this embodiment are used for a shielded cable including signal wires. The terminal module M3 of this embodiment includes terminals 1120 connected to signal wires 2111 of a cable 2110, a bracket 2150 mounted on the cable 2110 and a terminal holding member 2200 for holding the terminals 1120, as shown in FIG. 83. The connector C3 of this embodiment includes the terminal module M3 and the connector housing 1400 as shown in FIGS. 103 and 105.

Figure 95:
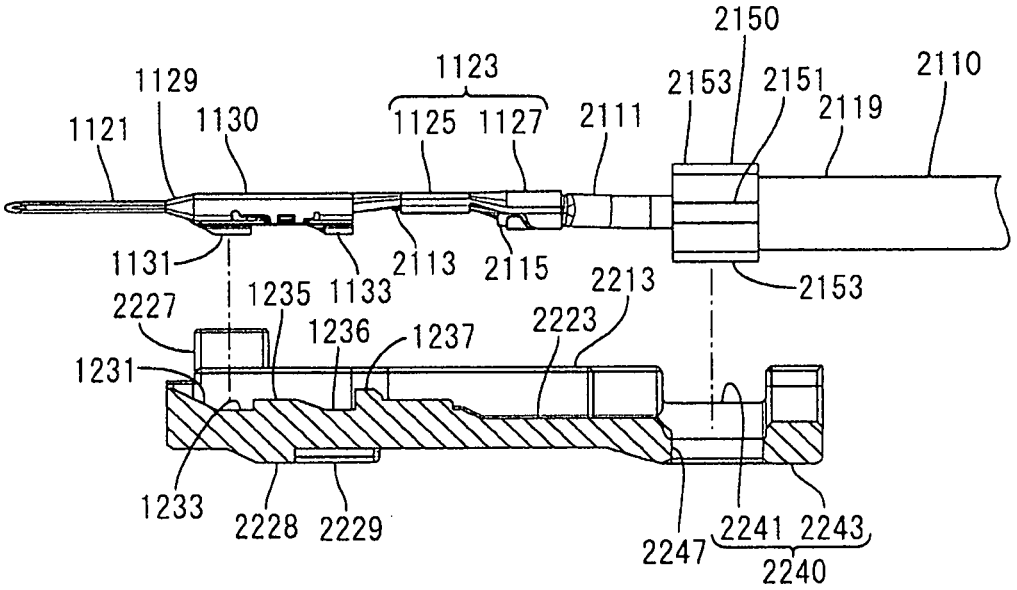
FIG. 95 is a section in a state before a terminal is held in the upper terminal holding member.

As shown in FIGS. 83 and 95, the cable 2110 is configured by bundling signal wires 2111 (two in this embodiment) and covering around the signal wires 2111 by an outer coating 2119. The signal wire 2111 is formed by covering an inner conductor 2113 by an inner insulation coating 2115, and the inner conductor 2113 has a small diameter. A wire barrel 1125 is caulked to the inner conductor 2113, and an insulation barrel 1127 is caulked to the inner insulation coating 2115. The outer coating 2119 is stripped at an end of the cable 2110 to expose the signal wires 2111 for connection to the terminals 1120. Further, exposed parts of the signal wires 2111 are untwisted.

The bracket 2150 is inserted onto the cable 2110 and mounted on an end part of the outer coating 2119 where the signal wires 2111 are exposed. The bracket 2150 has a flat rhombus shape in a front view and has a vertical dimension shorter than a width. Widthwise end parts of the bracket 2150 are formed into flat portions 2151 by overlapped plate parts to have a thickness which is twice the plate thickness, whereas vertical end parts of the bracket 2150 are formed into rounded curved portions 2153. The two signal wires 2111 are insertable through the bracket 2150.

As shown in FIG. 83, the terminal holding member 2200 is divided vertically (direction perpendicular to the extending direction of the terminals 1120) into two, configured by assembling an upper terminal holding member 2210 (an example of the "first terminal holding member") and a lower terminal holding member 2250 (an example of the "second terminal holding member"), and has a box shape long in the front-rear direction as a whole. Further, the lower terminal holding member 2250 is slidable along the extending direction of the terminals 1120 with respect to the upper terminal holding member 2210.

The upper terminal holding member 2210 is made of synthetic resin and holds the crimping portions 1123 and the terminal locked portions 1130 of the terminals 1120, as shown in FIG. 83. The upper terminal holding member 2210 includes a ceiling wall 2211, two side walls 2213 vertically projecting from the ceiling wall 2211, an upper front wall 2215 and an upper bracket holding portion 2240, and is open downward and rearward. A width of the ceiling wall 2211 is equal to that of the outer conductor shell 1300 in the second embodiment and equal to or slightly smaller than an inner dimension of a cavity 1411 of the connector housing 1400. The upper front wall 2215 is integrated with a lower front wall 2253, to be described later, thereby forming a front wall of the terminal holding member 2200. The upper front wall 2215 is provided with upper insertion grooves 2216 to form insertion holes into which the electrically connecting portions 1121 of the terminals 1120 are insertable. The side walls 2213 project down from positions inward of widthwise end parts of the ceiling walls 2211, and surfaces between the ceiling wall 2211 and the side walls 2213 are formed into rounded surfaces 2217. Further, the lower ends of the side walls 2213 are at the same height as the lower end positions of the terminal locked portions 1130 of the accommodated terminals 1120.

Figure 85:
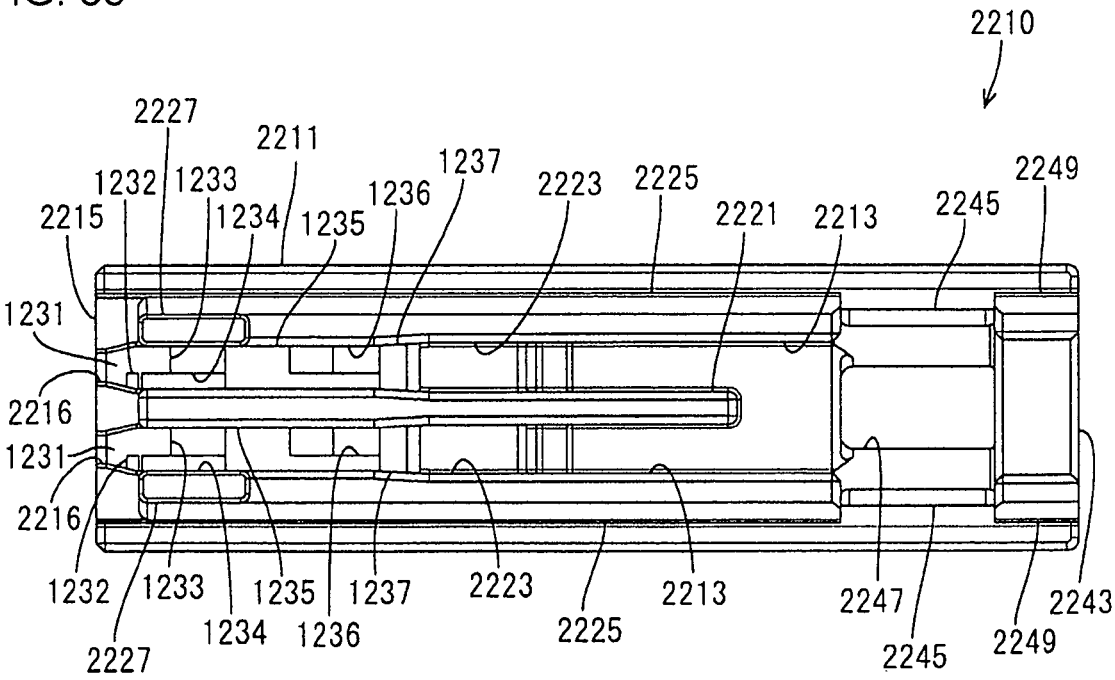
FIG. 85 is a bottom view of the upper terminal holding member.

As shown in FIGS. 83 and 85, a partition wall 2221 is provided between the side walls 2213 for partitioning between the terminals 1120. The partition wall 2221 projects down to the same height as the lower ends of the side walls 2213 from the ceiling wall 2211. Note that a dimension of the partition wall 2221 in the front-rear direction is shorter than that of the both side walls 2213 in the front-rear direction, and the rear end position of the partition wall 2221 is different from those of the side walls 2213. An area enclosed by each side wall 2213, the partition wall 2221 and the ceiling wall 2211 forms an accommodation recess 2223 for accommodating the crimping portion 1123 and the terminal locked portion 1130 of the terminal 1120. The accommodation recess 2223 is open downward, and the terminal 1120 can be accommodated therein from below with the electrically connecting portion 1121 projecting. Further, an inner dimension in a front part between each side wall 2213 and the partition wall 2221 (of the accommodation recess 2223) is substantially equal to an outer dimension of the terminal locked portion 1130. The inner dimension between each side wall 2213 and the partition wall 2221 (of the accommodation recess 2223) becomes larger toward a rear side, and is substantially equal to or slightly larger than an outer dimension of the crimping portion 1123 at a rear half part.

As shown in FIGS. 83 and 85, the lower surface of the accommodation recess 2223 is shaped in conformity with the shape of an upper part of the terminal 1120. Particularly, a terminal locking portion 1230 into which the terminal locked portion 1130 is to be fit is provided in the lower surface of the ceiling wall 2211 (lower surface of a front end part of the accommodation recess 2223) in a part where the terminal locked portion 1130 is to be accommodated. The shape of the terminal locking portion 1230 is similar to that in the second embodiment and not described.

As shown in FIGS. 83 and 105, a part of the accommodation recess 2223 where the crimping portion 1123 is to be accommodated is recessed in conformity with the shape of the crimping portion 1123 with a clearance provided between the crimping portion 1123 and this recess. More specifically, a part where the insulation barrel 1127 is to be accommodated is recessed more than a part where the wire barrel 1125 is to be accommodated to define a constant clearance between the crimping portion 1123 of the terminal 1120 and the accommodation recess 2223.

Figure 86:
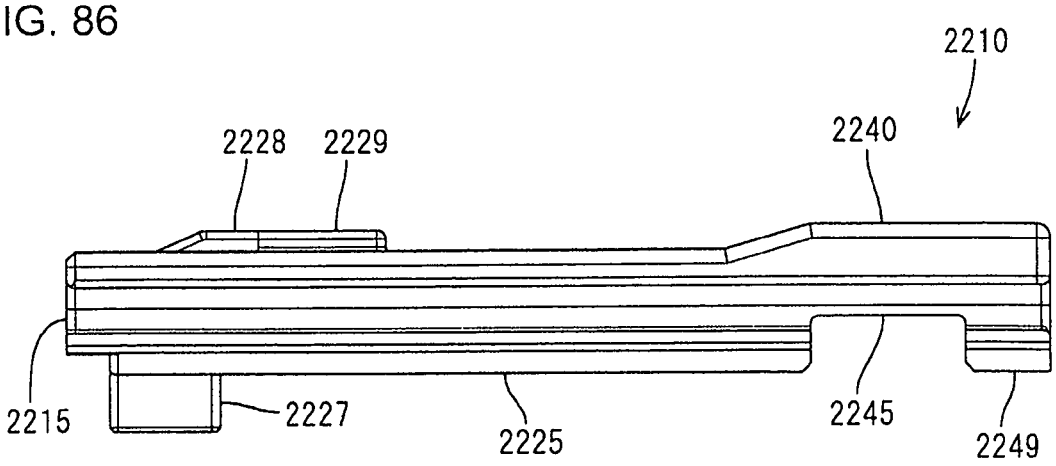
FIG. 86 is a side view of the upper terminal holding member.
Figure 87:
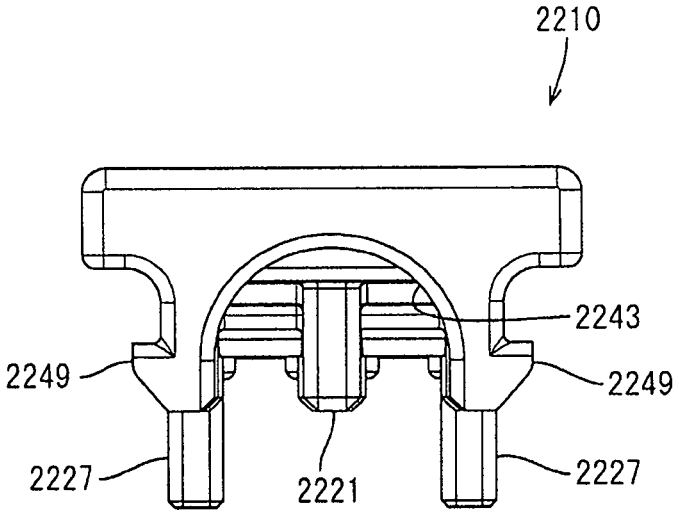
FIG. 87 is a back view of the upper terminal holding member.
Figure 88:
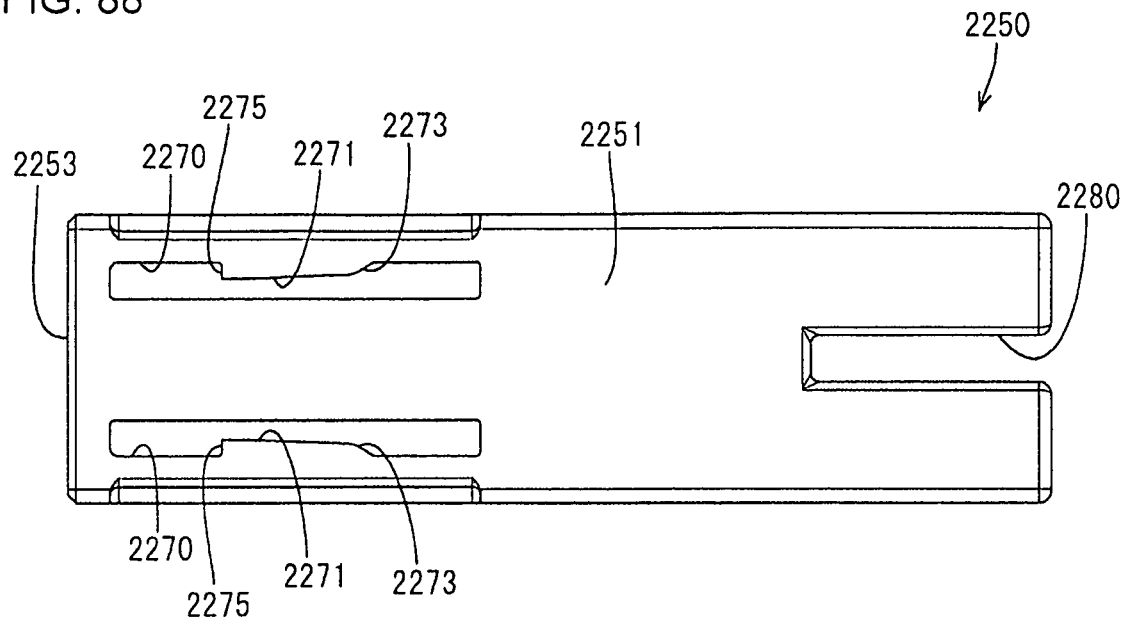
FIG. 88 is a bottom view of a lower terminal holding member.

As shown in FIGS. 85 and 86, guides 2225 project out in the width direction from side surfaces of the upper front wall 2215 and lower end parts of the both side walls 2213. The guide 2225 extends in the front-rear direction (extending direction of the terminals 1120) from the front end of the upper front wall 2215 to the rear end of the side wall 2213 of the upper terminal holding member 2210. The lower end position of the guide 2225 is at the same height as that of the side wall 2213, and a surface from the lower surface of the side wall 2213 toward the side surface of the guide 2225 is a rounded surface. Further, the upper surface of the guide 2225 is perpendicular to the side surface of the side wall 2213.

Further, as shown in FIGS. 83 and 86, a locking plate 2227 (parts of the "full locking portion" and the "partial locking portion") is provided at the front position of each side wall 2213. The locking plate 2227 is rectangular in a side view and projects down to a position slightly above the lower end of the lower terminal holding member 2250 when the upper terminal holding member 2210 is assembled with the lower terminal holding member 2250.

Figure 84:
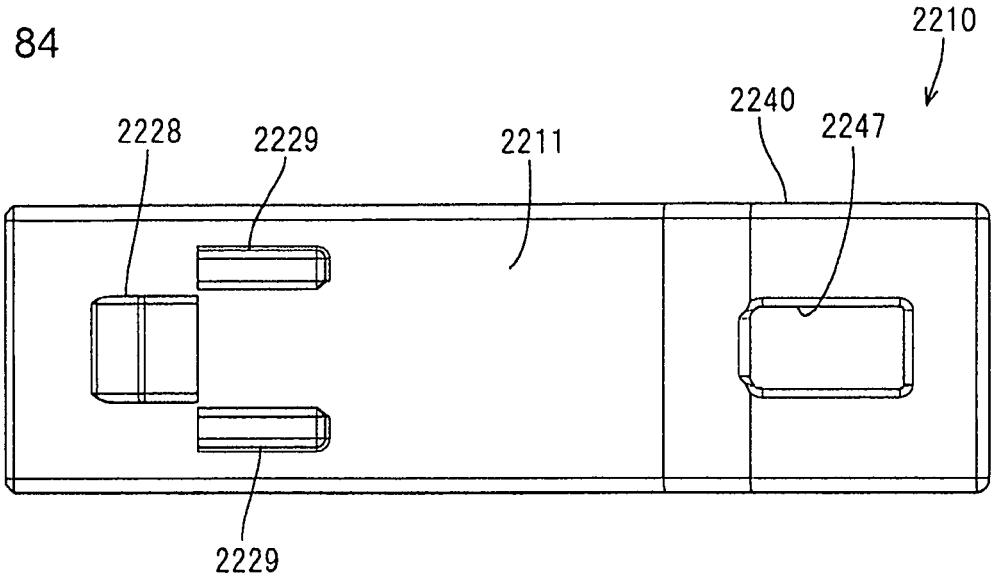
FIG. 84 is a plan view of an upper terminal holding member.

As shown in FIGS. 84 and 86, a lance locking portion 2228 (an example of the "first engaging portion") projects up on the upper surface of the ceiling wall 2211. Further, two engaging portions 2229 (an example of the "first engaging portion") are provided at positions shifted outward in the width direction behind the lance locking portion 2228. The engaging portions 2229 are ribs extending in the front-rear direction and the upper end position of the lance locking portion 2228 and those of the engaging portions 2229 are at the same height.

As shown in FIGS. 83 and 85, the upper bracket holding portion 2240 is provided on a rear end part of the upper terminal holding member 2210. A ceiling wall of the upper bracket holding portion 2240 has a larger vertical dimension than the ceiling wall 2211, and the upper surface of the upper bracket holding portion 2240 is located higher than the upper surface of the ceiling wall 2211. On the other hand, a width of the ceiling wall of the upper bracket holding portion 2240 is equal to that of the ceiling wall 2211.

As shown in FIGS. 83 and 85, the upper bracket holding portion 2240 includes a bracket accommodating portion 2241 for accommodating the bracket 2150 and a cable holding portion 2243 for holding the cable 2110. The bracket accommodating portion 2241 has side walls tapered to become narrower toward tops and widest lower end parts of the side walls serve as contact portions 2245 configured to come into contact with the flat portions 2151 of the bracket 2150. Further, an exposing hole 2247 penetrates through the ceiling wall at the upper end position of the bracket accommodating portion 2241 where the side walls are narrowest. The curved portion 2153 of the bracket 2150 is fit into this exposing hole 2247. The cable holding portion 2243 is open downward and is semicircular in a back view, and a locking claw 2249 is provided on an end part of the cable holding portion 2243.

The lower terminal holding member 2250 is made of synthetic resin and, as shown in FIG. 83, accommodates the crimping portions 1123 and the terminal locked portions 1130 of the terminals 1120 together with the upper terminal holding member 2210. The lower terminal holding member 2250 includes a bottom wall 2251, the lower front wall 2253 and rail walls 2255. The bottom wall 2251 is a flat plate having a flat upper surface. The lower front wall 2253 is provided with lower insertion grooves 2257 forming the insertion holes, into which the electrically connecting portions 1121 of the terminals 1120 are insertable, together with upper insertion grooves 2216.

Figure 96:
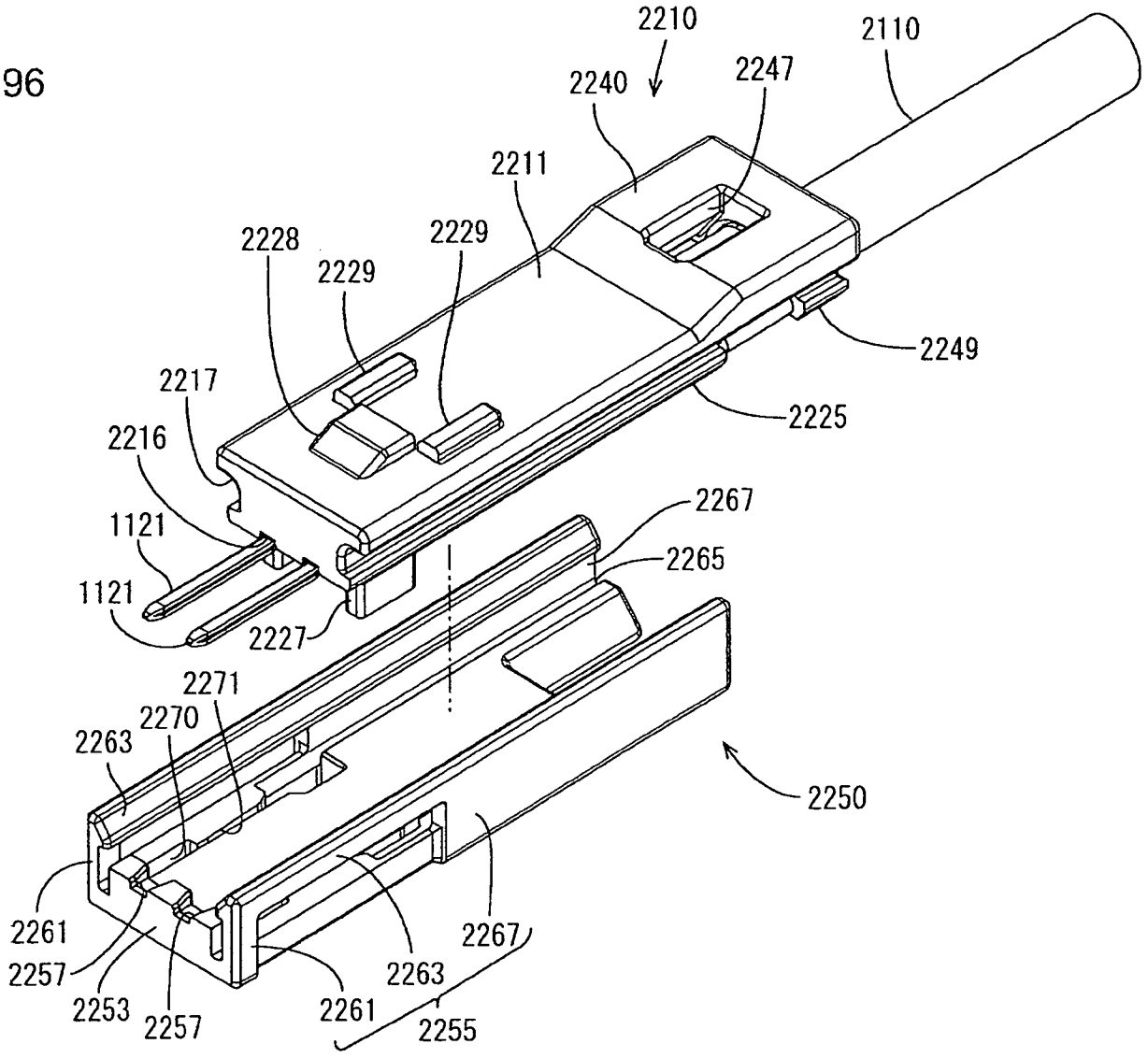
FIG. 96 is a perspective view in a state before the lower terminal holding member is assembled with the upper terminal holding member.
Figure 98:
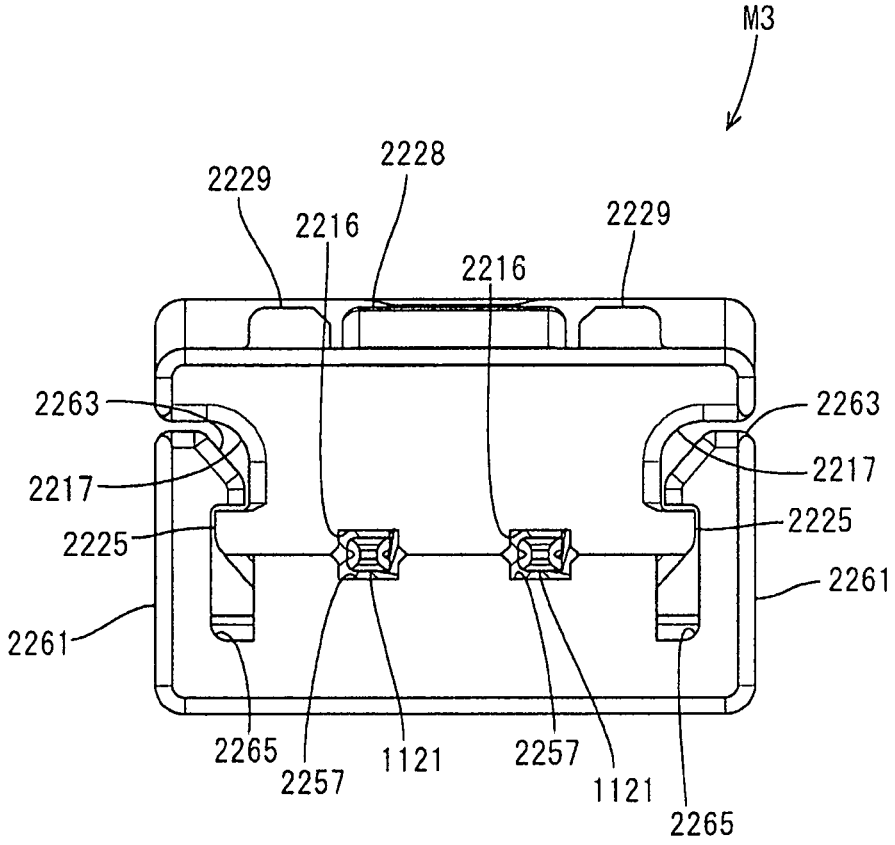
FIG. 98 is a front view in the state after the lower terminal holding member is assembled with the upper terminal holding member.

As shown in FIGS. 96 and 98, the rail walls 2255 of the lower terminal holding member 2250 are positioned to cover the side walls 2213 of the upper terminal holding member 2210 from outer sides in the width direction. The rail guide 2255 is composed of an arm 2261 projecting up from the front end position of the lower terminal holding member 2250, a rear end side wall 2267 provided on a rear end part of the lower terminal holding member 2250 and a rail 2263 configured to slide by being fit to the guide 2225. The rail wall 2263 is in the form of a claw projecting inward, and continuously extends in the front-rear direction (extending direction of the terminals 1120) from the arm 2261 to the rear end of the rear end side wall 2267. A surface from the upper end of the rail 2263 toward the inner claw is rounded. Further, the lower surface of the rail 2263 is configured to slide on the upper surface of the guide 2225. Further, a groove 2265 having a rounded surface is provided at a position of the bottom wall 2251 inwardly of the arm 2261 and the rear end side wall 2267. The groove 2265 extends in the front-rear direction and is provided from the front end position of the lower front wall 2253 to the rear end position of the bottom wall 2251. Thus, the arm 2261 and the rear end side wall 2267 easily are deflected and deformed outward in the width direction.

Figure 89:
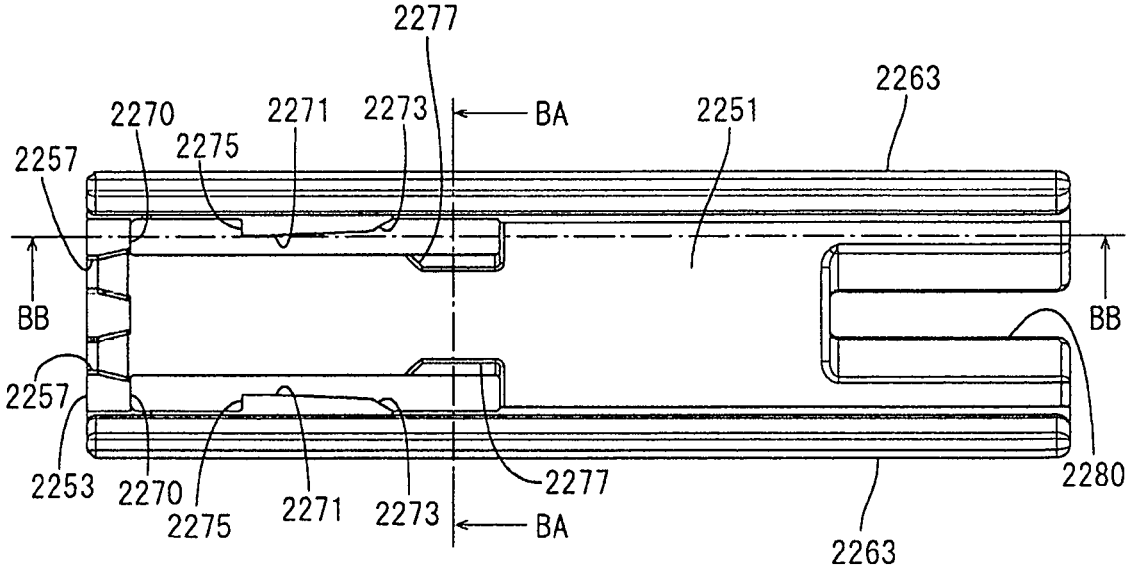
FIG. 89 is a plan view of the lower terminal holding member.
Figure 90:
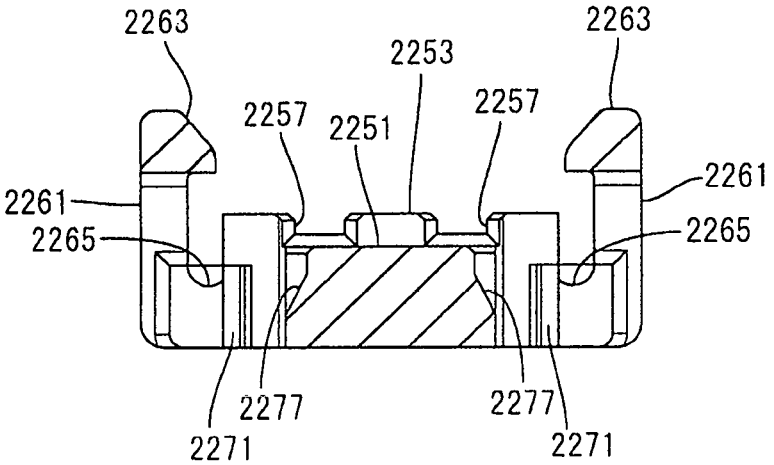
FIG. 90 is a section at position BA-BA in FIG. 89.
Figure 91:
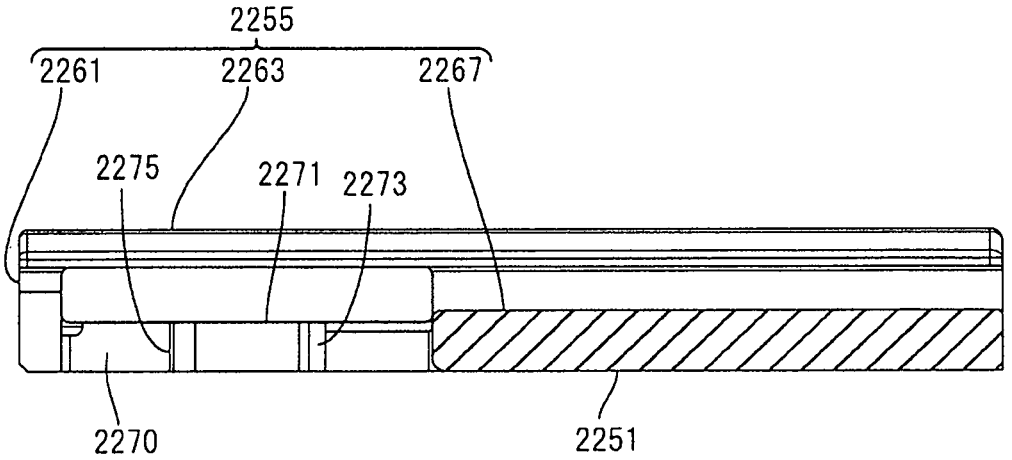
FIG. 91 is a section at position BB-BB in FIG. 89.
Figure 92:
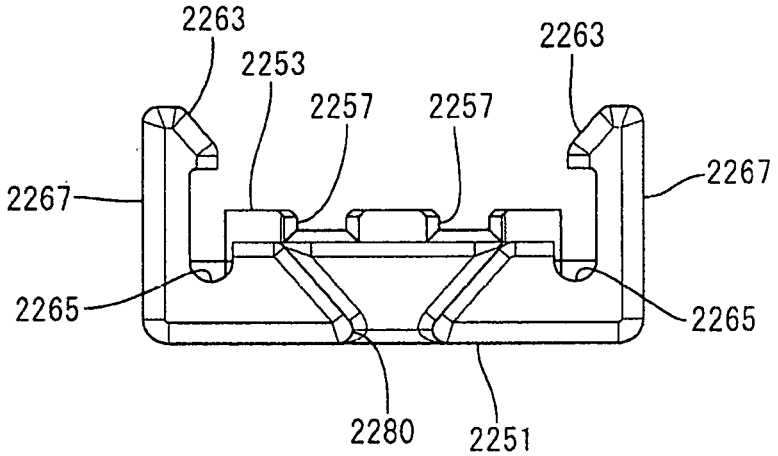
FIG. 92 is a back view of the lower terminal holding member.
Figure 97:
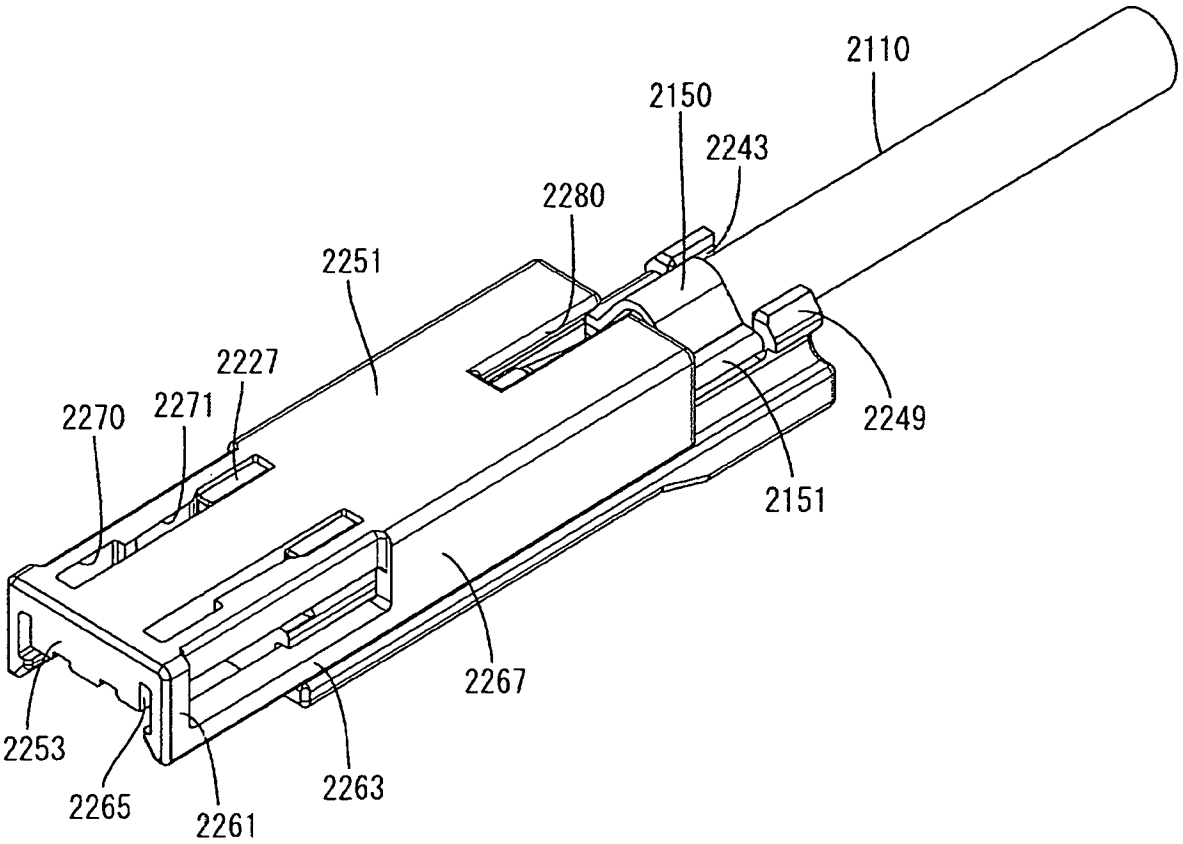
FIG. 97 is a perspective view viewed from below in a state after the lower terminal holding member is assembled with the upper terminal holding member.

As shown in FIGS. 89 and 97, the bottom wall 2251 is provided with two penetrating rails 2270 into which the locking plates 2227 are to be fit. Each penetrating rail 2270 penetrates through the bottom wall 2251 in a plate thickness direction and extends in the front-rear direction between the arm 2261 and the rear end side wall 2267. A width of the penetrating rail 2270 is equal to or slightly larger than that of the locking plate 2227.

The penetrating rail 2270 is provided with a locking projection 2271. The locking projection 2271 is provided at a position separated from the rear end position of the penetrating rail 2270 by a dimension of the locking plate 2227 in the front-rear direction and separated from the front end position of the penetrating rail 2270 by the dimension of the locking plate 2227 in the front-rear direction. A vertical dimension of the locking projection 2271 is smaller than that of the bottom wall 2251, and the lower surface of the locking projection 2271 is flush with that of the bottom wall 2251. The locking projection 2271 projects inward from the side surface of the penetrating rail 2270 to narrow the width of the penetrating rail 2270, thereby suppressing a movement of the locking plate 2227 in the front-rear direction. More specifically, the rear end surface of the locking projection 2271 is formed into an inclined surface 2273 (an example of the "partial locking portion") located more inward toward a front side, and the locking plate 2227 is locked to this inclined surface 2273. When a force is applied to move the locking plate 2227 forward, the locking plate 2227 easily passes through the position where the locking projection 2271 is provided, since the rear end surface is formed into the inclined surface 2273. On the other hand, the front surface of the locking projection 2271 is a perpendicular surface 2275 (an example of the "full locking portion") perpendicular to the inner side surface of the penetrating rail 2270, thereby preventing rearward return of the locking plate 2227 that has passed through the locking projection 2271 once. Note that a surface between the inclined surface 2273 and the perpendicular surface 2275 is a surface becoming gently and gradually narrower than the inclined surface.

A guide groove 2277 for guiding the locking plate 2227 when fitting the locking plate 2227 into the penetrating rail portion 2270 is provided at the rear end position of the penetrating rail 2270. The lower end position of the guide groove 2277 is substantially at a vertically middle position of the locking projection 2271. The guide groove 2277 gradually inclines down from an inner side toward an outer side in the width direction, thereby making the locking plate 2227 easily fittable into the penetrating rail 2270.

As shown in FIGS. 96 and 97, a bracket cut 2280 is provided in a rear end part of the bottom wall 2251. The bracket cut 2280 is cut forward from the rear end position of the bottom wall 2251 to the same position as the front end of the exposing hole 2247 of the upper terminal holding member 2210 when the lower and upper terminal holding members 2250, 2210 are assembled at a proper position. Inner surfaces of the bracket cut 2280 become wider toward tops. Further, a lower half of the bracket 2150 can be accommodated into the bracket cut portion 2280.

Figure 93:
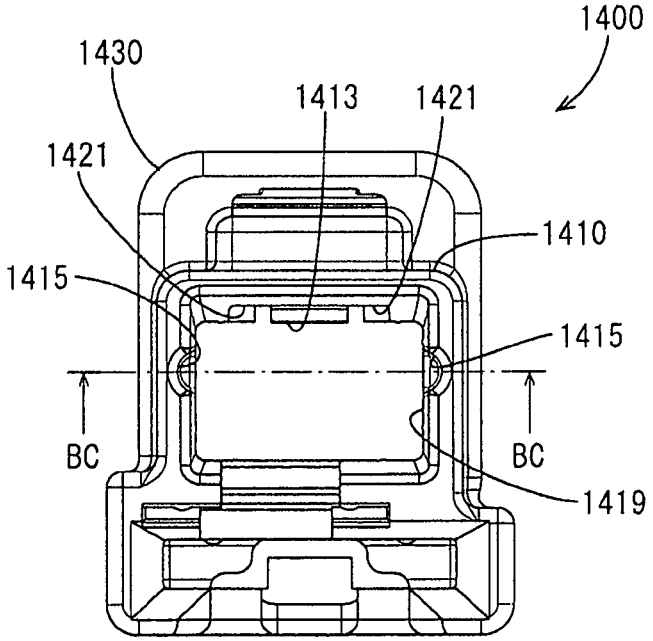
FIG. 93 is a back view of a connector housing.
Figure 94:
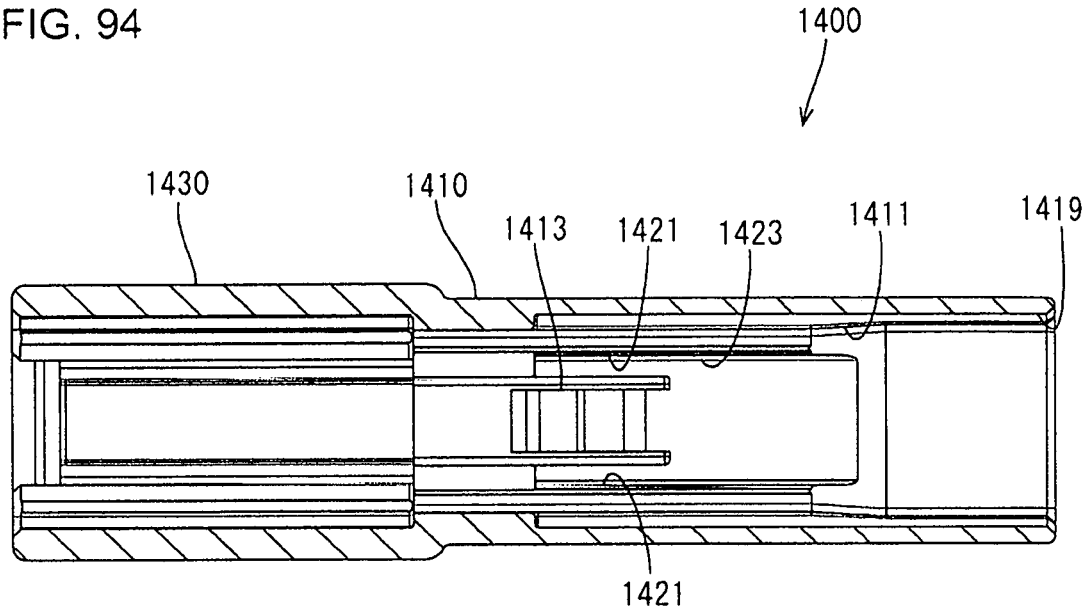
FIG. 94 is a section at position BC-BC in FIG. 93.

The connector housing 1400 is the same as that in the second embodiment. Here, a structure not used in the second embodiment is described. As shown in FIGS. 93 and 94, fitting grooves 1421 are provided in a ceiling wall of the cavity 1411. Two of the fitting grooves 1421 are provided on both sides of the locking lance 1413. An inner diameter of each fitting groove 1421 is equal to an outer diameter of the engaging portion 2229. Further, a coupling groove 1423 coupling the fitting grooves 1421 is provided behind the fitting grooves 1421. The coupling groove 1423 also is recessed between rearward extensions of the fitting grooves 1421.

Next, an example of an assembling procedure of the connector C3 is described.

First, as shown in FIGS. 83 and 95, the insulation coating 2119 of the cable 2110 having the bracket 2150 mounted thereon is stripped to expose the ends of the signal wires 2111 and the exposed parts of the signal wires 2111 are untwisted. Then, the signal wires 2111 are connected to the terminals 1120. Specifically, the wire barrels 2125 of the crimping portions 1123 are crimped to the inner conductors 2113 of the signal wires 2111 and the insulation barrels 1127 of the crimping portions 1123 are caulked to the inner insulation coatings 2115 of the signal wires 2111.

Subsequently, as shown in FIGS. 83 and 95, the terminals 1120 connected to the signal wires 2111 of the cable 2110 are accommodated into the upper terminal holding member 2210. The terminals 1120 are accommodated into the upper terminal holding member 2210 from below so that each terminal 1120 is accommodated into each accommodation recess 2223. In the case of accommodating the terminals 1120 into the downwardly open accommodation recesses 2223 in this way, the second terminal 1120 merely is retracted outwardly of one accommodation recess 2223 when accommodating the first terminal 1120 into the corresponding one accommodation recess 2223. Thus, an untwisting dimension may be short as compared to the case where the terminals 1120 are accommodated in the extending direction of the terminals 1120. Therefore, there is less influence of noise. When the terminal 1120 is disposed at a predetermined position of the upper terminal holding member 2210, the terminal locked portion 1130 is locked by the terminal locking portion 1230. Therefore, the terminal 1120 is held not to move with respect to the upper terminal holding member 2210.

Figure 102:
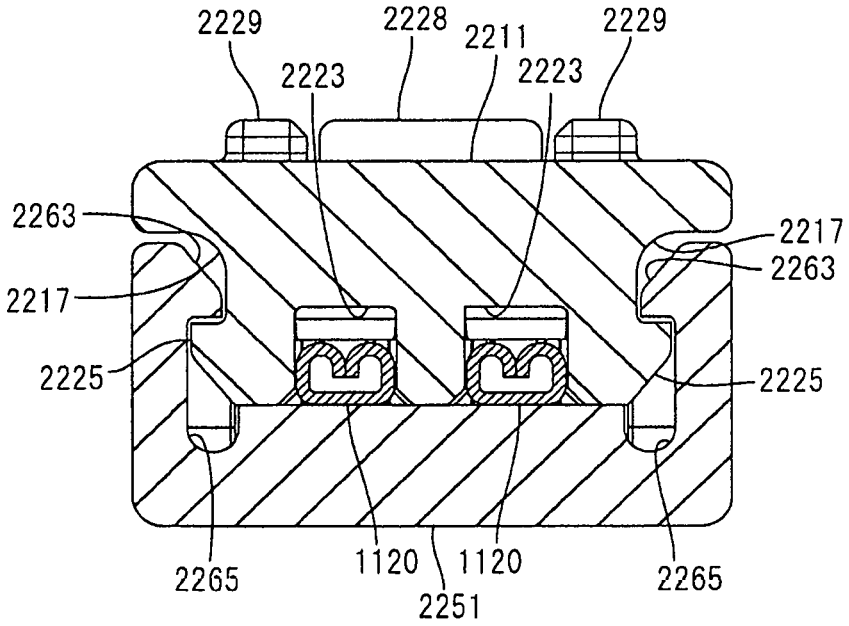
FIG. 102 is a section at position BE-BE in FIG. 100.

Then, as shown in FIG. 96, the upper terminal holding member 2210 having the terminals 1120 accommodated therein is assembled with the lower terminal holding member 2250. Specifically, the lower terminal holding member 2250 is inserted from below the upper terminal holding member 2210. By deforming the rails 2263 outward while the guides 2225 of the upper terminal holding member 2210 are deformed inward, the guides 2225 and the rails 2263 are made slidable by moving over each other. As shown in FIG. 102, the lower end surfaces of the rails 2263 and the upper surfaces of the guides 2225 are fit to slide on each other so that the upper terminal holding member 2210 and the lower terminal holding member 2250 are not relatively movable in the vertical direction.

Figure 99:
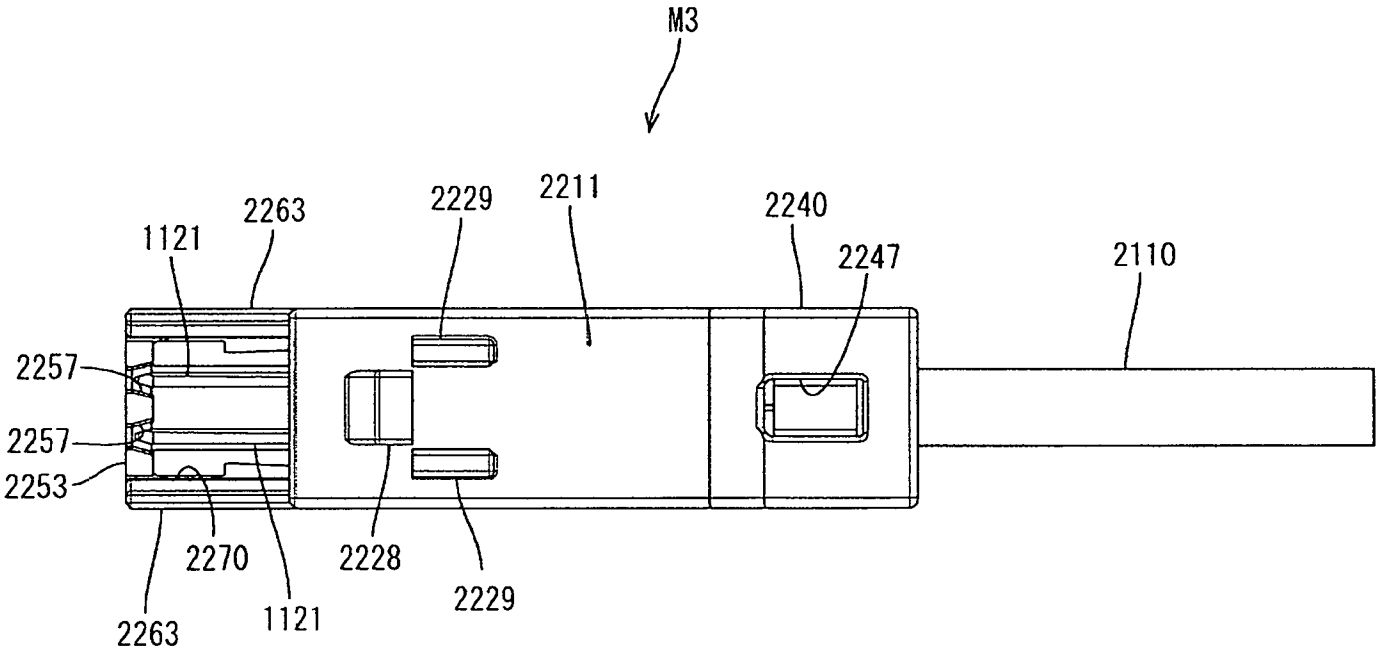
FIG. 99 is a plan view in the state after the lower terminal holding member is assembled with the upper terminal holding member.
Figure 100:
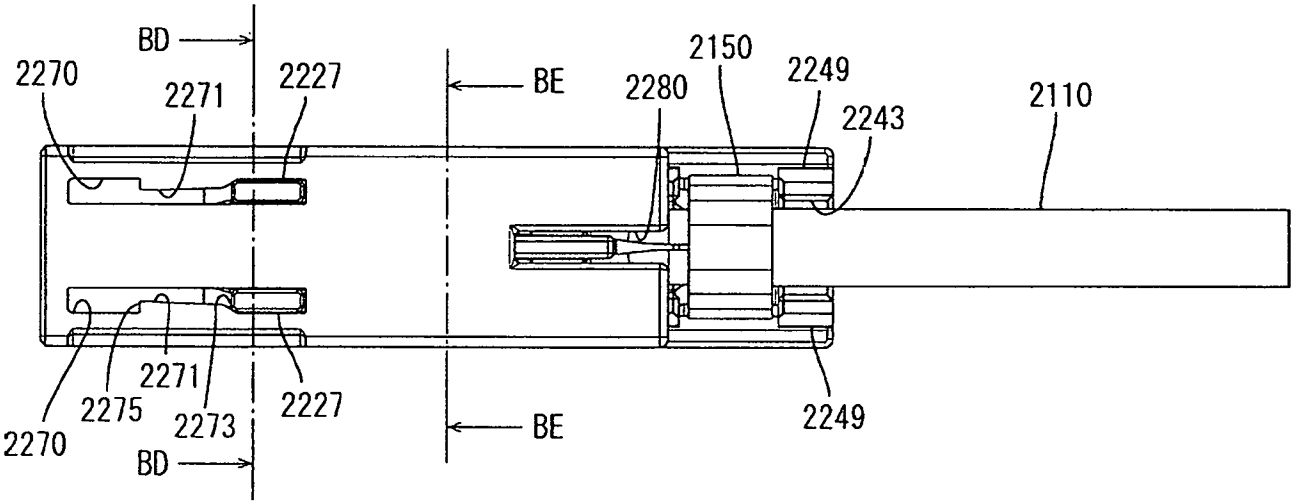
FIG. 100 is a bottom view in the state after the lower terminal holding member is assembled with the upper terminal holding member.
Figure 101:
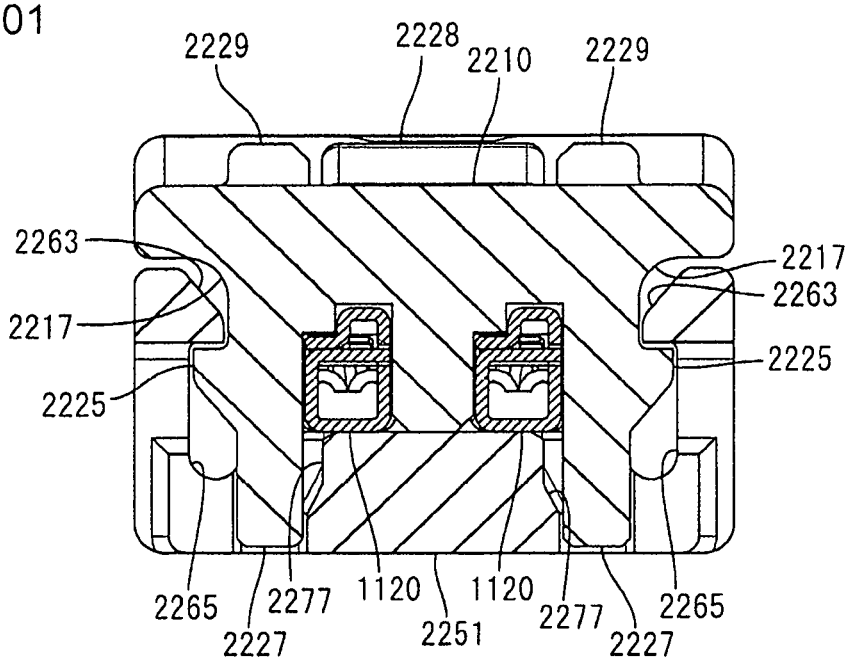
FIG. 101 is a section at position BD-BD in FIG. 100.

Further, as shown in FIGS. 100 and 101, the locking plates 2227 are guided by the guide grooves 2277 of the lower terminal holding member 2250, fit into the rear end parts of the penetrating rails 2270 and locked to the inclined surfaces 2273 of the locking projections 2271. At a terminal tip protection position where the locking plates 2227 are locked to the partial locking projections 2271, the electrically connecting portions 1121, which are tip parts of the terminals 1120, projecting from the upper terminal holding member 2210 are held in a state covered by the lower terminal holding member 2250, as shown in FIG. 99. Further, tip parts of the electrically connecting portions 1121 are disposed in the lower insertion grooves 2257 of the lower front wall 2253. On the other hand, the bracket 2150 of the cable 2110 is exposed without being covered by the lower terminal holding member 2250.

Figure 107:
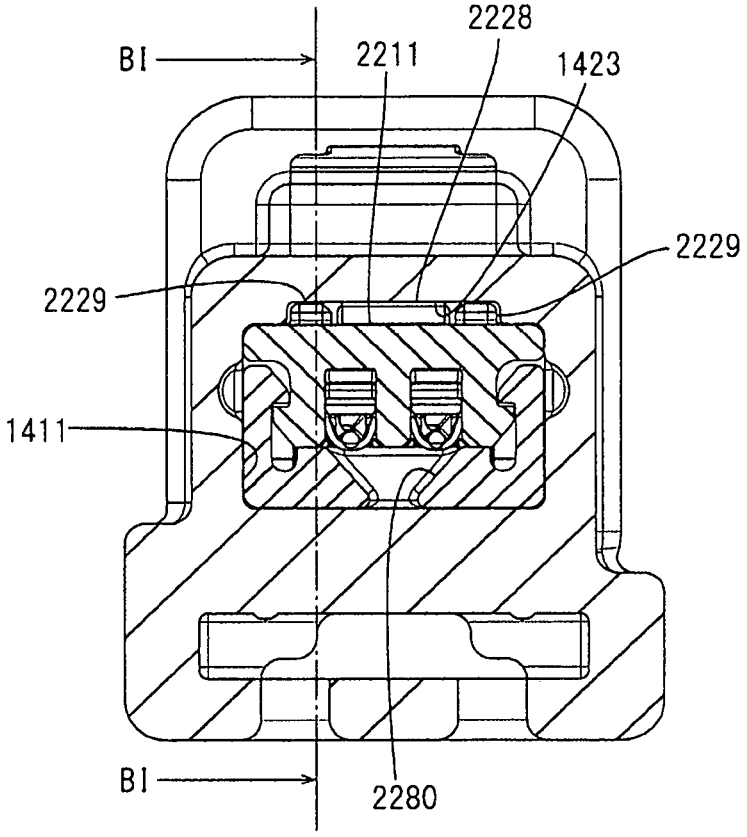
FIG. 107 is a section at position BH-BH in FIG. 105.
Figure 108:
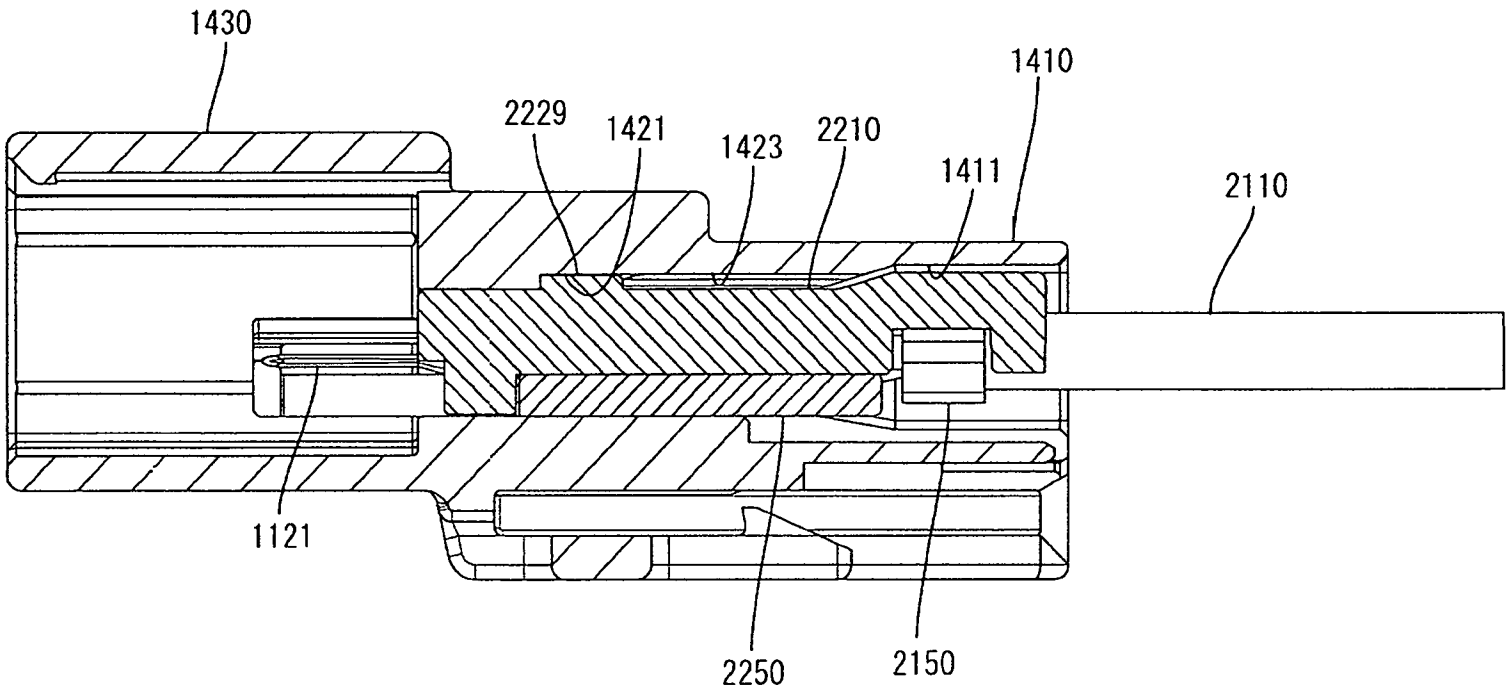
FIG. 108 is a section at position BI-BI in FIG. 107.

Subsequently, the terminal module M3 is mounted into the connector housing 1400, as shown in FIGS. 103, 105 and 107. The terminal module M3 is inserted through the insertion opening 1419 at the rear end of the cavity 1411 and pushed forward. At this time, the engaging portions 2229 are positioned by the coupling groove 1423, thereby restricting the inclination of the terminal module M3 in the connector housing 1400. The engaging portions 2229 are fit into the fitting grooves 1421 to prevent a movement of the terminal module M3 in the width direction in the connector housing 1400. Then, the locking lance 1413 of the connector housing 1400 is locked to the lance locking portion 2228 and the terminal module M3 is locked to the connector housing 1400.

Figure 109:
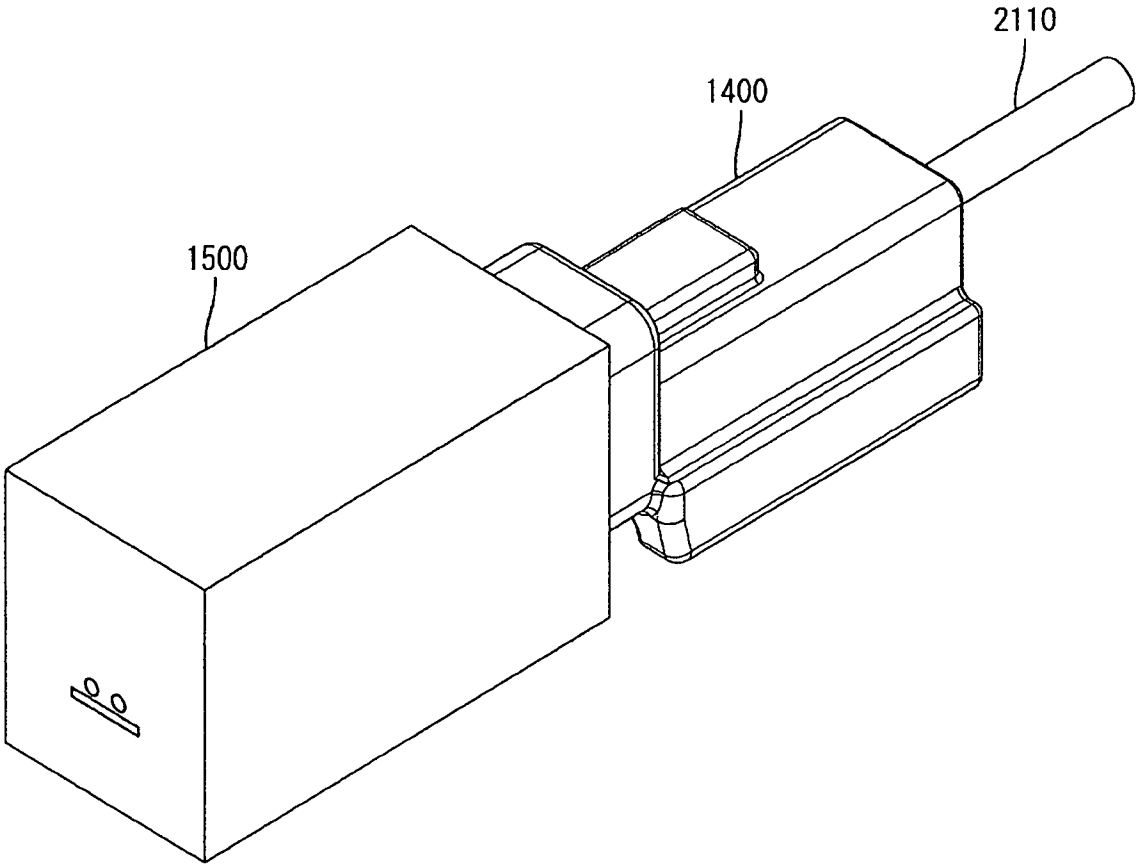
FIG. 109 is a perspective view in a state where the connector is set in a tool.
Figure 110:
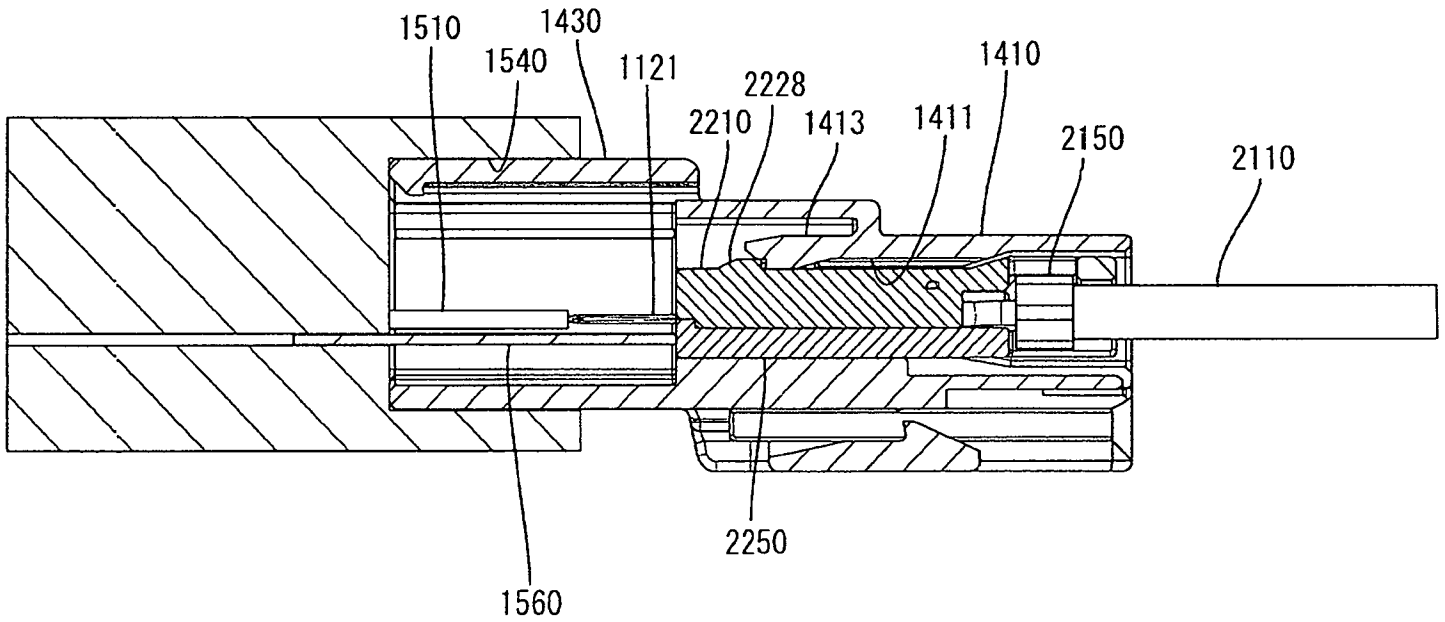
FIG. 110 is a section in the state where the connector is set in the tool.

Then, as shown in FIGS. 109 and 110, the lower terminal holding member 2250 is pushed rearward. A tool 1500 is fit to the receptacle 1430 of the connector housing 1400 from the front. A pushing portion 1530 is pushed rearward with the receptacle 1430 fit in the tool receptacle 1540 and the tips of the terminals 1120 butting against terminal protecting portions 1510. Then, the pushing portion 1530 contacts the front surface of the lower terminal holding member 2250 and the lower terminal holding member 2250 is pushed rearward while the guides 2225 of the upper terminal holding member 2210 and the rails 2263 of the lower terminal holding member 2250 are sliding on each other.

Figure 112:
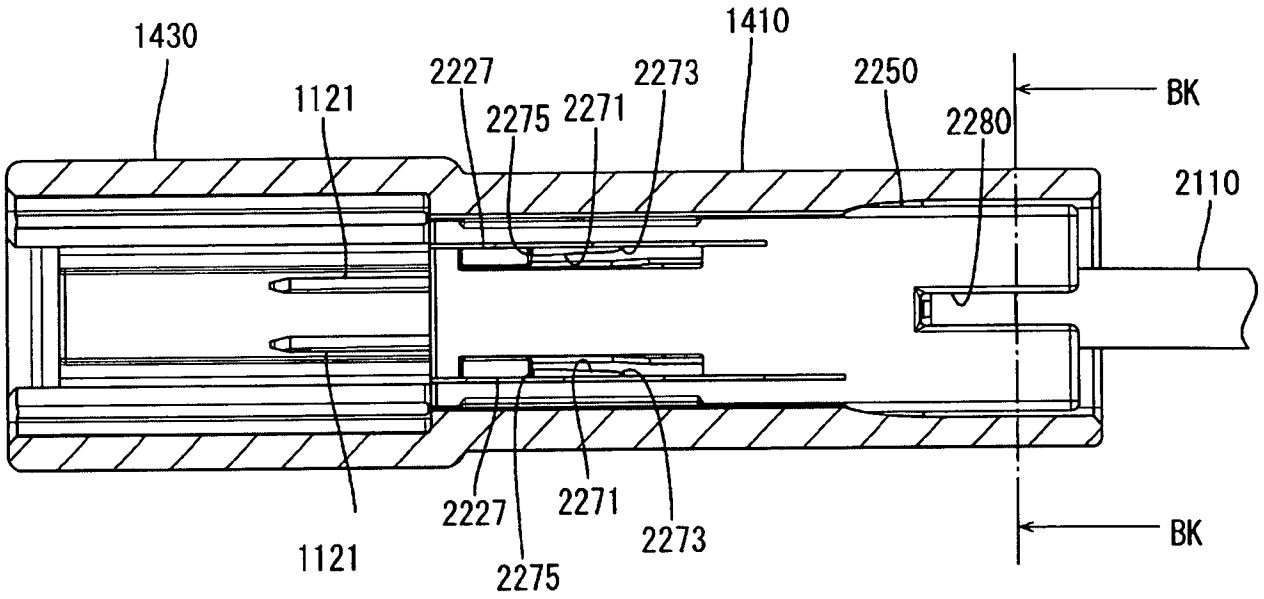
FIG. 112 is a section at position BJ-BJ in FIG. 111.
Figure 113:
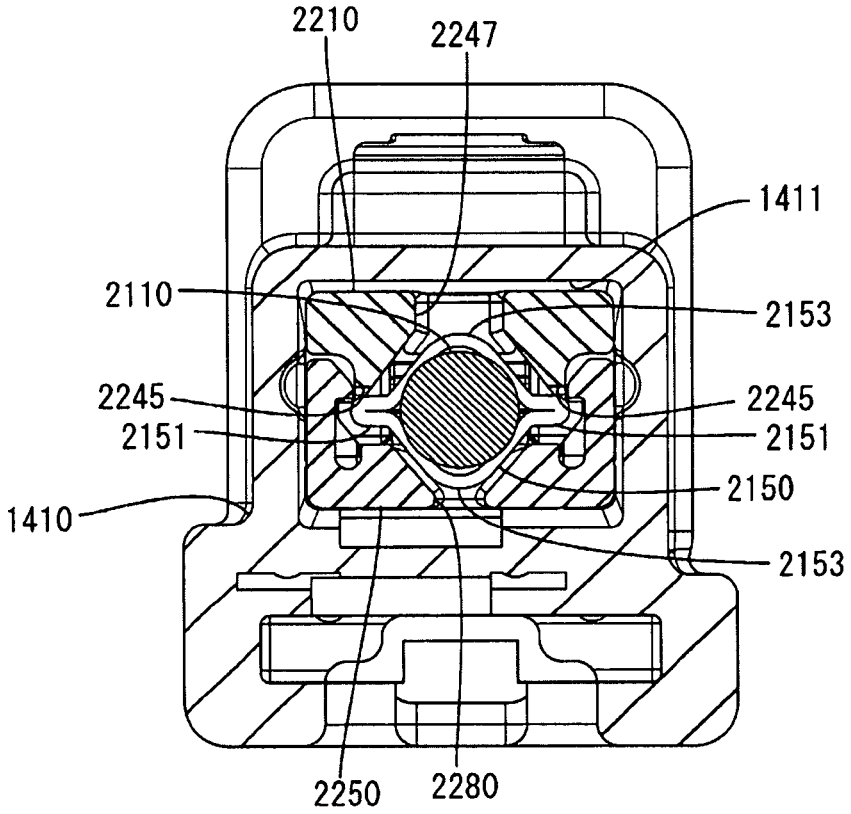
FIG. 113 is a section at position BK-BK in FIG. 112.

When the lower terminal holding member 2250 is pushed rearward, the locking plates 2227 of the upper terminal holding member 2210 move relatively forward by moving over the inclined surfaces 2273 of the locking projections 2271 of the penetrating rails 2270 of the lower terminal holding member 2250, as shown in FIG. 112. When the locking plates 2227 come into contact with the front positions of the penetrating rails 2270 to stop, the lower terminal holding member 2250 also cannot be moved any farther rearward and the pushing is stopped.

Figure 111:
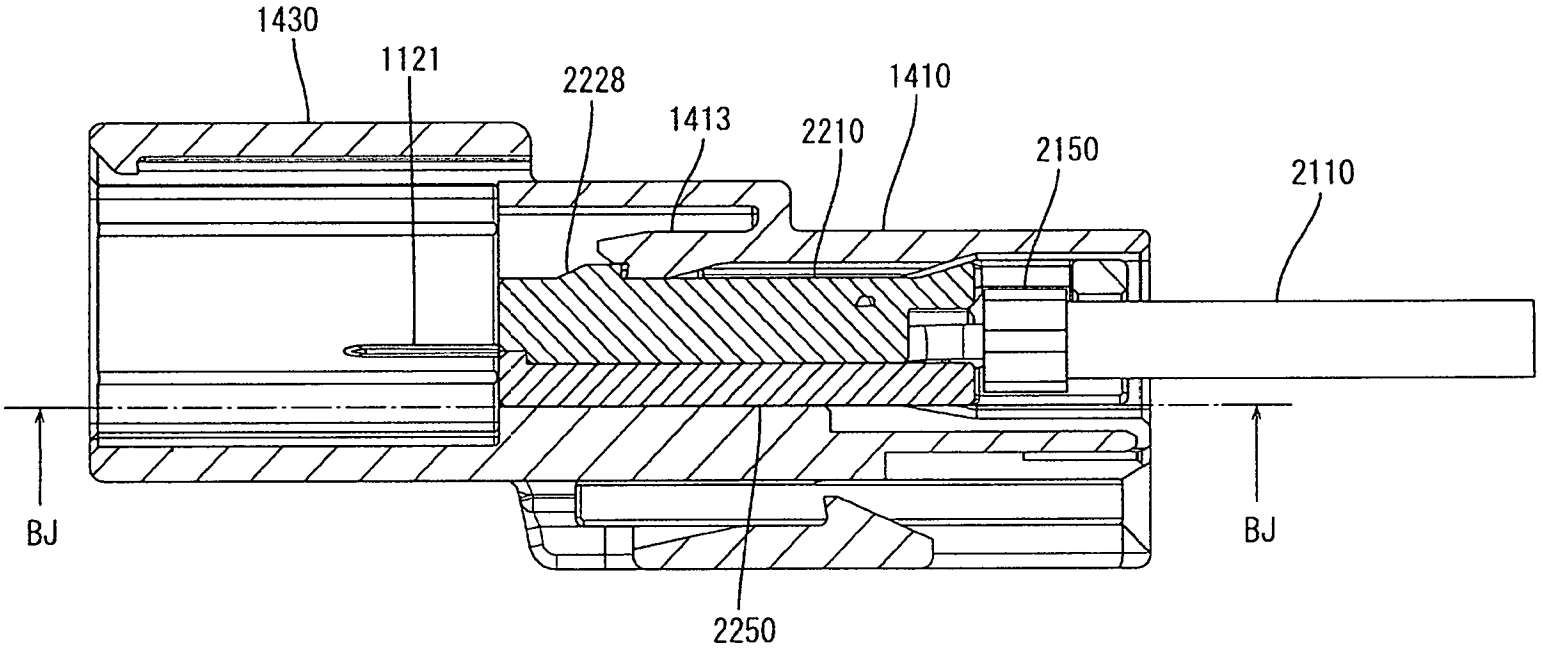
FIG. 111 is a section in a state where the connector is detached from the tool.

When the lower terminal holding member 2250 completely overlaps the upper terminal holding member 2210 and reaches a proper position, the electrically connecting portions 1121 are accommodated in the receptacle 1430 of the connector housing 1400 while projecting from the terminal holding member 2200, as shown in FIGS. 111 and 112. On the other hand, the terminal locked portions 1130 and the crimping portions 1123 are sandwiched and accommodated between the lower terminal holding member 2250 and the upper terminal holding member 2210. Further, as shown in FIG. 114, the bracket 2150 is sandwiched and accommodated between the bracket accommodating portion 2241 and the bracket cut portion 2280. The locking claws 2249 of the upper terminal holding member 2210 are locked to the rear end parts of the rails 2263, thereby suppressing vertical separation of the rear end parts of the upper terminal holding member 2210 and the lower terminal holding member 2250. Further, the locking plates 2227 are disposed at the front positions of the penetrating rails 2270 and locked to the perpendicular surfaces 2275 of the locking projections 2271 in such a state as not to relatively return rearward. Thus, the lower terminal holding member 2250 is fixed to the upper terminal holding member 2210.

Note that when the lower terminal holding member 2250 moves forward with respect to the upper terminal holding member 2210, the terminal locked portions 1130 of the terminals 1120 are fit into the terminal locking portions 1230 of the upper terminal holding member 2210. Thus, shifting movements of the terminals 1120 are suppressed when the lower terminal holding member 2250 moves. Further, the upper terminal holding member 2210 is locked by the locking lance 1413 of the connector housing 1400 and the engaging portions 2229 are held in the fitting grooves 1421. Thus, even if the lower terminal holding member 2250 moves, a movement of the upper terminal holding member 2210 can be prevented. Therefore, the lower terminal holding member 2250 easily is moved with respect to the upper terminal holding member 2210 when being pushed by the tool 1500.

As described above, according to the connector C3 and the terminal module M3 of the third embodiment, the electrically connecting portions 1121 of the terminals 1120 in an exposed state easily contact a wall surface of the connector housing 1400 since the terminal module M3 is inserted through the insertion opening 1419 of the connector housing 1400 provided in the extending direction of the terminals 1120 and the electrically connecting portions 1121, which are tip parts of the terminals 1120, are first inserted. Thus, it is preferable to use the terminal module M3 in which the electrically connecting portions 1121 of the terminals 1120 are protected until the electrically connecting portions 1121 are accommodated at predetermined positions. Further, although the outer conductor shell is not used in the third embodiment, the connector housing 1400 is commonly used also in the case of using an outer conductor shell as in the second embodiment. Thus, manufacturing cost can be reduced.

Other Embodiments

The invention disclosed in this specification is not limited to the above described and illustrated embodiments. For example, the following embodiments also are included in a technical scope.

Although the outer conductor shell 30, 1300 is divided into the lower outer conductor shell 31, 1301 and the upper outer conductor shell 33, 1303 in the above first and second embodiments, the outer conductor shell may be an integral member. In such a case, the terminal holding member 60, 1200 may be inserted through an opening provided on a rear side or the like.

Although the upper terminal holding member 65 is fixed to the lower outer conductor shell 31 to be immovable in the front-rear direction by engaging the engaging portions 95 of the upper terminal holding member 65 with the cut portions 47 of the lower outer conductor shell 31 in the above first embodiment, a movement in the front-rear direction may be restricted by another method. Further, a means for restricting a movement of the upper terminal holding member 65 in the front-rear direction may not be provided.

Although the upper terminal holding member 1210, 2210 is fixed to the outer conductor shell 1300 or the connector housing 1400 to be immovable in the front-rear direction in the above second and third embodiments, a movement in the front-rear direction may be restricted by another method or a part of the method. Further, a means for restricting a movement of the upper terminal holding member 1210, 2210 in the front-rear direction may not be provided.

Although the lower terminal holding member 61 having reached the proper position is fixed by locking the locking portion 75 of the lower terminal holding member 61 to the locked portion 49 of the lower outer conductor shell 31 in the above first embodiment, the lower terminal holding member 61 may be fixed by another method. Further, the lower terminal holding member 61 may be fixed to the upper terminal holding member 65. Further, a locking structure between the lower terminal holding member and the outer housing may be provided also in the second and third embodiments.

Although the full locking portions and the partial locking portions are not provided in the above first embodiment, these may be provided. Further, although the full locking portions and the partial locking portions are realized by locking the locking plate portions 1227, 2227 to the projections 1271, 1273, 2271 in the penetrating rail portions 1270, 2270 in the above second and third embodiments, locking may be effected by another method.

Although there are two signal wires in the above first to third embodiments, one, three or more signal wires may be provided.

Although the terminals 20, 1120 are held in the terminal holding member 60, 1200, 2200 by locking the terminal locked portions 25, 1130 to the terminal locking portions 79, 1230 in the above first to third embodiments, the terminals may be held by another structure.

Although the lower terminal holding member 1250, 2250 is moved by the tool 1500, 1550 in the above second and third embodiments, the lower terminal holding member 1250, 2250 may be moved by being pushed by a connector housing of a mating connector or the like at the time of connection to a mating connector.

LIST OF REFERENCE SIGNS

10 . . . shielded cable
11 . . . signal wire
20 . . . terminal
21 . . . electrically connecting portion (tip part)
23 . . . crimping portion (connecting part)
25 . . . terminal locked portion
30 . . . outer conductor shell
31 . . . lower outer conductor shell (first outer conductor shell)
31A . . . opening
33 . . . upper outer conductor shell (second outer conductor shell)
41 . . . lower body
43 . . . lower barrel
47 . . . cut portion
49 . . . locked portion
51 . . . upper body
53 . . . upper barrel
53A . . . upper plate
57 . . . locking hole
59 . . . lance locking portion
60 . . . terminal holding member
61 . . . lower terminal holding member (first terminal holding member)
65 . . . upper terminal holding member (second terminal holding member)
75 . . . locking portion (first locking portion)
78 . . . accommodation recess
79 . . . terminal locking portion
95 . . . engaging portion (second engaging portion)
C1 . . . connector
M1 . . . terminal module
1110 . . . shielded cable
1111 . . . signal wire
2110 . . . shielded cable
2111 . . . signal wire
1120 . . . terminal
1121 . . . electrically connecting portion (tip part)
1123 . . . crimping portion (connecting part)
1130 . . . terminal locked portion
2150 . . . bracket
1200, 2200 . . . terminal holding member
1210, 2210 . . . upper terminal holding member (first terminal holding member)
1223, 2223 . . . accommodation recess
1227, 2227 . . . locking plate portion (full locking portion, partial locking portion)
2228 . . . lance locking portion (first engaging portion)
2229 . . . engaging portion (first engaging portion)
1230 . . . terminal locking portion
1241 . . . engaging recess (first engaging portion)
1243 . . . engaging portion (first engaging portion)
1245 . . . engaging projection (first engaging portion)
1247 . . . engaging claw portion (first engaging portion)
1250, 2250 . . . lower terminal holding member (second terminal holding member)
1270, 2270 . . . penetrating rail portion
1271 . . . partial locking projection (partial locking portion)
1273 . . . full locking projection (full locking portion)
2271 . . . locking projection
2273 . . . inclined surface (partial locking portion)
2275 . . . perpendicular surface (full locking portion)
1300 . . . outer conductor shell
1301 . . . lower outer conductor shell (first outer conductor shell)
1303 . . . upper outer conductor shell (second outer conductor shell)
1309 . . . opening
1310 . . . lower body
1340 . . . lower barrel
1350 . . . upper body
1380 . . . upper barrel
1400 . . . connector housing
1500, 1550 . . . tool
C2, C3 . . . connector
M2, M3 . . . terminal module
S2 . . . connector subassembly

The invention claimed is:

1. A terminal module to be accommodated into an outer housing, comprising:

at least one male terminal to be connected to an end of at least one signal wire;

a first terminal holding member including opposite front and rear ends and at least one accommodation recess extending between the front and rear ends, a lateral side of the first terminal holding member being open from the front end to the rear end for accommodating insertion of the at least one male terminal inserted into the at least one accommodation recess in a direction intersecting an extending direction of the at least one male terminal with a tip part of the at least one male terminal projecting forward from the front end of the first terminal holding member; and a second terminal holding member to be assembled with the first terminal holding member;

the second terminal holding member being relatively movable rearward toward an end of the signal wire from a terminal tip protection position where the second terminal holding member covers the tip part of the at least one male terminal projecting from the first terminal holding member to a terminal tip projecting position where the tip part of the at least one male terminal projects forward from second terminal holding member.

2. The terminal module of claim 1, wherein the at least one male terminal comprises plural male terminals and the at least one accommodation recess comprises plural accommodation recesses respectively accommodating the plural male terminals.

3. The terminal module of claim 1, wherein the first and second terminal holding members include partial locking portions locking the first and second terminal holding members to each other at the terminal tip protection position and full locking portions for locking the first and second terminal holding members to each other at a position shifted toward the end of the signal wire.

4. A connector, comprising:

the terminal module of claim 1; and the outer housing for accommodating the terminal module;

the outer housing being an outer conductor shell made of metal.

5. The connector of claim 4, wherein:

the outer conductor shell is divided into first and second outer conductor shells;

the first outer conductor shell includes an opening larger than the first and second terminal holding members with the tip part of the terminal covered by the second terminal holding member; and the second outer conductor shell covers the opening.

6. A connector, comprising:

the terminal module of claim 1; and the outer housing for accommodating the terminal module;

the outer housing being a connector housing made of synthetic resin and including an insertion opening through which the terminal module is inserted in the extending direction of the terminal with the tip part of the terminal more forward than other parts of the terminal.

7. A connector, comprising:

a terminal module that includes:

at least one male terminal to be connected to an end of at least one signal wire, a first terminal holding member including at least one accommodation recess for accommodating the at least one male terminal inserted in a direction intersecting an extending direction of the at least one male terminal with a tip part of the at least one male terminal projecting, and a second terminal holding member to be assembled with the first terminal holding member, the second terminal holding member being relatively movable toward an end of the signal wire from a terminal tip protection position where the second terminal holding member covers the tip part of the at least one male terminal projecting from the first terminal holding member; and an outer housing for accommodating the terminal module, the outer housing being a connector housing made of synthetic resin and including an insertion opening through which the terminal module is inserted in the extending direction of the terminal with the tip part of the terminal in the lead, wherein the second terminal holding member includes a second engaging portion engageable with the outer housing.

8. The connector of claim 7, wherein the first terminal holding member includes a first locking portion lockable to the outer housing at a position shifted toward the end of the signal wire.

9. The connector of claim 6, wherein the first terminal holding member includes a terminal locking portion for locking the terminal and a first engaging portion engageable with the outer housing.

10. A connector, comprising:

a terminal module that includes:

at least one male terminal to be connected to an end of at least one signal wire, a first terminal holding member including at least one accommodation recess for accommodating the at least one male terminal inserted in a direction intersecting an extending direction of the at least one male terminal with a tip part of the at least one male terminal projecting, and a second terminal holding member to be assembled with the first terminal holding member, the second terminal holding member being relatively movable toward an end of the signal wire from a terminal tip protection position where the second terminal holding member covers the tip part of the at least one male terminal projecting from the first terminal holding member; and an outer housing for accommodating the terminal module, the outer housing being an outer conductor shell made of metal, wherein the second terminal holding member includes a second engaging portion engageable with the outer housing.

11. The connector of claim 10, wherein the first terminal holding member includes a first locking portion lockable to the outer housing at a position shifted toward the end of the signal wire.

12. The connector of claim 4, wherein the first terminal holding member includes a terminal locking portion for locking the terminal and a first engaging portion engageable with the outer housing.

* * * * *